US011737946B2

(12) United States Patent
Kabes

(10) Patent No.: US 11,737,946 B2
(45) Date of Patent: Aug. 29, 2023

(54) ADAPTED FITNESS EQUIPMENT

(71) Applicant: Joseph Warren Kabes, Rochester, NY (US)

(72) Inventor: Joseph Warren Kabes, Rochester, NY (US)

(73) Assignee: Inclusivity, Inc., Rochester, NY (US)

( * ) Notice: Subject to any disclaimer, the term of this patent is extended or adjusted under 35 U.S.C. 154(b) by 82 days.

(21) Appl. No.: 17/166,362

(22) Filed: Feb. 3, 2021

(65) Prior Publication Data

US 2021/0251840 A1 Aug. 19, 2021

Related U.S. Application Data

(60) Division of application No. 16/258,634, filed on Jan. 27, 2019, now Pat. No. 10,932,982, which is a (Continued)

(51) Int. Cl.
*A61H 3/00* (2006.01)
*A63B 21/16* (2006.01)
(Continued)

(52) U.S. Cl.
CPC ..... *A61H 3/00* (2013.01); *A63B 21/16* (2013.01); *A63B 49/08* (2013.01); *A63B 60/06* (2015.10); *A63B 65/12* (2013.01); *A63B 65/122* (2013.01); *A63B 69/407* (2013.01); *A63B 71/0009* (2013.01); *A61H 2003/002* (2013.01); *A61H 2201/0192* (2013.01); *A61H 2201/1635* (2013.01); *A63B 22/20* (2013.01); *A63B 2071/0018* (2013.01);
(Continued)

(58) Field of Classification Search
CPC ..... A61H 3/00; A61H 2003/002; A61H 2201/0192; A61H 2201/1635; A63B 21/16; A63B 49/08; A63B 60/06; A63B 65/12; A63B 65/122; A63B 69/407; A63B 71/0009; A63B 22/20; A63B 2071/0018; A63B 2071/025; A63B 2102/02; A63B 2102/14; A63B 2102/18; A63B 2102/32; A63B 2225/09; A63B 2225/50; A63B 2243/0037; A63B 71/00
See application file for complete search history.

(56) References Cited

U.S. PATENT DOCUMENTS 3,986,502 A 10/1976 Gilson
4,368,898 A * 1/1983 Lay ..... A63B 71/0009 473/56

(Continued)

*Primary Examiner* — Garrett K Atkinson
(74) *Attorney, Agent, or Firm* — Dawson Law Firm, P.C.; Michael J. Nickerson

(57) ABSTRACT

An exercise apparatus includes an adjustable frame being attachable to an assistive ambulation device. The adjustable frame includes removable handles, fitting arms located on a lower portion of the adjustable frame to receive a fitness attachment, and attachment points on located on the lower portion of the adjustable frame to couple a resistance device. A jump rope trainer includes a handle; flexible tubing including a handle fastener to connect the handle to the flexible tubing; and a soft sphere shaped object. The flexible tubing includes a soft sphere shaped object fastener to connect the soft sphere shaped object to the flexible tubing.

9 Claims, 46 Drawing Sheets

Related U.S. Application Data continuation-in-part of application No. 15/072,417, filed on Mar. 17, 2016, now Pat. No. 10,188,929.

(60) Provisional application No. 62/796,625, filed on Jan. 25, 2019, provisional application No. 62/783,406, filed on Dec. 21, 2018, provisional application No. 62/675,230, filed on May 23, 2018, provisional application No. 62/675,266, filed on May 23, 2018, provisional application No. 62/149,542, filed on Apr. 18, 2015, provisional application No. 62/135,764, filed on Mar. 20, 2015.

(51) Int. Cl.

| | |
|---|---|
| ***A63B 71/00*** | (2006.01) |
| ***A63B 65/12*** | (2006.01) |
| ***A63B 49/08*** | (2015.01) |
| ***A63B 69/40*** | (2006.01) |
| ***A63B 60/06*** | (2015.01) |
| ***A63B 102/32*** | (2015.01) |
| ***A63B 102/02*** | (2015.01) |
| ***A63B 102/14*** | (2015.01) |
| ***A63B 102/18*** | (2015.01) |
| ***A63B 22/20*** | (2006.01) |
| ***A63B 71/02*** | (2006.01) |

(52) U.S. Cl.

CPC ..... *A63B 2071/025* (2013.01); *A63B 2102/02* (2015.10); *A63B 2102/14* (2015.10); *A63B 2102/18* (2015.10); *A63B 2102/32* (2015.10); *A63B 2225/09* (2013.01); *A63B 2225/50* (2013.01); *A63B 2243/0037* (2013.01)

(56) References Cited

U.S. PATENT DOCUMENTS 4,453,742 A 6/1984 Zepkowski
4,470,598 A * 9/1984 Steele ..... A63B 71/0009 473/56
4,753,449 A * 6/1988 Doucet ..... A63B 71/0009 D12/133
4,824,132 A * 4/1989 Moore ..... A61G 5/10 280/250.1
4,836,151 A 5/1989 Nuredin
4,867,445 A * 9/1989 Connelly ..... A63B 21/4035 482/136
4,986,802 A 1/1991 Scoville et al.
5,080,350 A * 1/1992 Schofield ..... A63B 23/03508 482/133
5,116,067 A 5/1992 Johnson
5,284,131 A 2/1994 Gray
5,330,402 A 7/1994 Johnson
5,358,446 A * 10/1994 Bergman ..... A63D 5/00 273/129 Q
5,358,447 A * 10/1994 Erickson ..... A63D 5/00 473/56
5,379,154 A 3/1995 Baldwin
5,478,283 A * 12/1995 Hoblit ..... A63B 71/00 473/56
5,478,299 A 12/1995 Harmon et al.
5,520,597 A 5/1996 Tobin
5,584,783 A * 12/1996 Hagg ..... A63B 22/0605 482/148
5,645,516 A 7/1997 Foster
5,713,821 A * 2/1998 Nissen ..... A63B 21/154 482/131
5,807,185 A * 9/1998 Raubuck ..... A63B 65/12 473/282
5,807,211 A 9/1998 Berryhill
5,895,341 A 4/1999 Jones
5,913,749 A * 6/1999 Harmon ..... A63B 21/1672 482/129
6,004,233 A 12/1999 Raubuck et al.
6,042,482 A * 3/2000 Wilds ..... A63D 5/00 473/56
6,227,981 B1 * 5/2001 Lizama Troncoso ..... A63B 71/0009 473/56
6,416,447 B1 7/2002 Harmon
6,453,921 B1 * 9/2002 Rost ..... A61H 3/00 482/68
6,474,671 B1 * 11/2002 San Miguel Gomez ..... A61G 5/10 280/304.1
6,612,971 B1 * 9/2003 Morris ..... A63B 23/047 73/379.06
6,645,127 B1 11/2003 Petes
6,692,417 B2 * 2/2004 Burrell ..... A63B 21/00047 482/141
6,887,188 B1 5/2005 Davies
7,001,313 B1 2/2006 Crnkovich
7,104,565 B1 9/2006 Albert et al.
7,370,734 B2 5/2008 Hallgrimsson
7,377,285 B2 5/2008 Karasin et al.
7,429,253 B2 9/2008 Shimada et al.
7,510,214 B1 * 3/2009 Oxford ..... A63B 71/0009 482/77
7,874,962 B1 * 1/2011 Pestes ..... A63B 22/02 482/904
8,061,376 B2 * 11/2011 Ryan ..... A61H 3/04 482/68
8,075,455 B2 12/2011 Gamboa et al.
8,088,047 B2 1/2012 Marji
8,142,333 B2 3/2012 LaTour
8,162,809 B1 4/2012 Eastwood
8,434,824 B2 5/2013 Spinabella et al.
8,579,259 B2 11/2013 Okerlund et al.
8,936,538 B2 1/2015 Marcantonio
8,961,186 B2 * 2/2015 LoSasso ..... A63B 22/20 434/255
9,149,408 B2 * 10/2015 Karlovich ..... A47C 1/00
9,162,101 B2 * 10/2015 Zondervan ..... A61G 5/10
9,393,173 B1 * 7/2016 Meza ..... A61H 3/04
9,682,005 B2 6/2017 Herr et al.
2002/0086780 A1 * 7/2002 Morris ..... A63B 23/047 482/136
2002/0169058 A1 11/2002 Harmon
2003/0203792 A1 * 10/2003 Pestes ..... A63B 71/0009 482/60
2006/0064047 A1 3/2006 Shimada et al.
2008/0161162 A1 * 7/2008 Dokshutsky ..... A63B 21/153 482/129
2011/0143893 A1 * 6/2011 Marcantonio ..... A63B 23/1209 482/112
2014/0371038 A1 * 12/2014 Markowitz ..... A63B 21/0414 482/123
2015/0057137 A1 2/2015 Chen
2015/0335940 A1 * 11/2015 Johnson ..... A61H 3/04 248/118
2017/0036086 A1 * 2/2017 Giner Gil ..... A63B 71/0009
2017/0246492 A1 8/2017 Herr et al.

* cited by examiner

7000

8000

9000

ADAPTED FITNESS EQUIPMENT

PRIORITY INFORMATION

The present application is a divisional application of co-pending U.S. patent application Ser. No. 16/258,634, filed on Jan. 27, 2019, and claims priority, under 35 U.S.C. § 120, from co-pending U.S. patent application Ser. No. 16/258,634, filed on Jan. 27, 2019, said co-pending U.S. patent application Ser. No. 16/258,634, filed on Jan. 27, 2019 is a continuation-in-part application of U.S. patent application Ser. No. 15/072,417, filed on Mar. 17, 2016, and claims priority, under 35 U.S.C. § 120, from said U.S. patent application Ser. No. 15/072,417, filed on Mar. 17, 2016; said U.S. patent application Ser. No. 15/072,417, filed on Mar. 17, 2016, claiming priority, under 35 U.S.C. § 119(e), from U.S. Provisional Patent Application No. 62/135,764, filed on Mar. 20, 2015 and claiming priority, under 35 U.S.C. § 119(e), from U.S. Provisional Patent Application No. 62/149,542, filed on Apr. 18, 2015.

The entire content of U.S. patent application Ser. No. 16/258,634, filed on Jan. 27, 2019, is hereby incorporated by reference.

This application claims priority from U.S. Provisional Patent Application, Ser. No. 62/135,764, filed on Mar. 20, 2015. The entire content of U.S. Provisional Patent Application, Ser. No. 62/135,764, filed on Mar. 20, 2015, is hereby incorporated by reference.

This application claims priority from U.S. Provisional Patent Application, Ser. No. 62/149,542, filed on Apr. 18, 2015. The entire content of U.S. Provisional Patent Application, Ser. No. 62/149,542, filed on Apr. 18, 2015, is hereby incorporated by reference.

This application claims priority from U.S. Provisional Patent Application, Ser. No. 62/675,230, filed on May 23, 2018. The entire content of U.S. Provisional Patent Application, Ser. No. 62/675,230, filed on May 23, 2018, is hereby incorporated by reference.

This application claims priority from U.S. Provisional Patent Application, Ser. No. 62/675,266, filed on May 23, 2018. The entire content of U.S. Provisional Patent Application, Ser. No. 62/675,266, filed on May 23, 2018, is hereby incorporated by reference.

This application claims priority from U.S. Provisional Patent Application, Ser. No. 62/783,406, filed on Dec. 21, 2018. The entire content of U.S. Provisional Patent Application, Ser. No. 62/783,406, filed on Dec. 21, 2018, is hereby incorporated by reference.

This application claims priority from U.S. Provisional Patent Application, Ser. No. 62/796,625, filed on Jan. 25, 2019. The entire content of U.S. Provisional Patent Application, Ser. No. 62/796,625, filed on Jan. 25, 2019, is hereby incorporated by reference.

BACKGROUND

Exercise can help with weight control, can help improve an individual's health conditions, can help fight disease, can help improve an individual's mood, and/or can help boost an individual's energy level. The benefits of consistent strength training and aerobic exercise have been well documented by the medical field.

In order to assist people in achieving muscular strength, muscular endurance, and cardiovascular endurance, developers of conventional exercise equipment have come out with numerous devices including electronic, cam/pulley, and weight stack resistance machines, as well as cardiovascular machines; such as, rowers, stationary bicycles, treadmills, stair climbers, etc.

However, a large number of conventional exercise equipment is not configured for use by individuals with physical disabilities or special needs, such as individuals requiring a wheelchair, walker, stander, and/or other assistive ambulation device.

This shortfall in the amount of exercise equipment available to individuals with physical disabilities or special needs has made it difficult for individuals with physical disabilities or special needs to benefit from exercise.

Moreover, this shortfall in the amount of exercise equipment available to individuals with physical disabilities or special needs has, in some instances created a sense of exclusion for the individuals as they cannot participate in many activities, thereby negatively impacting their sense of self-worth.

On the other hand, if an individual with physical disabilities or special needs uses non-configured conventional exercise equipment, the individual may find the equipment difficult to use and/or unsafe to use.

Another form of exercise is jump rope. However, jump rope is not necessarily an easy skill to master for individuals with no physical disabilities or special needs, let alone for an individual with a physical disability or special need.

More specifically, individuals with physical disabilities or special needs; such as grasping issues and/or limited to no ability to walk; are unable to actually jump a traditional jump rope. Thus, these individuals miss out on the aerobic and anaerobic benefits of this form of exercise.

With traditional jump ropes, there is usually one length of rope attached to handles at each end. The user grips the handles and swings the rope over and jumps over the rope as it passed under the user's feet. The object is to continue this pattern in a rhythmic fashion for a specific number of times (jumps) or a given amount of time.

Often, users misjudge the timing of the jumps and lose rhythm and timing and/or trip over the rope, resulting in injury.

To realize the aerobic and anaerobic benefits of jumping rope without the danger and risk of injuring oneself, a conventional jump rope simulator/trainer can be used to mimic a jump rope without a rope actually passing under a user's feet.

The conventional jump rope simulator/trainer is grasped in the hands of the exerciser and rotated. The user may or may not jump periodically and rhythmically depending on their ability.

Since the swinging of the conventional jump rope simulator/trainer mimics the action of swinging a traditional rope, and the user has the choice of jumping or not, they can still attain health and skill related benefits.

Conventional jump rope simulator/trainers utilize a conventional jump rope handle resulting in issues for individuals with physical disabilities or special needs associated with grasping.

Moreover, conventional jump rope simulator/trainers utilize a variety of weighted objects to provide centrifugal force and a cord to produce centripetal force. The weighted objects could be a source of injury if the individual using the conventional jump rope simulator/trainer lacks the motor skills to rotate the weighted object correctly.

Thus, it is desirable to provide adapted fitness equipment that can be used by both ambulatory and non-ambulatory individuals to increase their health and sport-related fitness levels.

It is further desirable to provide adapted fitness equipment that works with multiple forms of assistive ambulation equipment like walkers, wheelchairs, gait trainers, standers, etc.

Moreover, it is desirable to provide adapted fitness equipment that can be used by individuals having different sizes, different levels of physical fitness, and/or different levels of physical disability.

Furthermore, it is desirable to provide a jump rope simulator/trainer that utilizes a grasping mechanism (handle) that enables an individual with physical disabilities or special needs associated with grasping to effectively use the jump rope simulator/trainer.

In addition, it is desirable to provide a jump rope simulator/trainer that utilizes a rotating member, which provides centrifugal force, which is shaped to reduce injury to individuals who lack the motor skills to rotate the rotating member correctly.

BRIEF DESCRIPTION OF THE DRAWINGS

The drawings are only for purposes of illustrating various embodiments and are not to be construed as limiting, wherein.

DETAILED DESCRIPTION

Figure 1:
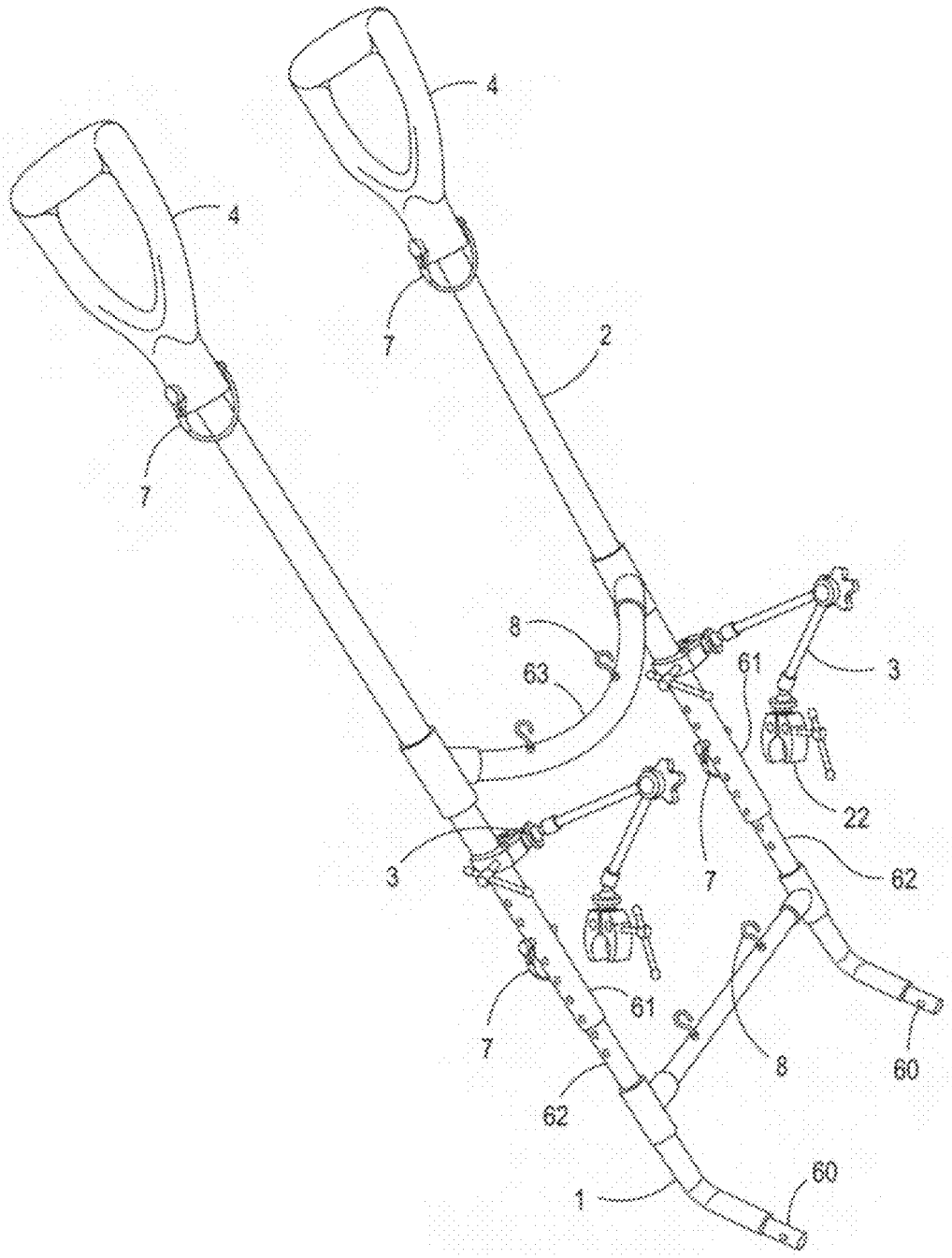
FIG. 1 illustrates a schematic view of an upper and lower frame of an exercise apparatus including a clamping mechanism.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts could be properly illustrated.

As illustrated in FIG. 1, an exercise apparatus includes a lower frame and an upper frame. The lower frame and upper frame may be composed of rigid interconnecting tubes (1 and 2).

Although FIG. 1 illustrates the lower frame and the upper frame being constructed of rigid interconnecting tubes, the frame may be constructed of any rigid lightweight material. Moreover, the frames need not be formed of tubes but may have any geometric shape that allows interconnectability.

Figure 3:
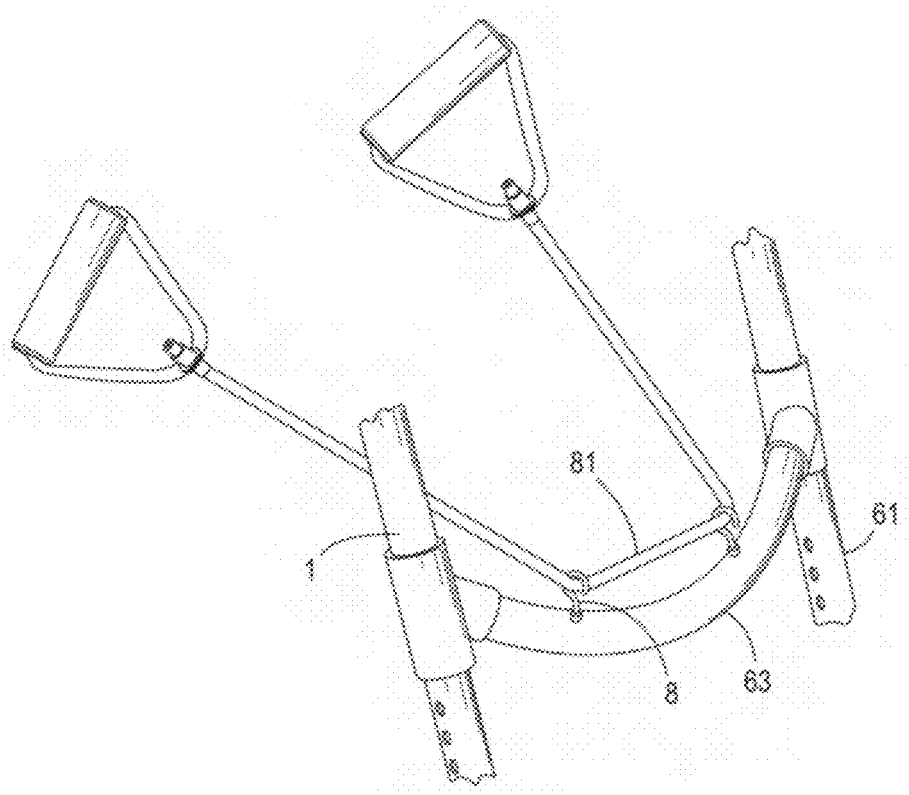
FIG. 3 illustrates a fragmentary view of the lower embodiment of the exercise apparatus of FIG. 1, showing attachments for various fitness tubing and resistance training devices.

The lower frame includes fitting arms 60, which are configured to receive various fitness and/or sport related skill attachments. The lower frame and upper frame include fastener elements 8 for attaching a variety of resistance tubing (as illustrated in FIG. 3) and weight resistance devices (not shown).

Although FIG. 1 illustrates the fitting arms 60 as being projections from the lower frame that are received by an attachment, the attachment may have projecting fitting arms and the lower frame has a receiving portion for engaging the fitting arms. Moreover, the mechanism for connecting the lower frame to the attachment may be any conventional connecting mechanism that facilitates connect and disconnect characteristics.

For example, the mechanism for connecting the lower frame to the attachment may be a pin 7, as illustrated in FIG. 1. Moreover, the mechanism for connecting the lower frame to the attachment may be a shear pin to protect the lower frame and/or the attachment (not shown).

The upper frame includes interchangeable detachable handles 4, which may be attached by a pin 7. The lower frame includes an incremental lower frame adjustment section 62 that includes points/holes. The upper frame also includes an incremental upper frame adjustment section 61 that includes points/holes.

As illustrated in FIG. 1, the lower frame is connected to the upper frame by lining up holes in the incremental lower frame adjustment section 62 and incremental upper frame adjustment section 61 and inserting a pin 7 through the lined up holes. This allows the overall frame to be adjusted to accommodate individuals and equipment of various sizes.

Although FIG. 1 illustrates the exercise apparatus as being constructed of two detachable frames, the exercise apparatus may be an integral frame that is capable of expanding and contracting in length to facilitate connection to various assistive ambulation devices and to accommodate individuals and equipment of various sizes.

The lined up holes hold the lower frame and upper frame together by attaching pins 7. The fitting arms 60 hold the lower frame to a fitness and/or sport related skill attachment (not shown) by using pins 7. The attachment points (not shown) on interchangeable detachable handles 4 hold interchangeable detachable handles 4 to the upper frame by pins 7.

It is noted that although the attaching pins 7 have been illustrated as removable locking pins, it is noted that the incremental lower frame adjustment section 62 of the lower frame or the incremental upper frame adjustment section 61 of the upper frame may have built-in push pins that enables the securing of the lower frame and upper frame together.

It is further noted that the connecting mechanism for connecting the lower and upper frames may be any conventional connection mechanism that enables expanding and contracting in length to facilitate connection to various assistive ambulation devices and to accommodate individuals and equipment of various sizes.

FIG. 1 also illustrates an articulation system, which includes clamp 22 and articulation arm 3, which enables the exercise apparatus to be securely mounted to a wheelchair, walker, gait trainer, stander, and/or other assistive ambulation equipment.

Lastly, FIG. 1 illustrates horizontal support 63 connected between vertical sections of the lower frame and upper frame. The fastener elements 8 are located on the horizontal support 63.

Although FIG. 1 illustrates two horizontal supports, the exercise apparatus may include more than two horizontal supports connected between vertical sections of the lower frame and upper frame.

It is noted that non-abrasive feet/skis, wheels, rollers, and/or bearings may be statically attached to the lower frame near the fitting arms 60. It is further noted that non-abrasive feet/skis, wheels, rollers, and/or bearings may be dynamically attached to the lower frame near the fitting arms 60 so to allow the non-abrasive feet/skis, wheels, rollers, and/or bearings to float with the terrain and/or floor.

Figure 2:
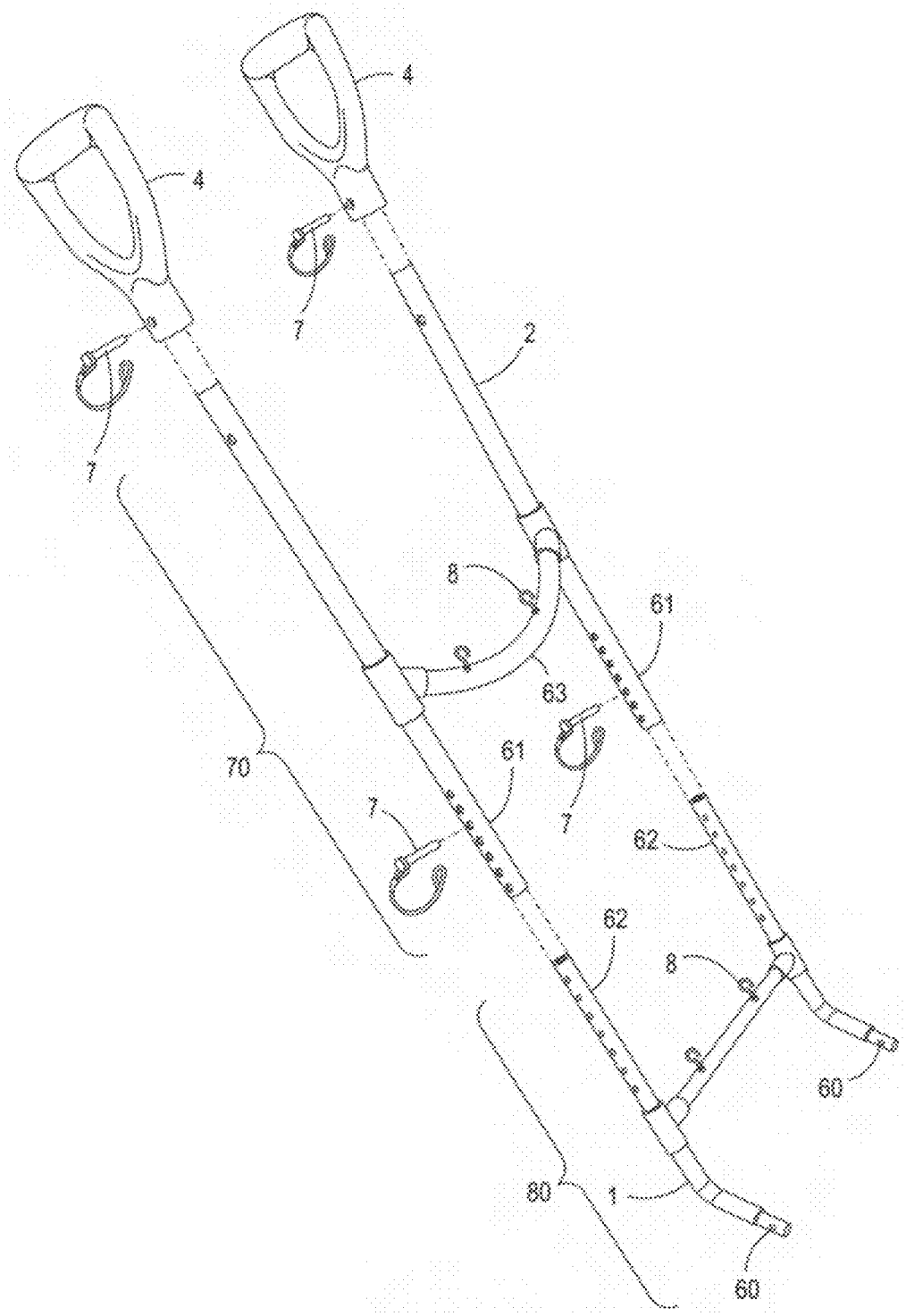
FIG. 2 illustrates a fragmentary view of the exercise apparatus of FIG. 1, showing in detail the adjustability of the upper and lower frame.

FIG. 2 shows a fragmentary view of the exercise apparatus shown in FIG. 1. As illustrated in FIG. 1, FIG. 2 shows an exercise apparatus, which includes a lower frame 80 and an upper frame 70. The lower frame 80 and upper frame 70 may be composed of rigid interconnecting tubes (1 and 2).

Although FIG. 2 illustrates the lower frame 80 and the upper frame 70 being constructed of rigid interconnecting tubes, the frame may be constructed of any rigid lightweight material. Moreover, the frames need not be formed of tubes but may have any geometric shape that allows interconnectability.

The lower frame 80 includes fitting arms 60, which are configured to receive various fitness and/or sport related skill attachments. The lower frame 80 and upper frame 70 include fastener elements 8 for attaching a variety of resistance tubing (as illustrated in FIG. 3) and weight resistance devices (not shown).

Although FIG. 2 illustrates the fitting arms 60 as being projections from the lower frame 80 that are received by an attachment, the attachment may have projecting fitting arms and the lower frame 80 may have a receiving portion for engaging the fitting arms. Moreover, the mechanism for connecting the lower frame 80 to the attachment may be any conventional connecting mechanism that facilitates connect and disconnect characteristics.

For example, the mechanism for connecting the lower frame to the attachment may be a pin 7, as illustrated in FIG. 2. Moreover, the mechanism for connecting the lower frame to the attachment may be a shear pin to protect the lower frame and/or the attachment (not shown).

FIG. 2 shows interchangeable detachable handles 4. The lower frame 80 includes an incremental lower frame adjustment section 62 that includes points/holes. The upper frame 70 also includes an incremental upper frame adjustment section 61 that includes points/holes.

As illustrated in FIG. 2, the lower frame 80 is connected to the upper frame 70 by lining up holes in the incremental lower frame adjustment section 62 and incremental upper frame adjustment section 61 and inserting a pin 7 through the lined up holes. This allows the overall frame to be adjusted to accommodate individuals and equipment of various sizes.

Although FIG. 2 illustrates the exercise apparatus as being constructed of two detachable frames, the exercise apparatus may be an integral frame that is capable of expanding and contracting in length to facilitate connection to various assistive ambulation devices and to accommodate individuals and equipment of various sizes.

The frame adjustment points/holes enables the holding of the lower frame 80 and upper frame 70 together by attaching pins 7. The fitting arms 60 enables the holding of the lower frame 80 to a fitness and/or sport related skill attachment (not shown) by attaching pins 7. The attachment points (not shown) on interchangeable detachable handles 4 enables the holding of interchangeable detachable handles 4 to the upper frame 70 by attaching pins 7.

Lastly, FIG. 2 illustrates horizontal support 63 connected between vertical sections of the lower frame and upper frame. The fastener elements 8 are located on the horizontal support 63.

It is noted that non-abrasive feet/skis, wheels, rollers, and/or bearings may be statically attached to the lower frame near the fitting arms 60. It is further noted that non-abrasive feet/skis, wheels, rollers, and/or bearings may be dynamically attached to the lower frame near the fitting arms 60 so to allow the non-abrasive feet/skis, wheels, rollers, and/or bearings to float with the terrain and/or floor.

In FIG. 3, this fragmentary view provides an example of how a resistance tube 81 attaches to the fastener elements 8, which are affixed to the horizontal support 63 of the upper lower frame 70 in FIG. 3. As illustrated in FIG. 3, the resistance tube 81 attaches to the fastener elements 8 to enable a user to engage in resistance training.

Figure 4:
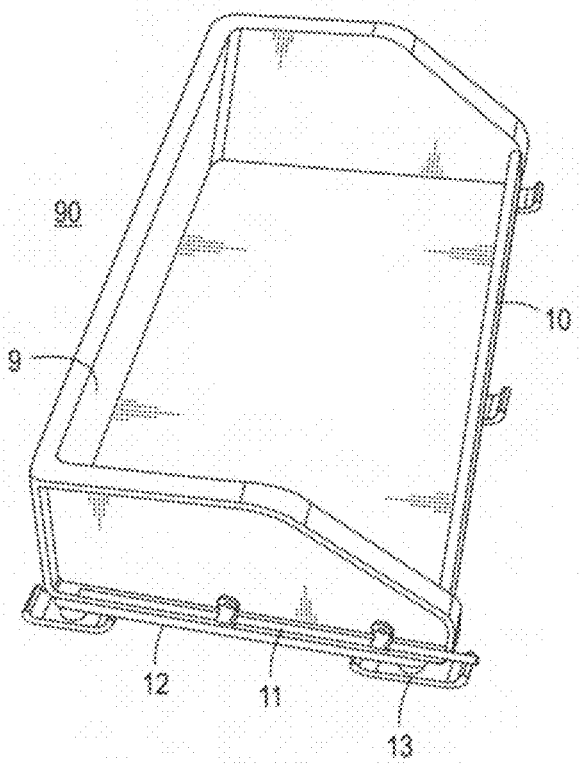
FIG. 4 illustrates a schematic side elevation view of the bucket/sled exercise apparatus attachment.

As illustrated FIG. 4, a bucket/sled exercise apparatus attachment 90 for the exercise apparatus of FIG. 1 may be composed of a molded plastic bucket/sled portion 9, wherein objects or weight resistance can be added to or taken away from depending upon an individual's ability, activity, and/or task.

A molded door 10 may be included, which can be opened or closed and is located in the front of the molded plastic bucket/sled portion 9. Adjustable and retractable guides 11 are mounted to the side of the molded plastic bucket/sled portion 9, which can be pulled out to extend in front of the molded plastic bucket/sled portion 9 and be utilized to aid in manipulating objects. The bucket/sled exercise apparatus attachment 90 may include a light-weight sub-frame 12 upon which the molded plastic bucket/sled portion 9 is mounted.

The bucket/sled exercise apparatus attachment 90 may have non-abrasive feet/skis 13, which are mounted to the sub-frame 12, to facilitate contact with the ground or floor.

It is noted that the bucket/sled exercise apparatus attachment 90 may have wheels, rollers, and/or bearings which are mounted to the sub-frame 12, to facilitate contact with the ground or floor. It is further noted that the non-abrasive feet/skis 13, wheels, rollers, and/or bearings may be statically attached to the sub-frame 12. It is also noted that the non-abrasive feet/skis 13, wheels, rollers, and/or bearings may be dynamically attached to the sub-frame 12 so to allow the non-abrasive feet/skis 13, wheels, rollers, and/or bearings to float with the terrain and/or floor.

Figure 5:
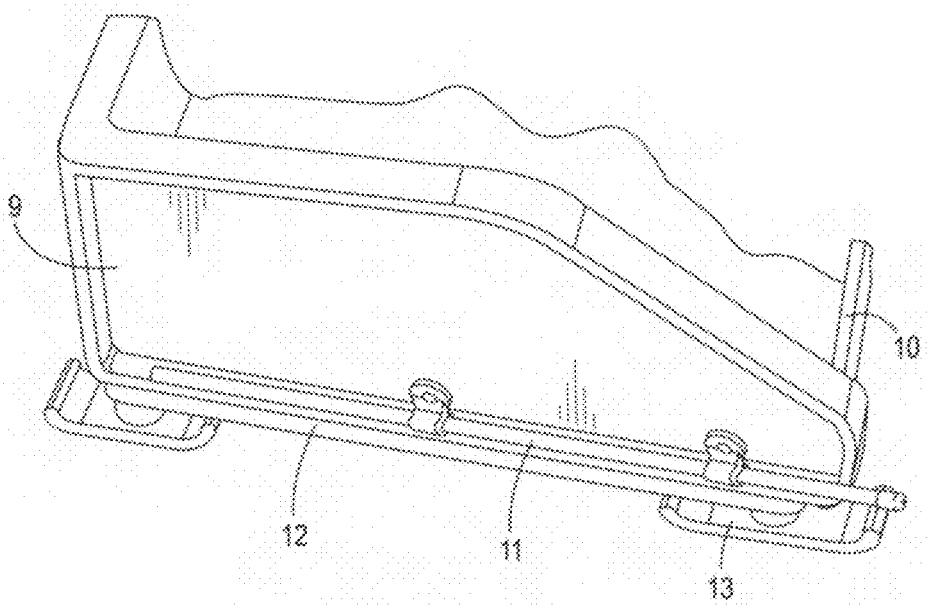
FIG. 5 illustrates a fragmentary side elevation view of a bucket/sled exercise apparatus attachment, showing gliding skis and retractable guides.

FIG. 5 shows a fragmentary side view of the bucket/sled exercise apparatus attachment shown in FIG. 4. As illustrated in FIG. 4, FIG. 5 shows a bucket/sled exercise apparatus attachment for the exercise apparatus of FIG. 1 composed of a molded plastic bucket/sled portion 9.

Although the molded plastic bucket/sled portion 9 has been illustrated as an open bucket, the molded plastic bucket/sled portion 9 may be shaped in various ways; i.e., a mouth, a dinosaur mouth, a hippo mouth, a scope, or other shape that has an opening that enables transporting an object.

Molded door 10 can be opened or closed and is located in the front of the molded plastic bucket/sled portion 9. Adjustable and retractable guides 11 are mounted to the side of the molded plastic bucket/sled portion 9, which can be pulled out to extend in front of the molded plastic bucket/sled portion 9.

The bucket/sled exercise apparatus attachment may include a light-weight sub-frame 12 upon which the molded plastic bucket/sled portion 9 is mounted. The bucket/sled exercise apparatus attachment has non-abrasive feet/skis 13, which are mounted to the sub-frame 12, to facilitate contact with the ground or floor.

It is noted that the bucket/sled exercise apparatus attachment may have wheels, rollers, and/or bearings which are mounted to the sub-frame 12, to facilitate contact with the ground or floor. It is further noted that the non-abrasive feet/skis 13, wheels, rollers, and/or bearings may be statically attached to the sub-frame 12. It is also noted that the non-abrasive feet/skis 13, wheels, rollers, and/or bearings may be dynamically attached to the sub-frame 12 so to allow the non-abrasive feet/skis 13, wheels, rollers, and/or bearings to float with the terrain and/or floor.

Figure 6:
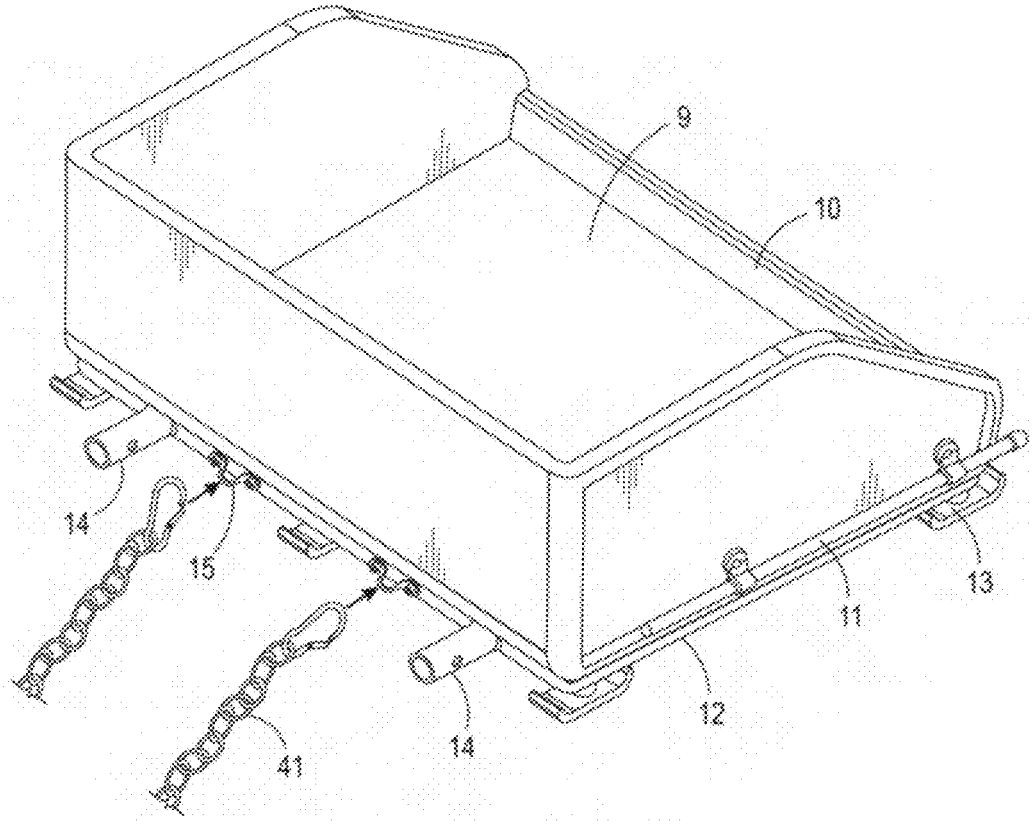
FIG. 6 illustrates a schematic top elevation view of a bucket/sled exercise apparatus attachment, showing attachment points to the lower frame and attachments for pulling devices.

FIG. 6 is a schematic top elevation view of the bucket/sled exercise apparatus attachment shown in FIG. 4. As illustrated in FIG. 6, of the bucket/sled exercise apparatus attachment includes molded door 10, adjustable and retractable guides 11, light-weight sub-frame 12, and the non-abrasive feet/skis 13.

It is noted that the bucket/sled exercise apparatus attachment may have wheels, rollers, and/or bearings which are mounted to the sub-frame 12, to facilitate contact with the ground or floor. It is further noted that the non-abrasive feet/skis 13, wheels, rollers, and/or bearings may be statically attached to the sub-frame 12. It is also noted that the non-abrasive feet/skis 13, wheels, rollers, and/or bearings may be dynamically attached to the sub-frame 12 so to allow the non-abrasive feet/skis 13, wheels, rollers, and/or bearings to float with the terrain and/or floor.

The bucket/sled exercise apparatus attachment includes fitting arm receiving recesses 14 for the fitting arms 60 of the lower frame 80, as illustrated in FIG. 2.

Although FIG. 6 illustrates the fitting arms as being projections from the lower frame that are received by the bucket/sled exercise apparatus attachment at fitting arm receiving recesses 14, the bucket/sled exercise apparatus attachment may have projecting fitting arms and the lower frame have fitting arm receiving recesses for engaging the fitting arms.

Mounted to the lower sub-frame 12 are fastener elements 15, which may receive chains/ropes 41 for pulling the bucket/sled exercise apparatus attachment, enabling the bucket/sled exercise apparatus attachment to be utilized as a push, pull, or drag sled, and/or a means for carrying/transporting objects. It is noted that the fastener elements 15 may also receive various forms of resistance tubing and other resistance training equipment, enabling resistance training.

Figure 7:
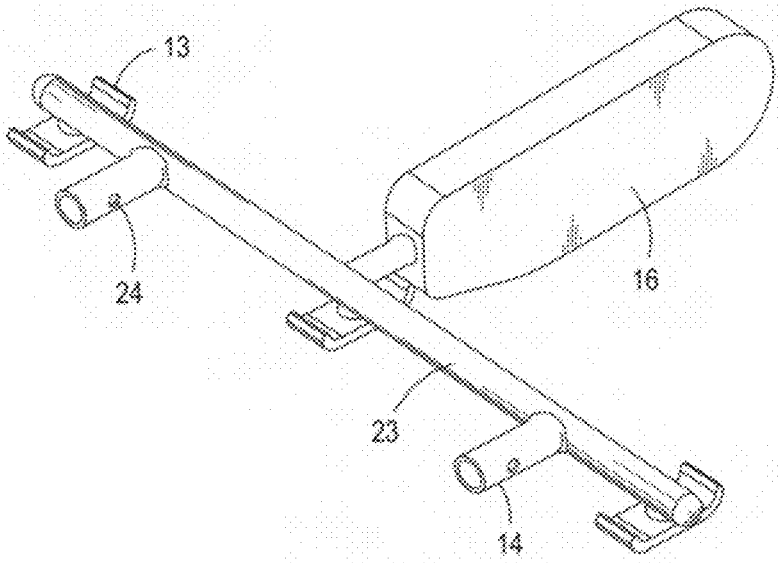
FIG. 7 illustrates a schematic view of a manipulative striking apparatus attachment, showing attachment points to the lower frame and gliding skis.

FIG. 7 is a schematic view of a manipulative striking apparatus attachment for the exercise apparatus of FIG. 1. The manipulative striking apparatus attachment can be utilized to strike, push, and/or manipulate various objects on or near the floor with club/paddle portion 16. The manipulative striking apparatus attachment includes a frame 23, attached non-abrasive feet/skis 13, fitting arm receiving recesses 14, and fitting arm attachment points 24 for engaging the fitting arms 60 of the lower frame 80 of FIG. 2. It is noted that the manipulative striking apparatus attachment may have wheels, rollers, and/or bearings which are mounted to the manipulative striking apparatus attachment, to facilitate contact with the ground or floor. It is further noted that the non-abrasive feet/skis 13, wheels, rollers, and/or bearings may be statically attached to the manipulative striking apparatus attachment. It is also noted that the non-abrasive feet/skis 13, wheels, rollers, and/or bearings may be dynamically attached to the manipulative striking apparatus attachment so to allow the non-abrasive feet/skis 13, wheels, rollers, and/or bearings to float with the terrain and/or floor.

Although FIG. 7 illustrates the fitting arms as being projections from the lower frame that are received by the manipulative striking apparatus attachment at attachment points 24, the manipulative striking apparatus attachment may have projecting fitting arms and the lower frame have fitting arm receiving recesses for engaging the fitting arms.

Figure 8:
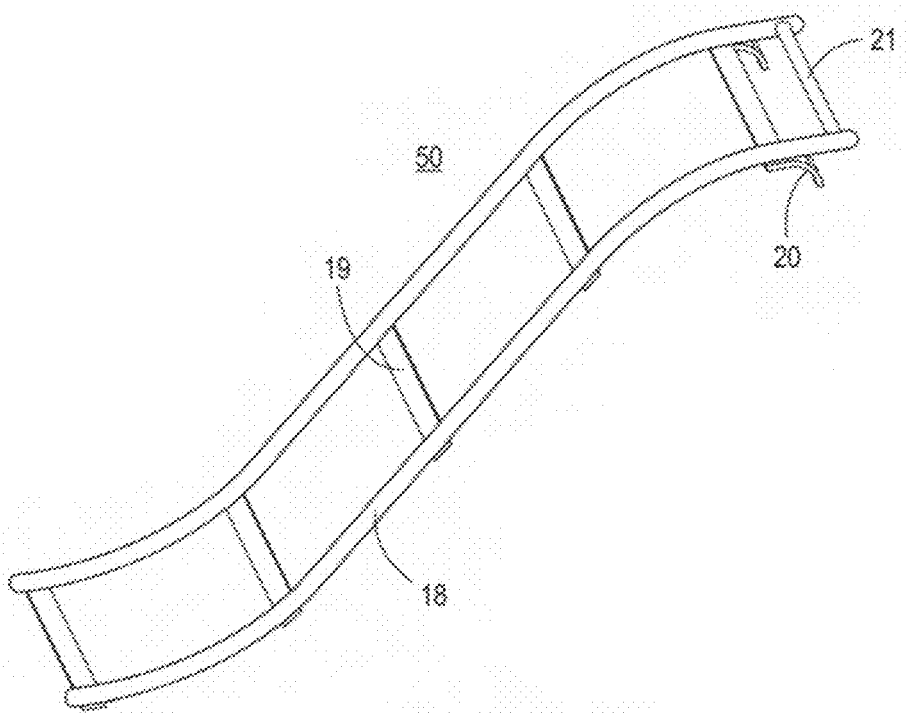
FIG. 8 illustrates a schematic view of a manipulative ramp apparatus attachment, showing attachment points to the upper or lower frame.

FIG. 8 illustrates a schematic view of a manipulative ramp apparatus attachment 50 for the exercise apparatus of FIG. 1. The manipulative ramp apparatus attachment 50 includes ramp rails 18 and horizontal ramp rail supports 19 that provide rigidity for the manipulative ramp apparatus attachment 50. As illustrated in FIG. 8, the manipulative ramp apparatus attachment 50 includes resting platform 21 where an individual can rest or hold objects that are ready to be rolled, slid, or manipulated by the manipulative ramp apparatus attachment 50. Curved attachment points 20 rest or hook onto a horizontal support of the upper frame 70 of FIG. 2.

It is noted that non-abrasive feet/skis, wheels, rollers, and/or bearings may be statically attached to the manipulative ramp apparatus attachment 50 where the manipulative ramp apparatus attachment 50 engages the floor. It is further noted that non-abrasive feet/skis, wheels, rollers, and/or bearings may be dynamically attached to the manipulative ramp apparatus attachment 50 where the manipulative ramp apparatus attachment 50 engages the floor so to allow the non-abrasive feet/skis, wheels, rollers, and/or bearings to float with the terrain and/or floor.

Figure 9:
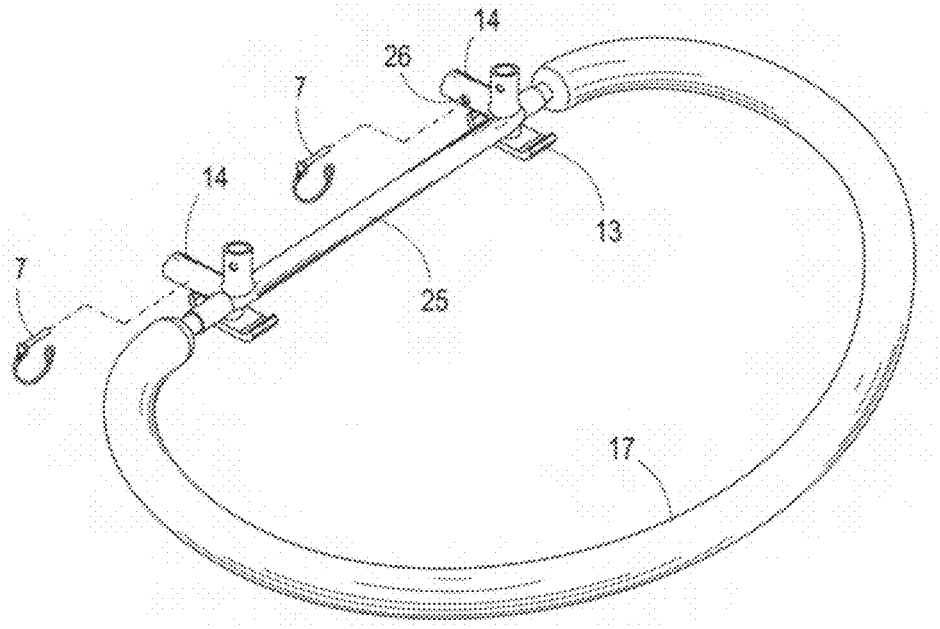
FIG. 9 illustrates a schematic view of a manipulative object controlling apparatus attachment, showing attachment points to the lower frame and the gliding skis and ring for controlling and manipulation of objects.

FIG. 9 is a schematic view of the manipulative object controlling apparatus attachment for the exercise apparatus of FIG. 1. As illustrated in FIG. 9, the manipulative object controlling apparatus attachment includes frame 25, non-abrasive feet/skis 13, fitting arm receiving recesses 14, and fitting arm attachment points 26 for engaging the fitting arms 60 of the lower frame 80 of FIG. 2.

It is noted that the manipulative object controlling apparatus attachment may have wheels, rollers, and/or bearings which are mounted to the manipulative object controlling apparatus attachment, to facilitate contact with the ground or floor. It is further noted that the non-abrasive feet/skis 13, wheels, rollers, and/or bearings may be statically attached to the manipulative object controlling apparatus attachment. It is also noted that the non-abrasive feet/skis 13, wheels, rollers, and/or bearings may be dynamically attached to the manipulative object controlling apparatus attachment so to allow the non-abrasive feet/skis 13, wheels, rollers, and/or bearings to float with the terrain and/or floor.

As illustrated in FIG. 9, the manipulative object controlling apparatus attachment includes attaching pins 7 that attach the manipulative object controlling apparatus attachment to the lower frame 80 of FIG. 2. Manipulative control ring 17 control movement and transport of a multitude of objects, such as a ball.

Figure 10:
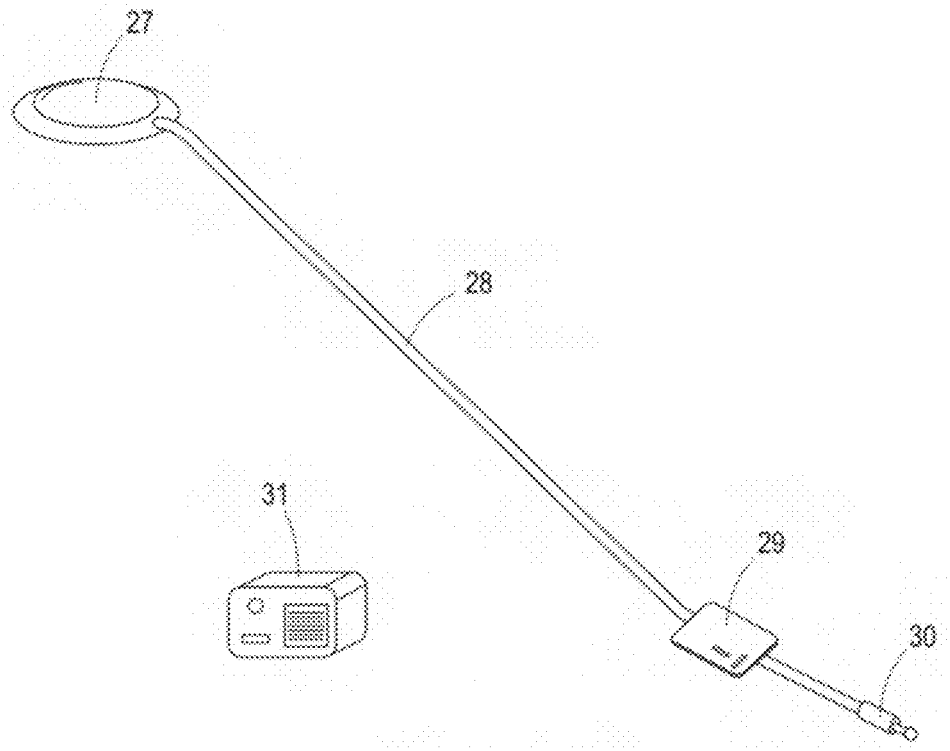
FIG. 10 illustrates a schematic view of basic wiring and control system for sound and relay switch devices.

FIG. 10 is a schematic view of a control system for sound and relay switch devices for the exercise apparatus of FIG. 1. The exercise apparatus may utilize a switch button 27, mounted to upper frame of FIG. 1 (not shown) and wiring 28 that extends through the frame to a power source 29. A wiring adapter 30 enables the switch button 27 to be utilized with electrical components of the various attachments described herein. A sound device 31 can be also be included and activated by motion sensing, a push button, etc.

Figure 11:
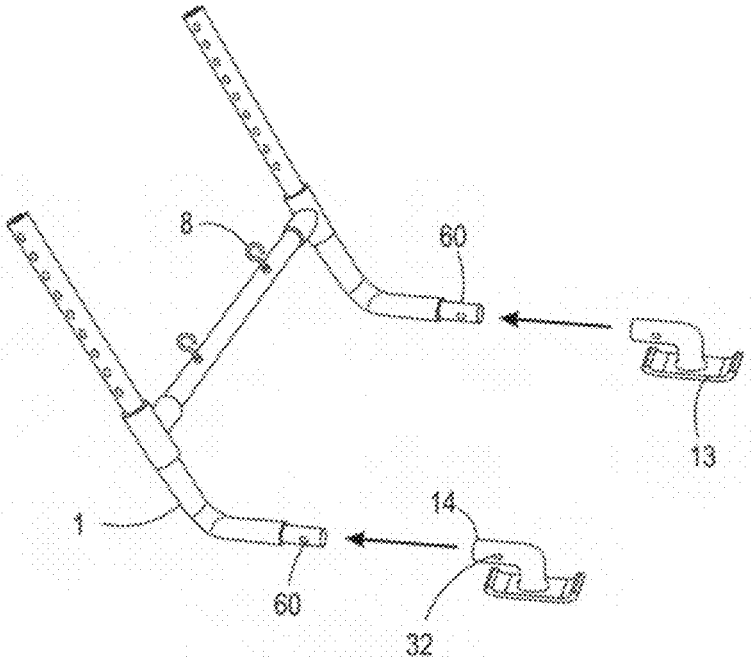
FIG. 11 illustrates a fragmentary side view of the lower frame and non-abrasive feet/ski adapters.

FIG. 11 illustrates the lower frame and fitting arms 60 coupling with non-abrasive feet/skis 13 through attachment points 32 of the non-abrasive feet/skis 13. Pins (not shown) may be used to secure the lower frame and fitting arms 60 with the non-abrasive feet/skis 13.

Figure 12:
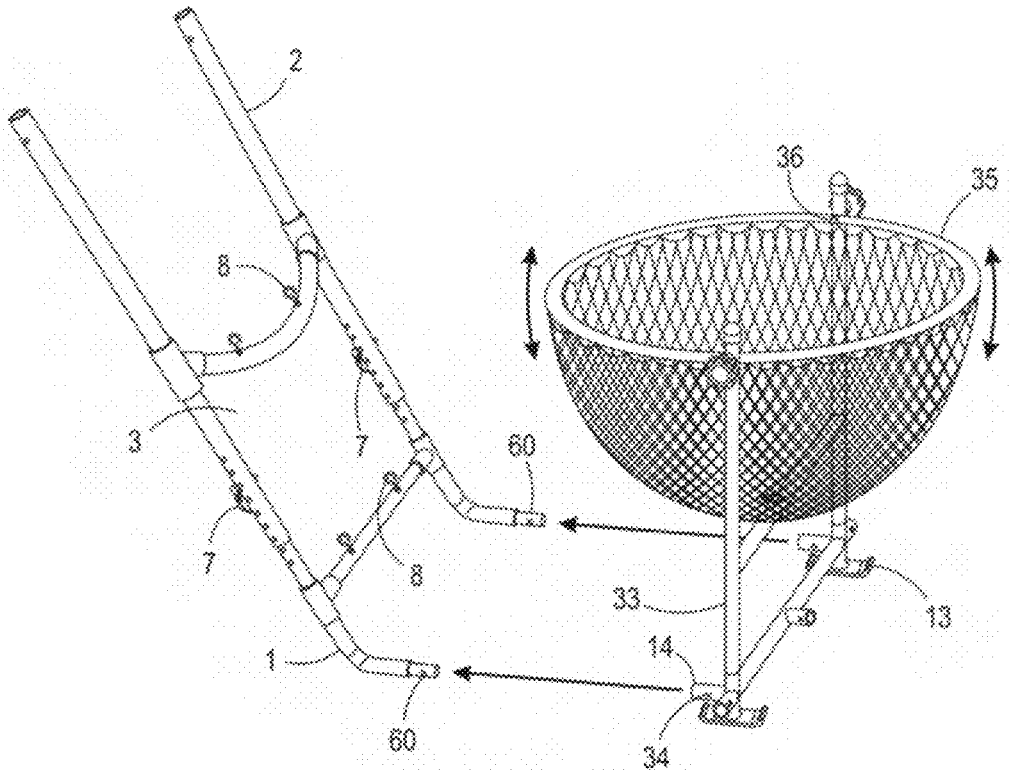
FIG. 12 illustrates a schematic side view of the lower frame, showing a hoop and net for basketball-type games and activities.

FIG. 12 is a schematic side view of the exercise apparatus of FIG. 1 and a hoop/net attachment. The hoop/net attachment can be utilized for basketball-type activities and games. The hoop/net 35 is rotatable coupled to frame 33 by fasteners 36. The frame 33 includes attachment points 34 and non-abrasive feet/skis 13. It is noted that the hoop/net may have wheels, rollers, and/or bearings which are mounted to the sub-frame 12, to facilitate contact with the ground or floor. It is further noted that the non-abrasive feet/skis 13, wheels, rollers, and/or bearings may be statically attached to the hoop/net attachment.

It is also noted that the non-abrasive feet/skis 13, wheels, rollers, and/or bearings may be dynamically attached to the hoop/net attachment so to allow the non-abrasive feet/skis 13, wheels, rollers, and/or bearings to float with the terrain and/or floor. The hoop/net 35 is attached to the lower frame via fitting arms 60. Pins (not shown) may be used to secure the fitting arms 60 with the hoop/net attachment.

Figure 13:
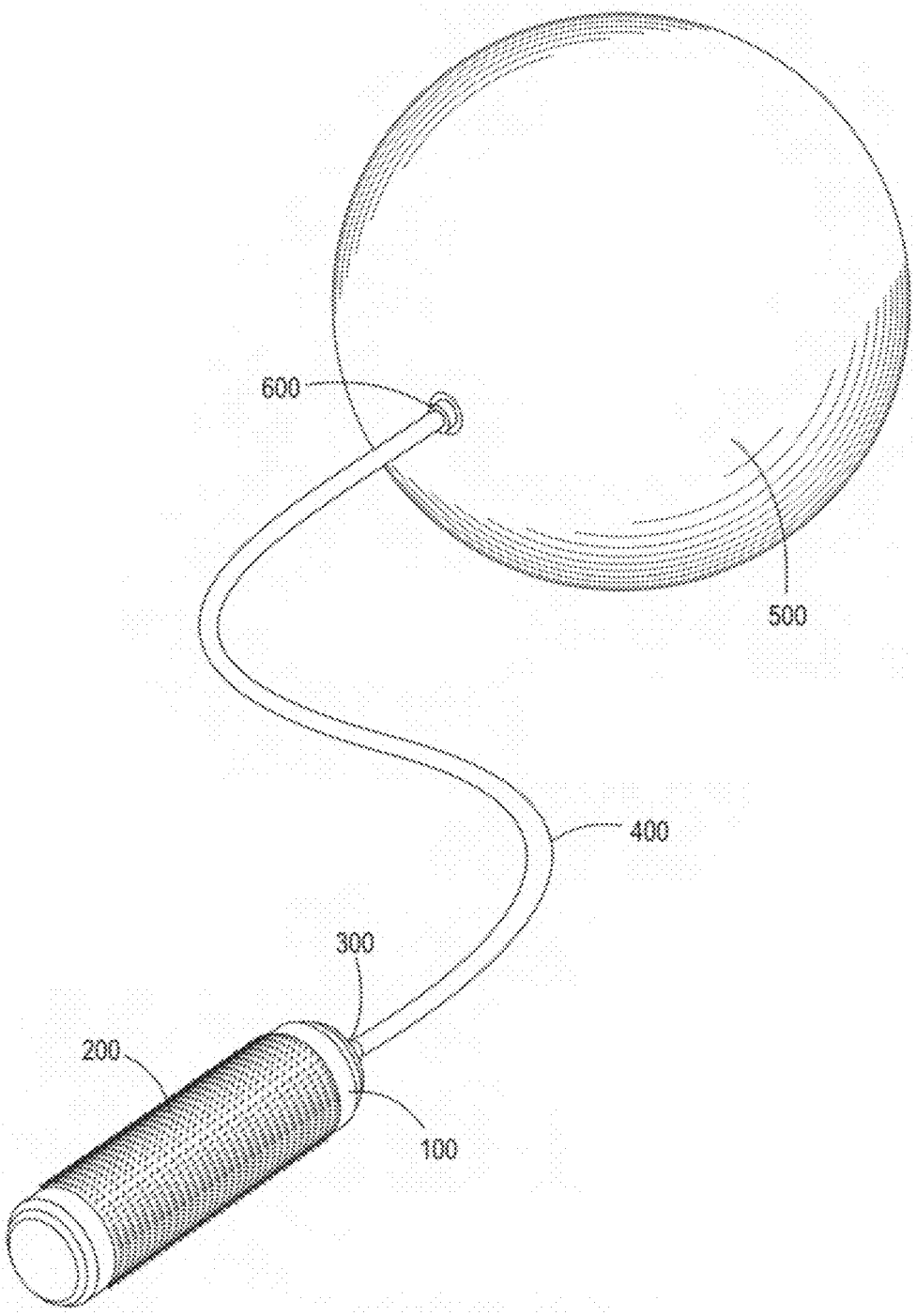
FIG. 13 illustrates a schematic side view of a jump rope simulator/trainer.

FIG. 13 illustrates that a jump rope simulator/trainer includes a handle 100 with an opening 300 for coupling the handle 100 to a flexible tubing 400. The jump rope simulator/trainer includes a soft sphere shaped object 500 with an opening 600 for coupling to an opposite end of the flexible tubing 400. As illustrated in FIG. 13, the handle 100 includes a hook and loop system 200.

Figure 14:
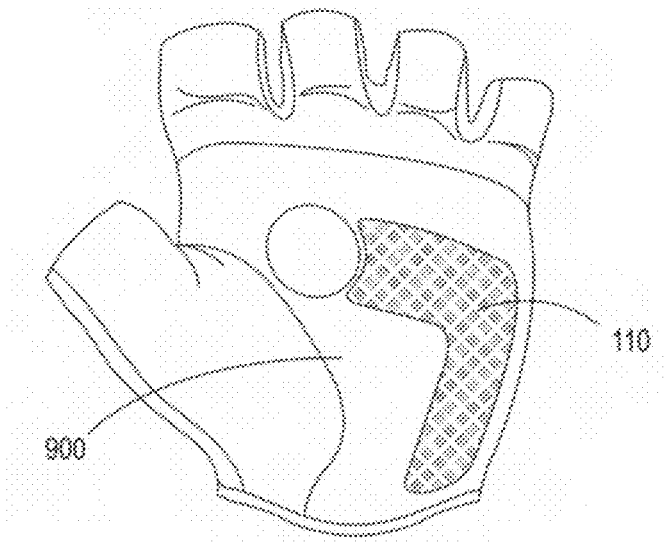
FIG. 14 illustrates a schematic view of a non-palm side of the jump rope simulator/trainer glove for grasping the jump rope simulator/trainer handle.

FIG. 14 illustrates a non-palm side of a soft fingerless glove 900. The soft fingerless glove 900 includes a cut out for the hook and loop adjustment strap 110, which enables the soft fingerless glove 900 to be fitted to various size hands.

Figure 15:
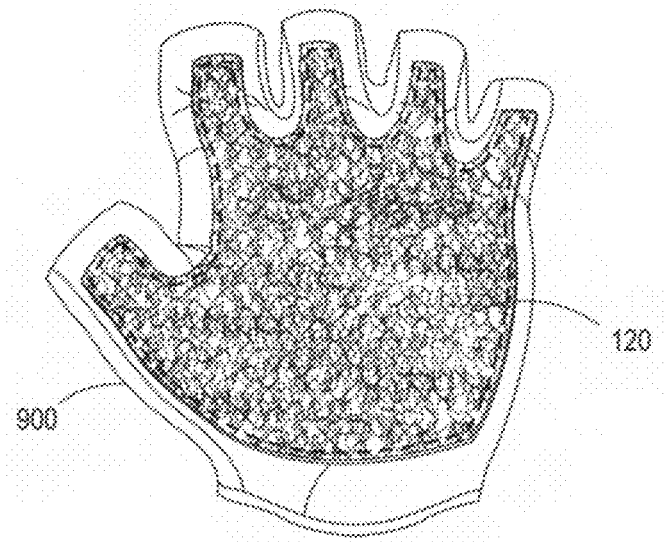
FIG. 15 illustrates a schematic view of a palm side of the jump rope simulator/trainer glove for grasping the jump rope simulator/trainer handle.

FIG. 15 illustrates a palm side of the soft fingerless glove 900. The soft fingerless glove 900 includes a hook and loop pattern 120, which couples with the hook and loop system 200 of handle 100 of FIG. 13. Although the jump rope simulator/trainer of FIGS. 13, 14, and 15 shows a glove grasping apparatus detachable from the handle, it is noted that the glove grasping apparatus could be integrally formed with the handle.

Figure 16:
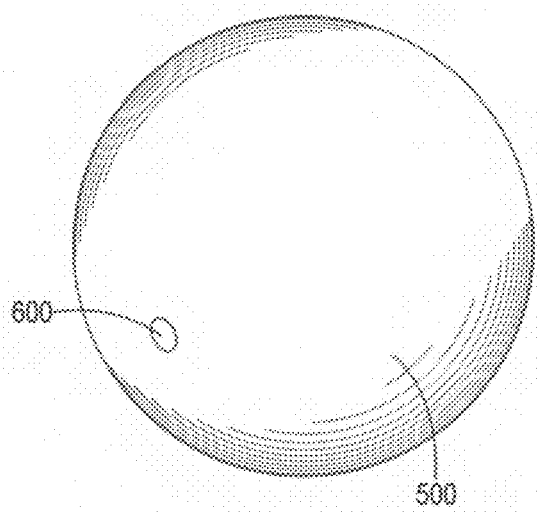
FIG. 16 illustrates a fragmentary view of the handle of a jump rope simulator/trainer, showing a hook and loop system.

FIG. 16 illustrates that a jump rope simulator/trainer includes a handle 100 with an opening 300 for coupling the handle 100 to flexible tubing. The handle 100 includes a hook and loop system 200.

Figure 17:
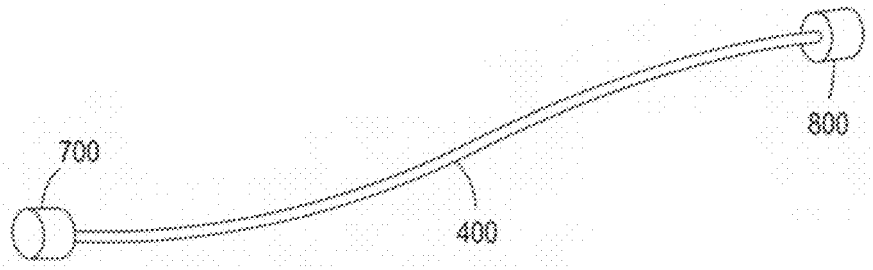
FIG. 17 illustrates a schematic view of a flexible base length of a jump rope simulator/trainer.

FIG. 17 Illustrates a flexible tubing 400, having fasteners 700 and 800. Fasteners 700 may couple with handle 100 of FIG. 16, and fastener 800, may couple with the soft sphere shaped object 500 of FIG. 13.

Figure 18:
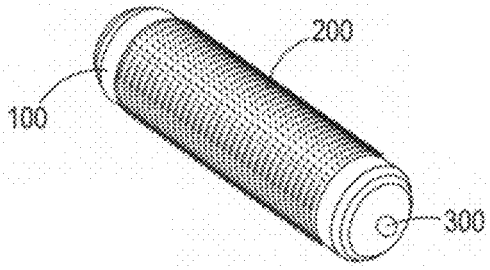
FIG. 18 illustrates a fragmentary side view of a soft sphere shaped object.

FIG. 18 Illustrates a soft sphere shaped object 500 having an opening 600 coupling with fastener 800 of FIG. 17.

Figure 19:
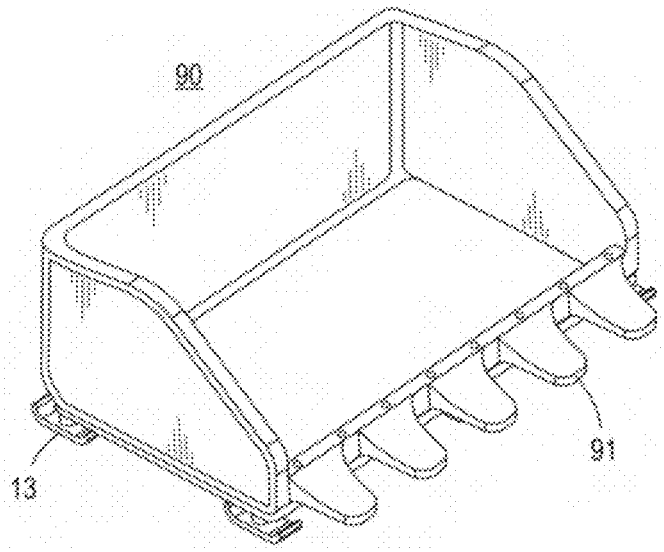
FIG. 19 illustrates a bucket/sled exercise apparatus attachment shaped as a loader bucket.

As illustrated FIG. 19, a bucket/sled exercise apparatus attachment 90 for the exercise apparatus of FIG. 1 may be shaped as a loader bucket (teeth 91), wherein objects or weight resistance can be added to or taken away from depending upon an individual's ability, activity, and/or task. The loader bucket shaped exercise apparatus attachment 90 may have non-abrasive feet/skis 13, which are mounted to the frame, to facilitate contact with the ground or floor.

It is noted that the loader bucket shaped exercise apparatus attachment may have wheels, rollers, and/or bearings which are mounted to the frame, to facilitate contact with the ground or floor. It is further noted that the non-abrasive feet/skis 13, wheels, rollers, and/or bearings may be statically attached to the loader bucket shaped exercise apparatus attachment 90. It is also noted that the non-abrasive feet/skis 13, wheels, rollers, and/or bearings may be dynamically attached to the loader bucket shaped exercise apparatus attachment 90 so to allow the non-abrasive feet/skis 13, wheels, rollers, and/or bearings to float with the terrain and/or floor.

Figure 20:
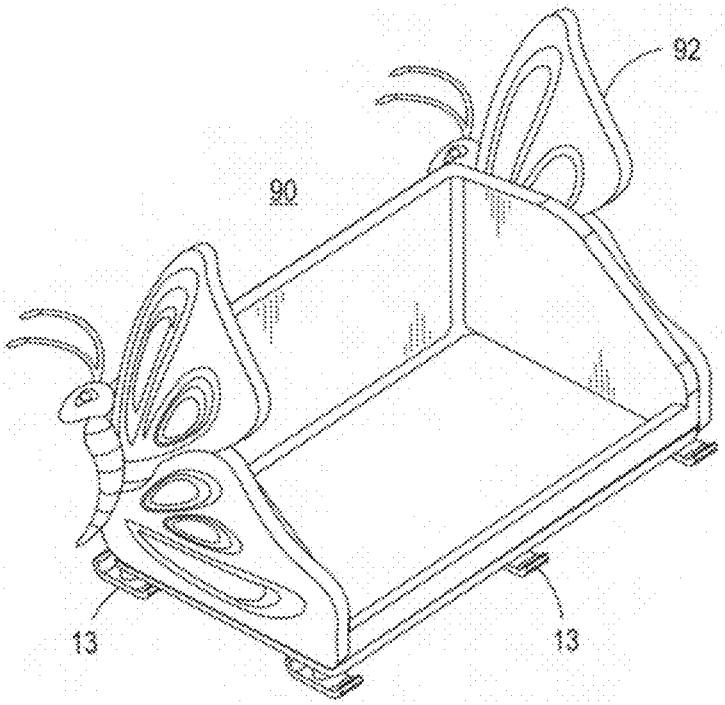
FIGS. 20-24 illustrate various examples of facades that can be attached to the bucket/sled exercise apparatus attachment of FIG. 4.

FIG. 20 illustrates a butterfly shaped façade 92 for the bucket/sled exercise apparatus attachment 90 of FIG. 4. The butterfly shaped façade 92 may be composed of a molded plastic, a fabric, or other material that can sustain a desired shape. The butterfly shaped façade 92 is attached to the outside sidewalls of the frame of the bucket/sled exercise apparatus attachment 90 by the utilization of snaps or a loop/hook system.

It is noted that the butterfly shaped façade 92 can be easily interchangeable with other facades, thus the attachment mechanism facilitates attachment and detachment of the façade. The bucket shaped exercise apparatus attachment 90 may have non-abrasive feet/skis 13, which are mounted to the frame, to facilitate contact with the ground or floor. It is noted that the bucket shaped exercise apparatus attachment may have wheels, rollers, and/or bearings which are mounted to the frame, to facilitate contact with the ground or floor. It is further noted that the non-abrasive feet/skis 13, wheels, rollers, and/or bearings may be statically attached to the bucket shaped exercise apparatus attachment 90. It is also noted that the non-abrasive feet/skis 13, wheels, rollers, and/or bearings may be dynamically attached to the bucket shaped exercise apparatus attachment 90 so to allow the non-abrasive feet/skis 13, wheels, rollers, and/or bearings to float with the terrain and/or floor. Although FIG. 20 illustrates a butterfly shaped façade 92, the façade may be any desired shape.

Figure 21:
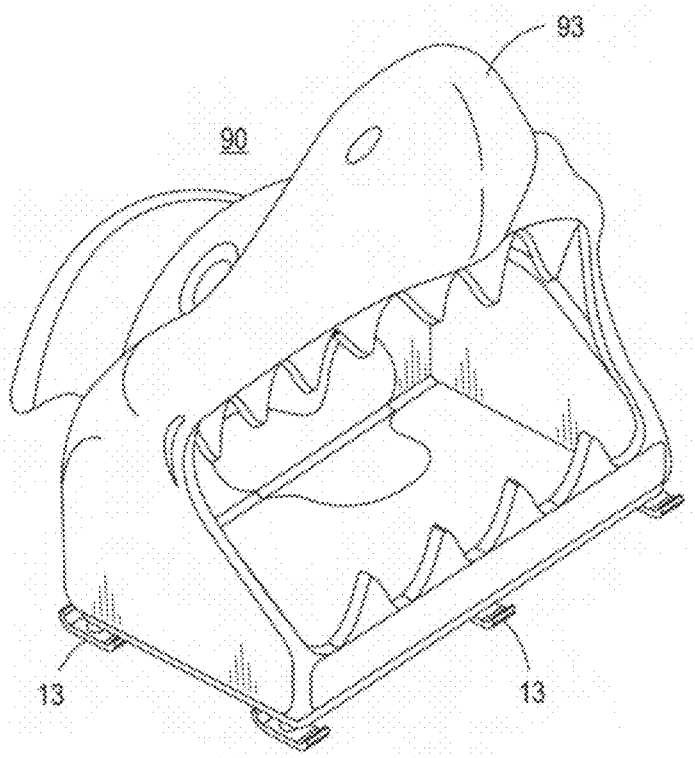

FIG. 21 illustrates a shark head shaped façade 93 for the bucket/sled exercise apparatus attachment 90 of FIG. 4. The shark head shaped façade 93 may be composed of a molded plastic, a fabric, or other material that can sustain a desired shape. It is noted that if the shark head shaped façade 93 is composed of a fabric, the façade may include stiffening materials to keep the top of the façade from falling into the bucket/sled exercise apparatus attachment. The shark head shaped façade 93 may be attached to the outside sidewalls of the frame of the bucket/sled exercise apparatus attachment by the utilization of snaps or a loop/hook system. It is noted that if the shark head shaped façade 93 is composed of fabric, the shark head shaped façade may be secured to the bucket/sled exercise apparatus attachment with elastic material.

It is further noted that if the shark head shaped façade 93 is composed of a plastic material, the shark head shaped façade may have enough expansion to allow the façade to fit snuggly to the bucket/sled exercise apparatus attachment. It is noted that the shark head shaped façade 93 can be easily interchangeable with other facades, thus the attachment mechanism facilitates attachment and detachment of the façade. The bucket shaped exercise apparatus attachment 90 may have non-abrasive feet/skis 13, which are mounted to the frame, to facilitate contact with the ground or floor.

It is noted that the bucket shaped exercise apparatus attachment may have wheels, rollers, and/or bearings which are mounted to the frame, to facilitate contact with the ground or floor. It is further noted that the non-abrasive feet/skis 13, wheels, rollers, and/or bearings may be statically attached to the bucket shaped exercise apparatus attachment 90. It is also noted that the non-abrasive feet/skis 13, wheels, rollers, and/or bearings may be dynamically attached to the bucket shaped exercise apparatus attachment 90 so to allow the non-abrasive feet/skis 13, wheels, rollers, and/or bearings to float with the terrain and/or floor. Although FIG. 21 illustrates a shark head shaped façade 93, the façade may be any desired shape.

Figure 22:
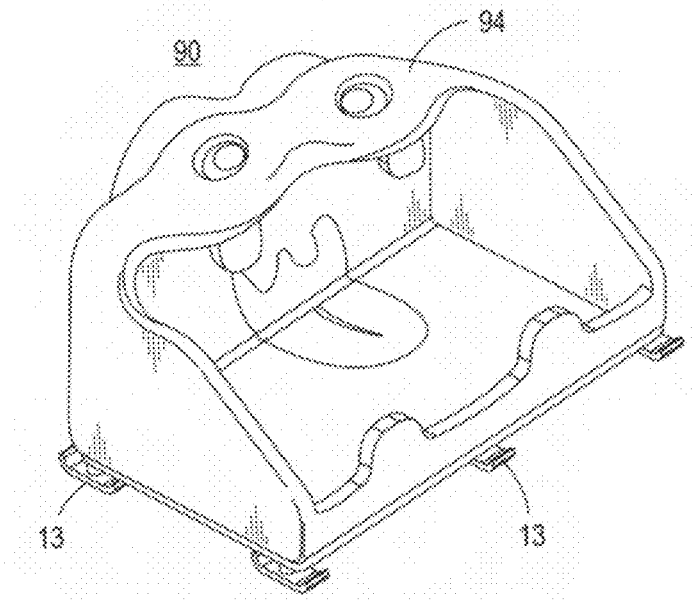

FIG. 22 illustrates a hippo/alligator/crocodile head shaped façade 94 for the bucket/sled exercise apparatus attachment of FIG. 4. The hippo/alligator/crocodile head shaped façade 94 may be composed of a molded plastic, a fabric, or other material that can sustain a desired shape. It is noted that if the hippo/alligator/crocodile head shaped façade 94 is composed of a fabric, the façade may include stiffening materials to keep the top of the façade from falling into the bucket/sled exercise apparatus attachment. The hippo/alligator/crocodile head shaped façade 94 may be attached to the outside sidewalls of the frame of the bucket/sled exercise apparatus attachment by the utilization of snaps or a loop/hook system.

It is noted that if the hippo/alligator/crocodile head shaped façade 94 is composed of fabric, the hippo/alligator/crocodile head shaped façade may be secured to the bucket/sled exercise apparatus attachment with elastic material. It is further noted that if the hippo/alligator/crocodile head shaped façade 94 is composed of a plastic material, the hippo/alligator/crocodile head shaped façade 94 may have enough expansion to allow the façade to fit snuggly to the bucket/sled exercise apparatus attachment. It is noted that the hippo/alligator/crocodile head shaped façade 94 can be easily interchangeable with other facades, thus the attachment mechanism facilitates attachment and detachment of the façade. The bucket shaped exercise apparatus attachment 90 may have non-abrasive feet/skis 13, which are mounted to the frame, to facilitate contact with the ground or floor.

It is noted that the bucket shaped exercise apparatus attachment may have wheels, rollers, and/or bearings which are mounted to the frame, to facilitate contact with the ground or floor. It is further noted that the non-abrasive feet/skis 13, wheels, rollers, and/or bearings may be statically attached to the bucket shaped exercise apparatus attachment 90. It is also noted that the non-abrasive feet/skis 13, wheels, rollers, and/or bearings may be dynamically attached to the bucket shaped exercise apparatus attachment 90 so to allow the non-abrasive feet/skis 13, wheels, rollers, and/or bearings to float with the terrain and/or floor. Although FIG. 22 illustrates a hippo/alligator/crocodile head shaped façade 94, the façade may be any desired shape.

Figure 23:
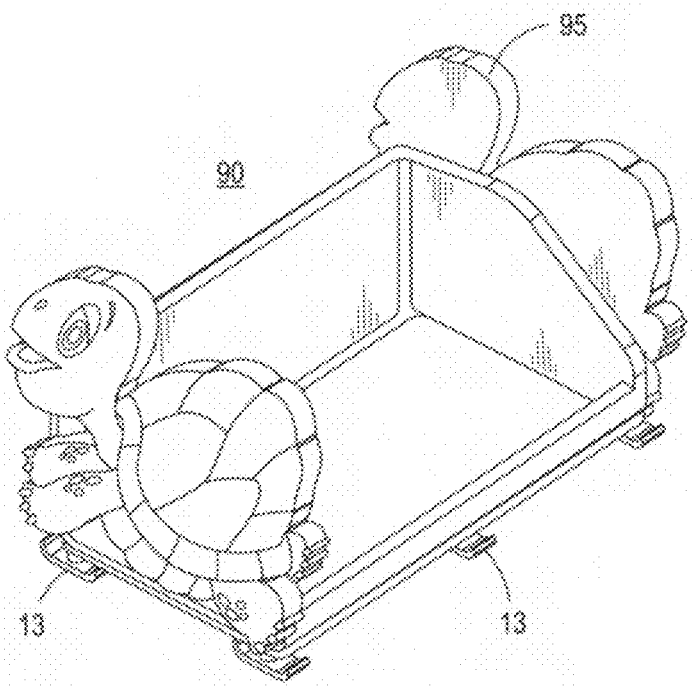

FIG. 23 illustrates a turtle shaped façade 95 for the bucket/sled exercise apparatus attachment of FIG. 4. The turtle shaped façade 95 may be composed of a molded plastic, a fabric, or other material that can sustain a desired shape. The turtle shaped façade 95 is attached to the outside sidewalls of the frame of the bucket/sled exercise apparatus attachment by the utilization of snaps or a loop/hook system. It is noted that the turtle shaped façade 95 can be easily interchangeable with other facades, thus the attachment mechanism facilitates attachment and detachment of the façade. The bucket shaped exercise apparatus attachment 90 may have non-abrasive feet/skis 13, which are mounted to the frame, to facilitate contact with the ground or floor. It is noted that the bucket shaped exercise apparatus attachment may have wheels, rollers, and/or bearings which are mounted to the frame, to facilitate contact with the ground or floor. It is further noted that the non-abrasive feet/skis 13, wheels, rollers, and/or bearings may be statically attached to the bucket shaped exercise apparatus attachment 90. It is also noted that the non-abrasive feet/skis 13, wheels, rollers, and/or bearings may be dynamically attached to the bucket shaped exercise apparatus attachment 90 so to allow the non-abrasive feet/skis 13, wheels, rollers, and/or bearings to float with the terrain and/or floor. Although FIG. 23 illustrates a turtle shaped façade 95, the façade may be any desired shape.

Figure 24:
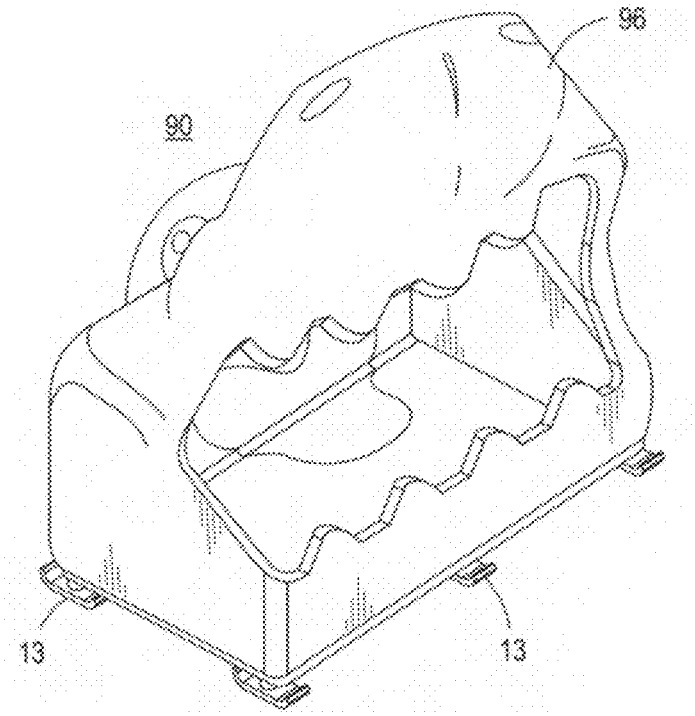

FIG. 24 illustrates a dinosaur head shaped façade 96 for the bucket/sled exercise apparatus attachment of FIG. 4. The dinosaur head shaped façade 96 may be composed of a molded plastic, a fabric, or other material that can sustain a desired shape. It is noted that if the dinosaur head shaped façade 96 is composed of a fabric, the façade may include stiffening materials to keep the top of the façade from falling into the bucket/sled exercise apparatus attachment. The dinosaur head shaped façade 96 may be attached to the outside sidewalls of the frame of the bucket/sled exercise apparatus attachment by the utilization of snaps or a loop/hook system. It is noted that if the dinosaur head shaped façade 96 is composed of fabric, the dinosaur head shaped façade 96 may be secured to the bucket/sled exercise apparatus attachment with elastic material.

It is further noted that if the dinosaur head shaped façade 96 is composed of a plastic material, the dinosaur head shaped façade 96 may have enough expansion to allow the façade to fit snuggly to the bucket/sled exercise apparatus attachment. It is noted that the dinosaur head shaped façade 96 can be easily interchangeable with other facades, thus the attachment mechanism facilitates attachment and detachment of the façade.

The bucket shaped exercise apparatus attachment 90 may have non-abrasive feet/skis 13, which are mounted to the frame, to facilitate contact with the ground or floor. It is noted that the bucket shaped exercise apparatus attachment may have wheels, rollers, and/or bearings which are mounted to the frame, to facilitate contact with the ground or floor. It is further noted that the non-abrasive feet/skis 13, wheels, rollers, and/or bearings may be statically attached to the bucket shaped exercise apparatus attachment 90. It is also noted that the non-abrasive feet/skis 13, wheels, rollers, and/or bearings may be dynamically attached to the bucket shaped exercise apparatus attachment 90 so to allow the non-abrasive feet/skis 13, wheels, rollers, and/or bearings to float with the terrain and/or floor. Although FIG. 24 illustrates a dinosaur head shaped façade 96, the façade may be any desired shape.

Figure 25:
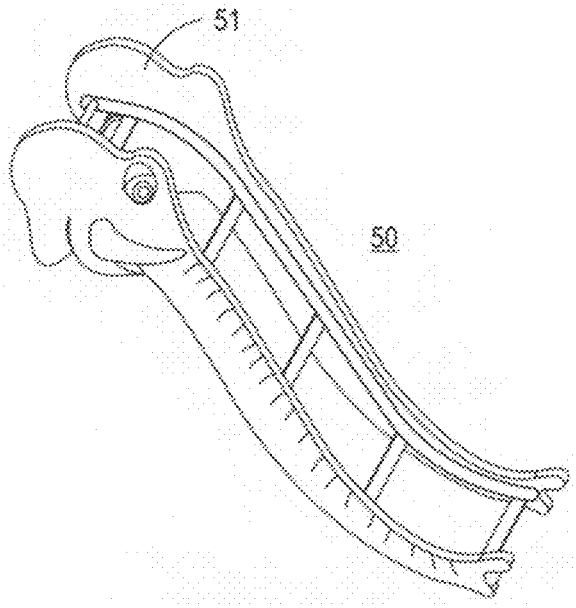
FIGS. 25-29 illustrate various examples of facades that can be attached to the manipulative ramp apparatus attachment of FIG. 8.

FIG. 25 illustrates an elephant head/trunk shaped façade 51 for the manipulative ramp apparatus attachment 50 of FIG. 8. The elephant head/trunk shaped façade 51 may be composed of a molded plastic, a fabric, or other material that can sustain a desired shape. It is noted that the manipulative ramp apparatus attachment 50 of FIG. 8 may include additional external rails or other external means for attaching the façade thereto. The elephant head/trunk shaped façade 51 may be attached to the additional external rails or other external means of the manipulative ramp apparatus attachment 50 by the utilization of snaps or a loop/hook system. It is noted that if the elephant head/trunk shaped façade 51 is composed of a plastic material, the elephant head/trunk shaped façade 51 may have enough expansion to allow the façade to snap onto the external rails or other external means of the manipulative ramp apparatus attachment 50.

It is noted that the elephant head/trunk shaped façade 51 can be easily interchangeable with other facades, thus the attachment mechanism facilitates attachment and detachment of the façade. It is further noted that non-abrasive feet/skis, wheels, rollers, and/or bearings may be statically attached to the manipulative ramp apparatus attachment 50. It is also noted that the non-abrasive feet/skis, wheels, rollers, and/or bearings may be dynamically attached to the manipulative ramp apparatus attachment 50 so to allow the non-abrasive feet/skis, wheels, rollers, and/or bearings to float with the terrain and/or floor.

Although FIG. 25 illustrates an elephant head/trunk shaped façade 51, the façade may be any desired shape.

Figure 26:
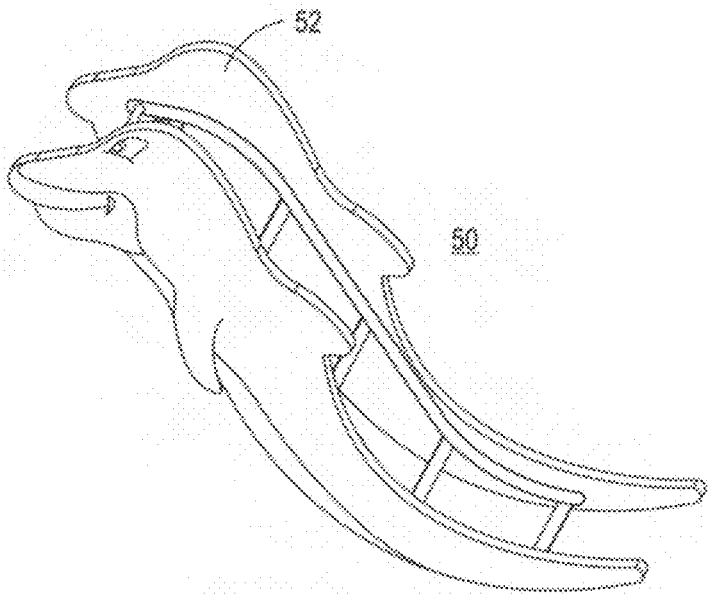

FIG. 26 illustrates a dolphin shaped façade 52 for the manipulative ramp apparatus attachment 50 of FIG. 8. The dolphin shaped façade 52 may be composed of a molded plastic, a fabric, or other material that can sustain a desired shape. It is noted that the manipulative ramp apparatus attachment 50 of FIG. 8 may include additional external rails or other external means for attaching the façade thereto. The dolphin shaped façade 52 may be attached to the additional external rails or other external means of the manipulative ramp apparatus attachment 50 by the utilization of snaps or a loop/hook system. It is noted that if the dolphin shaped façade 52 is composed of a plastic material, the dolphin shaped façade 52 may have enough expansion to allow the façade to snap onto the external rails or other external means of the manipulative ramp apparatus attachment 50. It is noted that the dolphin shaped façade 52 can be easily interchangeable with other facades, thus the attachment mechanism facilitates attachment and detachment of the façade. It is further noted that non-abrasive feet/skis, wheels, rollers, and/or bearings may be statically attached to the manipulative ramp apparatus attachment 50. It is also noted that the non-abrasive feet/skis, wheels, rollers, and/or bearings may be dynamically attached to the manipulative ramp apparatus attachment 50 so to allow the non-abrasive feet/skis, wheels, rollers, and/or bearings to float with the terrain and/or floor. Although FIG. 26 illustrates a dolphin shaped façade 52, the façade may be any desired shape.

Figure 27:
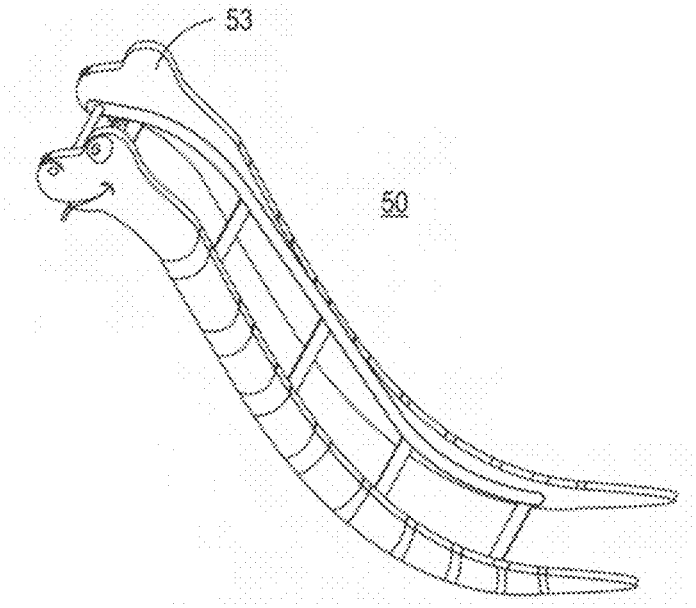

FIG. 27 illustrates a snake shaped façade 53 for the manipulative ramp apparatus attachment 50 of FIG. 8. The snake shaped façade 53 may be composed of a molded plastic, a fabric, or other material that can sustain a desired shape. It is noted that the manipulative ramp apparatus attachment 50 of FIG. 8 may include additional external rails or other external means for attaching the façade thereto. The snake shaped façade 53 may be attached to the additional external rails or other external means of the manipulative ramp apparatus attachment 50 by the utilization of snaps or a loop/hook system. It is noted that if the snake shaped façade 53 is composed of a plastic material, the snake shaped façade 53 may have enough expansion to allow the façade to snap onto the external rails or other external means of the manipulative ramp apparatus attachment 50.

It is noted that the snake shaped façade 53 can be easily interchangeable with other facades, thus the attachment mechanism facilitates attachment and detachment of the façade. It is further noted that non-abrasive feet/skis, wheels, rollers, and/or bearings may be statically attached to the manipulative ramp apparatus attachment 50.

It is also noted that the non-abrasive feet/skis, wheels, rollers, and/or bearings may be dynamically attached to the manipulative ramp apparatus attachment 50 so to allow the non-abrasive feet/skis, wheels, rollers, and/or bearings to float with the terrain and/or floor. Although FIG. 27 illustrates a snake shaped façade 53, the façade may be any desired shape.

Figure 28:
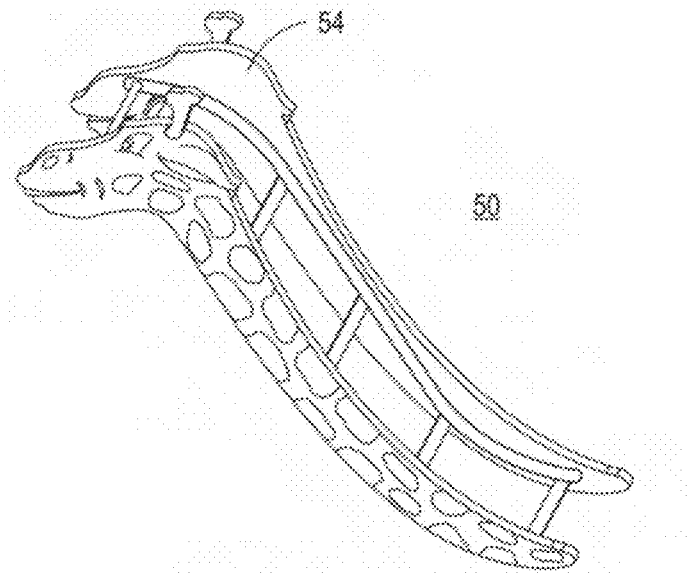

FIG. 28 illustrates a giraffe shaped façade 54 for the manipulative ramp apparatus attachment 50 of FIG. 8. The giraffe shaped façade 54 may be composed of a molded plastic, a fabric, or other material that can sustain a desired shape. It is noted that the manipulative ramp apparatus attachment 50 of FIG. 8 may include additional external rails or other external means for attaching the façade thereto. The giraffe shaped façade 54 may be attached to the additional external rails or other external means of the manipulative ramp apparatus attachment 50 by the utilization of snaps or a loop/hook system. It is noted that if the giraffe shaped façade 54 is composed of a plastic material, the giraffe shaped façade 54 may have enough expansion to allow the façade to snap onto the external rails or other external means of the manipulative ramp apparatus attachment 50. It is noted that the giraffe shaped façade 54 can be easily interchangeable with other facades, thus the attachment mechanism facilitates attachment and detachment of the façade. It is further noted that non-abrasive feet/skis, wheels, rollers, and/or bearings may be statically attached to the manipulative ramp apparatus attachment 50. It is also noted that the non-abrasive feet/skis, wheels, rollers, and/or bearings may be dynamically attached to the manipulative ramp apparatus attachment 50 so to allow the non-abrasive feet/skis, wheels, rollers, and/or bearings to float with the terrain and/or floor. Although FIG. 28 illustrates a giraffe shaped façade 54, the façade may be any desired shape.

Figure 29:
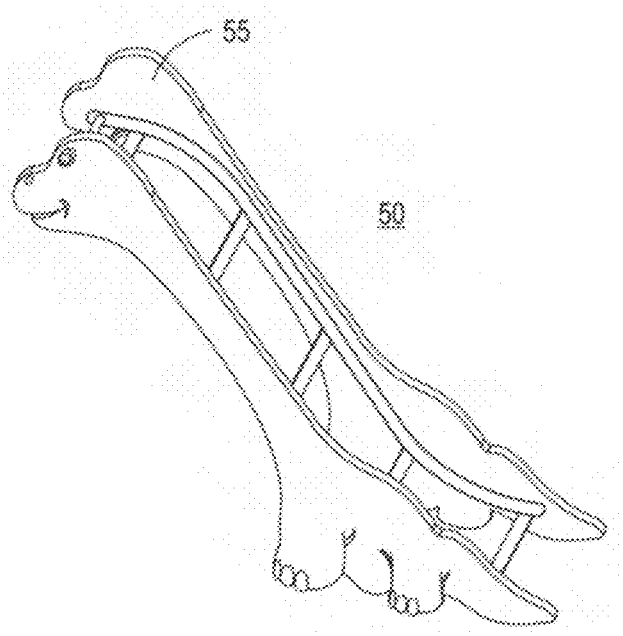

FIG. 29 illustrates a dinosaur shaped façade 55 for the manipulative ramp apparatus attachment 50 of FIG. 8. The dinosaur shaped façade 55 may be composed of a molded plastic, a fabric, or other material that can sustain a desired shape. It is noted that the manipulative ramp apparatus attachment 50 of FIG. 8 may include additional external rails or other external means for attaching the façade thereto. The dinosaur shaped façade 55 may be attached to the additional external rails or other external means of the manipulative ramp apparatus attachment 50 by the utilization of snaps or a loop/hook system. It is noted that if the dinosaur shaped façade 55 is composed of a plastic material, the dinosaur shaped façade 55 may have enough expansion to allow the façade to snap onto the external rails or other external means of the manipulative ramp apparatus attachment 50. It is noted that the dinosaur shaped façade 55 can be easily interchangeable with other facades, thus the attachment mechanism facilitates attachment and detachment of the façade. Although FIG. 29 illustrates a dinosaur shaped façade 55, the façade may be any desired shape.

Figure 30:
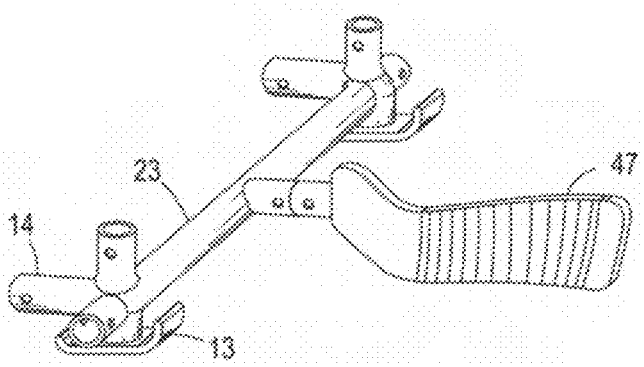
FIG. 30 illustrates a manipulative striking apparatus attachment shaped as a blade of a hockey stick.

FIG. 30 illustrates a manipulative striking apparatus attachment shaped as a blade 47 of a hockey stick in lieu of the manipulative striking apparatus attachment of FIG. 7. The manipulative striking apparatus attachment can be utilized to strike, push, and/or manipulate various objects on or near the floor with blade 47. The manipulative striking apparatus attachment includes a frame 23, attached non-abrasive feet/skis 13, fitting arm receiving recesses 14 for engaging the fitting arms 60 of the lower frame 80 of FIG. 2. It is noted that the manipulative striking apparatus attachment may have wheels, rollers, and/or bearings which are mounted to the manipulative striking apparatus attachment, to facilitate contact with the ground or floor. It is further noted that the non-abrasive feet/skis 13, wheels, rollers, and/or bearings may be statically attached to the manipulative striking apparatus attachment. It is also noted that the non-abrasive feet/skis 13, wheels, rollers, and/or bearings may be dynamically attached to the manipulative striking apparatus attachment so to allow the non-abrasive feet/skis 13, wheels, rollers, and/or bearings to float with the terrain and/or floor. Although FIG. 30 illustrates the fitting arms as being projections from the lower frame that are received by the manipulative striking apparatus attachment, the manipulative striking apparatus attachment may have projecting fitting arms and the lower frame have fitting arm receiving recesses for engaging the fitting arms. The manipulative striking apparatus attachment shaped as a blade 47 of a hockey stick may be composed of a molded plastic, a fabric, or other material that can sustain a desired shape. It is noted that the manipulative striking apparatus attachment shaped as a blade 47 of a hockey stick may be attached to the lower frame of the exercise apparatus in the same manner as the manipulative striking apparatus attachment of FIG. 7. It is further noted that the manipulative striking apparatus attachment shaped as a blade 47 of a hockey stick be a façade that attaches to the manipulative striking apparatus attachment of FIG. 7 by the utilization of snaps or a loop/hook system.

It is noted that if the blade 47 of a hockey stick shaped façade is composed of fabric, the blade 47 of a hockey stick shaped façade may be secured to the manipulative striking apparatus attachment with elastic material.

It is further noted that if the blade 47 of a hockey stick shaped façade is composed of a plastic material, the blade 47 of a hockey stick shaped façade may have enough expansion to allow the façade to fit snuggly to the manipulative striking apparatus attachment.

Although FIG. 30 illustrates a blade 47 of a hockey stick shaped façade, the façade may be any desired shape.

Figure 31:
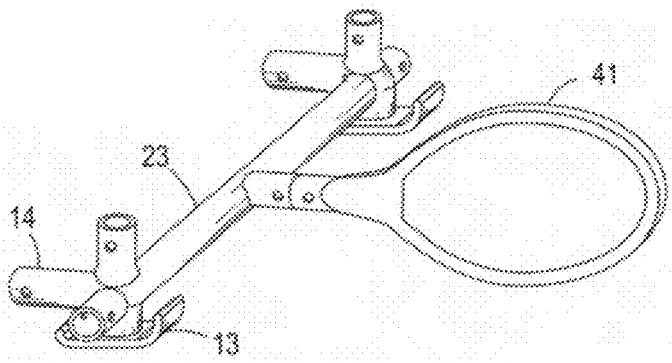
FIG. 31 illustrates a manipulative striking apparatus attachment shaped as a blade of a golf club.

FIG. 31 illustrates a manipulative striking apparatus attachment shaped as a paddle 41 in lieu of the manipulative striking apparatus attachment of FIG. 7. The manipulative striking apparatus attachment can be utilized to strike, push, and/or manipulate various objects on or near the floor with paddle 41.

The manipulative striking apparatus attachment includes a frame 23, attached non-abrasive feet/skis 13, fitting arm receiving recesses 14 for engaging the fitting arms 60 of the lower frame 80 of FIG. 2.

It is noted that the manipulative striking apparatus attachment may have wheels, rollers, and/or bearings which are mounted to the manipulative striking apparatus attachment, to facilitate contact with the ground or floor.

It is further noted that the non-abrasive feet/skis 13, wheels, rollers, and/or bearings may be statically attached to the manipulative striking apparatus attachment.

It is also noted that the non-abrasive feet/skis 13, wheels, rollers, and/or bearings may be dynamically attached to the manipulative striking apparatus attachment so to allow the non-abrasive feet/skis 13, wheels, rollers, and/or bearings to float with the terrain and/or floor.

Although FIG. 31 illustrates the fitting arms as being projections from the lower frame that are received by the manipulative striking apparatus attachment, the manipulative striking apparatus attachment may have projecting fitting arms and the lower frame have fitting arm receiving recesses for engaging the fitting arms.

The manipulative striking apparatus attachment shaped as a paddle 41 may be composed of a molded plastic, a fabric, or other material that can sustain a desired shape.

It is noted that the manipulative striking apparatus attachment shaped as a paddle 41 may be attached to the lower frame of the exercise apparatus in the same manner as the manipulative striking apparatus attachment of FIG. 7.

It is further noted that the manipulative striking apparatus attachment shaped as a paddle 41 be a façade that attaches to the manipulative striking apparatus attachment of FIG. 7 by the utilization of snaps or a loop/hook system.

It is noted that if the paddle shaped façade 41 is composed of fabric, the paddle shaped façade 41 may be secured to the manipulative striking apparatus attachment with elastic material.

It is further noted that if the paddle shaped façade 41 is composed of a plastic material, the paddle shaped façade 41 may have enough expansion to allow the façade to fit snuggly to the manipulative striking apparatus attachment.

Although FIG. 31 illustrates a paddle shaped façade 41, the façade may be any desired shape.

Figure 32:
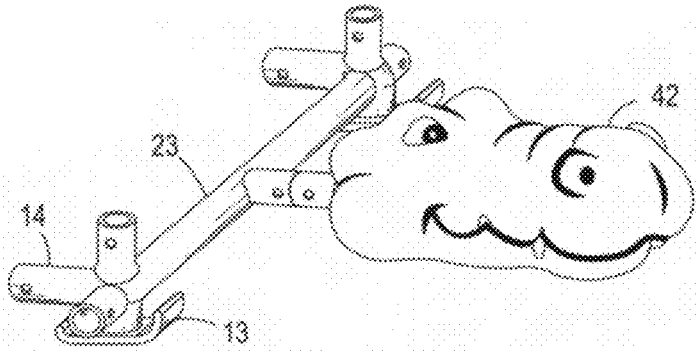
FIG. 32 illustrates a manipulative striking apparatus attachment shaped as a paddle.

FIG. 32 illustrates a manipulative striking apparatus attachment shaped as an alligator head 42 in lieu of the manipulative striking apparatus attachment of FIG. 7. The manipulative striking apparatus attachment can be utilized to strike, push, and/or manipulate various objects on or near the floor with alligator head 42.

The manipulative striking apparatus attachment includes a frame 23, attached non-abrasive feet/skis 13, fitting arm receiving recesses 14 for engaging the fitting arms 60 of the lower frame 80 of FIG. 2.

It is noted that the manipulative striking apparatus attachment may have wheels, rollers, and/or bearings which are mounted to the manipulative striking apparatus attachment, to facilitate contact with the ground or floor.

It is further noted that the non-abrasive feet/skis 13, wheels, rollers, and/or bearings may be statically attached to the manipulative striking apparatus attachment.

It is also noted that the non-abrasive feet/skis 13, wheels, rollers, and/or bearings may be dynamically attached to the manipulative striking apparatus attachment so to allow the non-abrasive feet/skis 13, wheels, rollers, and/or bearings to float with the terrain and/or floor.

Although FIG. 32 illustrates the fitting arms as being projections from the lower frame that are received by the manipulative striking apparatus attachment, the manipulative striking apparatus attachment may have projecting fitting arms and the lower frame have fitting arm receiving recesses for engaging the fitting arms.

The manipulative striking apparatus attachment shaped as an alligator head 42 may be composed of a molded plastic, a fabric, or other material that can sustain a desired shape.

It is noted that the manipulative striking apparatus attachment shaped as an alligator head 42 may be attached to the lower frame of the exercise apparatus in the same manner as the manipulative striking apparatus attachment of FIG. 7.

It is further noted that the manipulative striking apparatus attachment shaped as an alligator head 42 be a façade that attaches to the manipulative striking apparatus attachment of FIG. 7 by the utilization of snaps or a loop/hook system.

It is noted that if the alligator head shaped façade 42 is composed of fabric, the alligator head shaped façade 42 may be secured to the manipulative striking apparatus attachment with elastic material.

It is further noted that if the alligator head shaped façade 42 is composed of a plastic material, the alligator head shaped façade 42 may have enough expansion to allow the façade to fit snuggly to the manipulative striking apparatus attachment.

Although FIG. 32 illustrates an alligator head shaped façade 42, the façade may be any desired shape.

Figure 33:
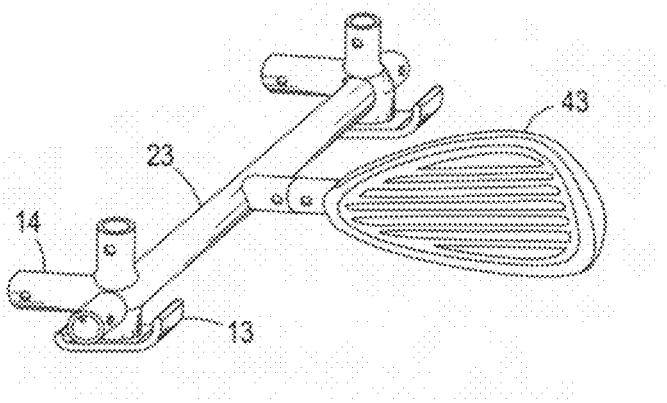
FIG. 33 illustrates a manipulative striking apparatus attachment shaped as a hand.

FIG. 33 illustrates a manipulative striking apparatus attachment shaped as a blade 43 of a golf club in lieu of the manipulative striking apparatus attachment of FIG. 7. The manipulative striking apparatus attachment can be utilized to strike, push, and/or manipulate various objects on or near the floor with blade 43.

The manipulative striking apparatus attachment includes a frame 23, attached non-abrasive feet/skis 13, fitting arm receiving recesses 14 for engaging the fitting arms 60 of the lower frame 80 of FIG. 2.

It is noted that the manipulative striking apparatus attachment may have wheels, rollers, and/or bearings which are mounted to the manipulative striking apparatus attachment, to facilitate contact with the ground or floor.

It is further noted that the non-abrasive feet/skis 13, wheels, rollers, and/or bearings may be statically attached to the manipulative striking apparatus attachment.

It is also noted that the non-abrasive feet/skis 13, wheels, rollers, and/or bearings may be dynamically attached to the manipulative striking apparatus attachment so to allow the non-abrasive feet/skis 13, wheels, rollers, and/or bearings to float with the terrain and/or floor.

Although FIG. 33 illustrates the fitting arms as being projections from the lower frame that are received by the manipulative striking apparatus attachment, the manipulative striking apparatus attachment may have projecting fitting arms and the lower frame have fitting arm receiving recesses for engaging the fitting arms.

The manipulative striking apparatus attachment shaped as a blade 43 of a golf club may be composed of a molded plastic, a fabric, or other material that can sustain a desired shape.

It is noted that the manipulative striking apparatus attachment shaped as a blade 43 of a golf club may be attached to the lower frame of the exercise apparatus in the same manner as the manipulative striking apparatus attachment of FIG. 7.

It is further noted that the manipulative striking apparatus attachment shaped as a blade 43 of a golf club be a façade that attaches to the manipulative striking apparatus attachment of FIG. 7 by the utilization of snaps or a loop/hook system.

It is noted that if the blade 43 of a golf club shaped façade is composed of fabric, the blade 43 of a golf club shaped façade may be secured to the manipulative striking apparatus attachment with elastic material.

It is further noted that if the blade 43 of a golf club shaped façade is composed of a plastic material, the blade 43 of a golf club shaped façade may have enough expansion to allow the façade to fit snuggly to the manipulative striking apparatus attachment.

Although FIG. 33 illustrates a blade 43 of a golf club shaped façade, the façade may be any desired shape.

Figure 34:
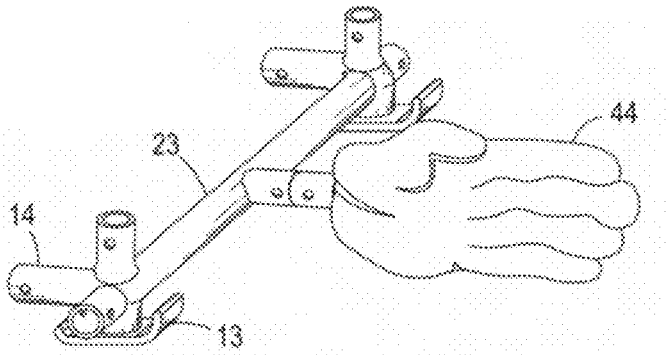
FIG. 34 illustrates a manipulative striking apparatus attachment shaped as a head of an animal.

FIG. 34 illustrates a manipulative striking apparatus attachment shaped as a hand 44 in lieu of the manipulative striking apparatus attachment of FIG. 7. The manipulative striking apparatus attachment can be utilized to strike, push, and/or manipulate various objects on or near the floor with hand 44.

The manipulative striking apparatus attachment includes a frame 23, attached non-abrasive feet/skis 13, fitting arm receiving recesses 14 for engaging the fitting arms 60 of the lower frame 80 of FIG. 2.

It is noted that the manipulative striking apparatus attachment may have wheels, rollers, and/or bearings which are mounted to the manipulative striking apparatus attachment, to facilitate contact with the ground or floor.

It is further noted that the non-abrasive feet/skis 13, wheels, rollers, and/or bearings may be statically attached to the manipulative striking apparatus attachment.

It is also noted that the non-abrasive feet/skis 13, wheels, rollers, and/or bearings may be dynamically attached to the manipulative striking apparatus attachment so to allow the non-abrasive feet/skis 13, wheels, rollers, and/or bearings to float with the terrain and/or floor.

Although FIG. 34 illustrates the fitting arms as being projections from the lower frame that are received by the manipulative striking apparatus attachment, the manipulative striking apparatus attachment may have projecting fitting arms and the lower frame have fitting arm receiving recesses for engaging the fitting arms.

The manipulative striking apparatus attachment shaped as a hand 44 may be composed of a molded plastic, a fabric, or other material that can sustain a desired shape.

It is noted that the manipulative striking apparatus attachment shaped as a hand 44 may be attached to the lower frame of the exercise apparatus in the same manner as the manipulative striking apparatus attachment of FIG. 7.

It is further noted that the manipulative striking apparatus attachment shaped as a hand 44 be a façade that attaches to the manipulative striking apparatus attachment of FIG. 7 by the utilization of snaps or a loop/hook system.

It is noted that if the hand shaped façade 44 is composed of fabric, the hand shaped façade 44 may be secured to the manipulative striking apparatus attachment with elastic material.

It is further noted that if the hand shaped façade 44 is composed of a plastic material, the hand shaped façade 44 may have enough expansion to allow the façade to fit snuggly to the manipulative striking apparatus attachment.

Although FIG. 34 illustrates a hand shaped façade 44, the façade may be any desired shape.

Figure 35:
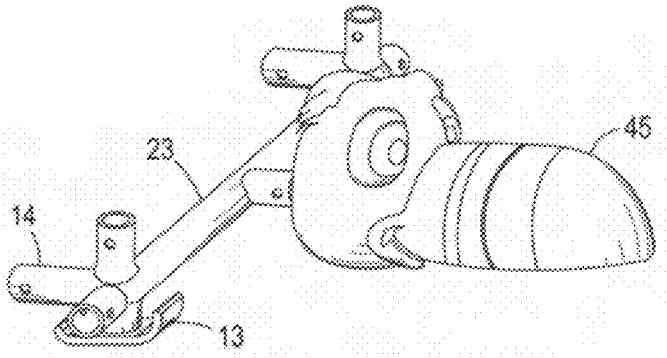
FIG. 35 illustrates a manipulative striking apparatus attachment shaped as a head of a bird.

FIG. 35 illustrates a manipulative striking apparatus attachment shaped as a bird head 45 in lieu of the manipulative striking apparatus attachment of FIG. 7. The manipulative striking apparatus attachment can be utilized to strike, push, and/or manipulate various objects on or near the floor with bird head 45.

The manipulative striking apparatus attachment includes a frame 23, attached non-abrasive feet/skis 13, fitting arm receiving recesses 14 for engaging the fitting arms 60 of the lower frame 80 of FIG. 2.

It is noted that the manipulative striking apparatus attachment may have wheels, rollers, and/or bearings which are mounted to the manipulative striking apparatus attachment, to facilitate contact with the ground or floor.

It is further noted that the non-abrasive feet/skis 13, wheels, rollers, and/or bearings may be statically attached to the manipulative striking apparatus attachment.

It is also noted that the non-abrasive feet/skis 13, wheels, rollers, and/or bearings may be dynamically attached to the manipulative striking apparatus attachment so to allow the non-abrasive feet/skis 13, wheels, rollers, and/or bearings to float with the terrain and/or floor.

Although FIG. 35 illustrates the fitting arms as being projections from the lower frame that are received by the manipulative striking apparatus attachment, the manipulative striking apparatus attachment may have projecting fitting arms and the lower frame have fitting arm receiving recesses for engaging the fitting arms.

The manipulative striking apparatus attachment shaped as a bird head 45 may be composed of a molded plastic, a fabric, or other material that can sustain a desired shape.

It is noted that the manipulative striking apparatus attachment shaped as a bird head 45 may be attached to the lower frame of the exercise apparatus in the same manner as the manipulative striking apparatus attachment of FIG. 7.

It is further noted that the manipulative striking apparatus attachment shaped as a bird head 45 be a façade that attaches to the manipulative striking apparatus attachment of FIG. 7 by the utilization of snaps or a loop/hook system.

It is noted that if the bird head shaped façade 45 is composed of fabric, the bird head shaped façade 45 may be secured to the manipulative striking apparatus attachment with elastic material.

It is further noted that if the bird head shaped façade 45 is composed of a plastic material, the bird head shaped façade 45 may have enough expansion to allow the façade to fit snuggly to the manipulative striking apparatus attachment.

Although FIG. 35 illustrates a bird head shaped façade 45, the façade may be any desired shape.

Figure 36:
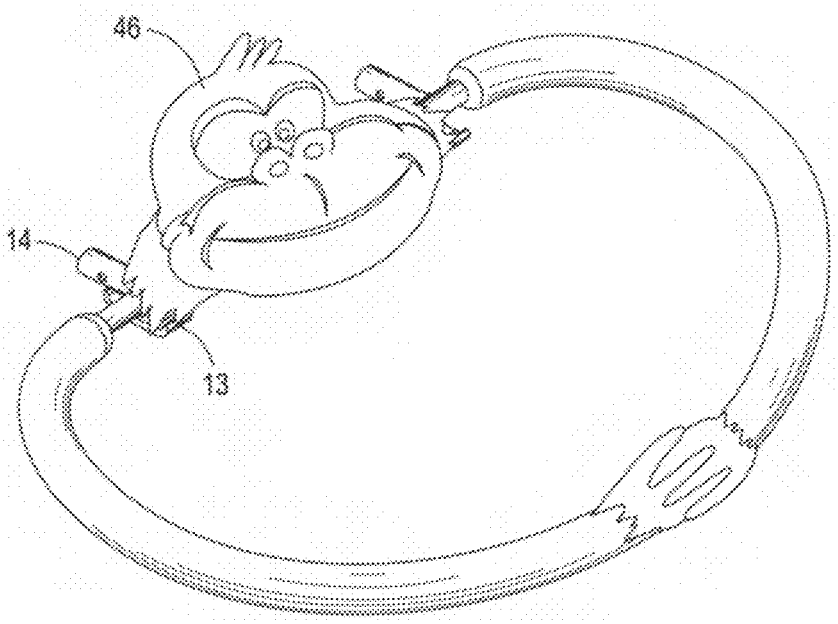
FIGS. 36-39 illustrate various examples of facades that can be attached to the manipulative object controlling apparatus attachment of FIG. 9.

FIG. 36 illustrates a monkey shaped façade 46 for the manipulative object controlling apparatus attachment of FIG. 9.

The manipulative object controlling apparatus attachment includes a frame 23, attached non-abrasive feet/skis 13, fitting arm receiving recesses 14 for engaging the fitting arms 60 of the lower frame 80 of FIG. 2.

It is noted that the manipulative object controlling apparatus attachment may have wheels, rollers, and/or bearings which are mounted to the manipulative object controlling apparatus attachment, to facilitate contact with the ground or floor.

It is further noted that the non-abrasive feet/skis 13, wheels, rollers, and/or bearings may be statically attached to the manipulative object controlling apparatus attachment.

It is also noted that the non-abrasive feet/skis 13, wheels, rollers, and/or bearings may be dynamically attached to the manipulative object controlling apparatus attachment so to allow the non-abrasive feet/skis 13, wheels, rollers, and/or bearings to float with the terrain and/or floor.

Although FIG. 36 illustrates the fitting arms as being projections from the lower frame that are received by the manipulative object controlling apparatus attachment, the manipulative object controlling apparatus attachment may have projecting fitting arms and the lower frame have fitting arm receiving recesses for engaging the fitting arms.

The monkey shaped façade 46 may be composed of a molded plastic, a fabric, or other material that can sustain a desired shape.

The monkey shaped façade 46 may be attached to the ring of the manipulative object controlling apparatus attachment by the utilization of snaps or a loop/hook system.

It is noted that if the monkey head shaped façade 46 is composed of fabric, the monkey shaped façade 46 may be secured to the ring of manipulative object controlling apparatus attachment with elastic material.

It is further noted that if the monkey shaped façade 46 is composed of a plastic material, the monkey shaped façade 46 may have enough expansion to allow the façade to fit snuggly to the ring of the manipulative object controlling apparatus attachment.

It is noted that the monkey shaped façade 46 can be easily interchangeable with other facades, thus the attachment mechanism facilitates attachment and detachment of the façade.

Although FIG. 36 illustrates a monkey shaped façade 46, the façade may be any desired shape.

Figure 37:
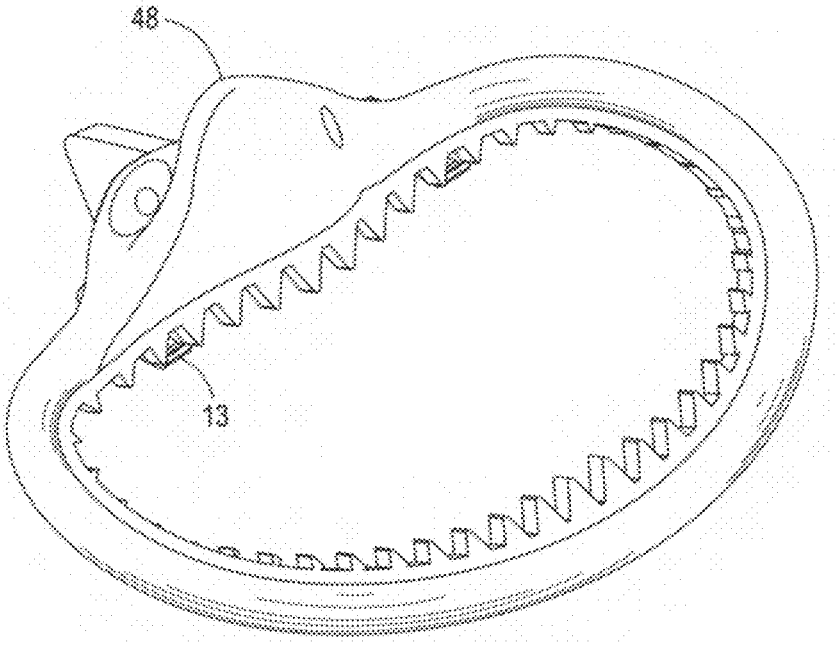

FIG. 37 illustrates a shark mouth shaped façade 48 for the manipulative object controlling apparatus attachment of FIG. 9.

The manipulative object controlling apparatus attachment includes a frame 23, attached non-abrasive feet/skis 13, fitting arm receiving recesses 14 for engaging the fitting arms 60 of the lower frame 80 of FIG. 2.

It is noted that the manipulative object controlling apparatus attachment may have wheels, rollers, and/or bearings which are mounted to the manipulative object controlling apparatus attachment, to facilitate contact with the ground or floor.

It is further noted that the non-abrasive feet/skis 13, wheels, rollers, and/or bearings may be statically attached to the manipulative object controlling apparatus attachment.

It is also noted that the non-abrasive feet/skis 13, wheels, rollers, and/or bearings may be dynamically attached to the manipulative object controlling apparatus attachment so to allow the non-abrasive feet/skis 13, wheels, rollers, and/or bearings to float with the terrain and/or floor.

Although FIG. 37 illustrates the fitting arms as being projections from the lower frame that are received by the manipulative object controlling apparatus attachment, the manipulative object controlling apparatus attachment may have projecting fitting arms and the lower frame have fitting arm receiving recesses for engaging the fitting arms.

The shark mouth shaped façade 48 may be composed of a molded plastic, a fabric, or other material that can sustain a desired shape.

The shark mouth shaped façade 48 may be attached to the ring of the manipulative object controlling apparatus attachment by the utilization of snaps or a loop/hook system.

It is noted that if the shark mouth head shaped façade 48 is composed of fabric, the shark mouth shaped façade 48 may be secured to the ring of manipulative object controlling apparatus attachment with elastic material.

It is further noted that if the shark mouth shaped façade 48 is composed of a plastic material, the shark mouth shaped façade 48 may have enough expansion to allow the façade to fit snuggly to the ring of the manipulative object controlling apparatus attachment.

It is noted that the shark mouth shaped façade 48 can be easily interchangeable with other facades, thus the attachment mechanism facilitates attachment and detachment of the façade.

Although FIG. 37 illustrates a shark mouth shaped façade 48, the façade may be any desired shape.

Figure 38:
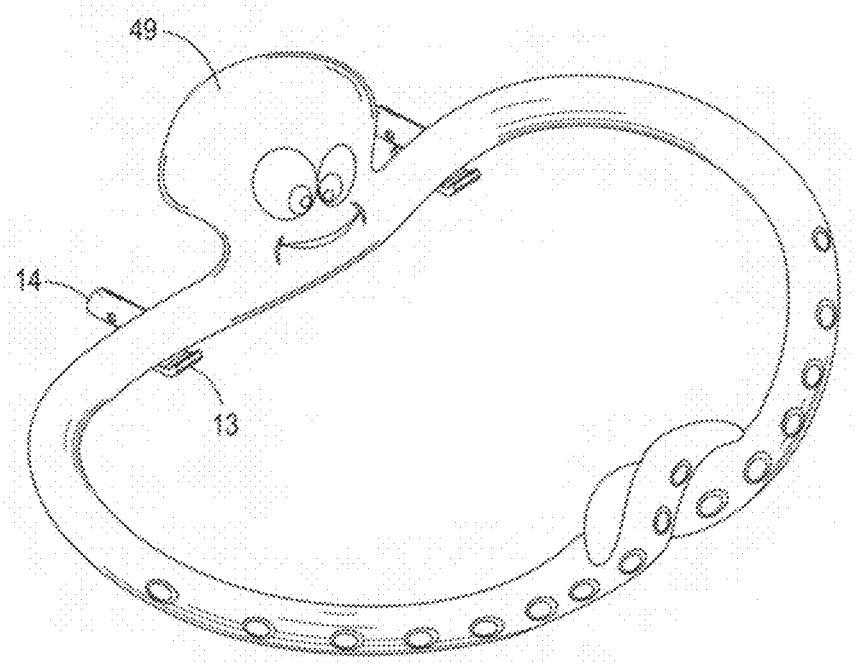

FIG. 38 illustrates an octopus shaped façade 49 for the manipulative object controlling apparatus attachment of FIG. 9.

The manipulative object controlling apparatus attachment includes a frame 23, attached non-abrasive feet/skis 13, fitting arm receiving recesses 14 for engaging the fitting arms 60 of the lower frame 80 of FIG. 2.

It is noted that the manipulative object controlling apparatus attachment may have wheels, rollers, and/or bearings which are mounted to the manipulative object controlling apparatus attachment, to facilitate contact with the ground or floor.

It is further noted that the non-abrasive feet/skis 13, wheels, rollers, and/or bearings may be statically attached to the manipulative object controlling apparatus attachment.

It is also noted that the non-abrasive feet/skis 13, wheels, rollers, and/or bearings may be dynamically attached to the manipulative object controlling apparatus attachment so to allow the non-abrasive feet/skis 13, wheels, rollers, and/or bearings to float with the terrain and/or floor.

Although FIG. 38 illustrates the fitting arms as being projections from the lower frame that are received by the manipulative object controlling apparatus attachment, the manipulative object controlling apparatus attachment may have projecting fitting arms and the lower frame have fitting arm receiving recesses for engaging the fitting arms.

The octopus shaped façade 49 may be composed of a molded plastic, a fabric, or other material that can sustain a desired shape.

The octopus shaped façade 49 may be attached to the ring of the manipulative object controlling apparatus attachment by the utilization of snaps or a loop/hook system.

It is noted that if the octopus head shaped façade 49 is composed of fabric, the octopus shaped façade 49 may be secured to the ring of manipulative object controlling apparatus attachment with elastic material.

It is further noted that if the octopus shaped façade 49 is composed of a plastic material, the octopus shaped façade 49 may have enough expansion to allow the façade to fit snuggly to the ring of the manipulative object controlling apparatus attachment.

It is noted that the octopus shaped façade 49 can be easily interchangeable with other facades, thus the attachment mechanism facilitates attachment and detachment of the façade.

Although FIG. 38 illustrates an octopus shaped façade 49, the façade may be any desired shape.

Figure 39:
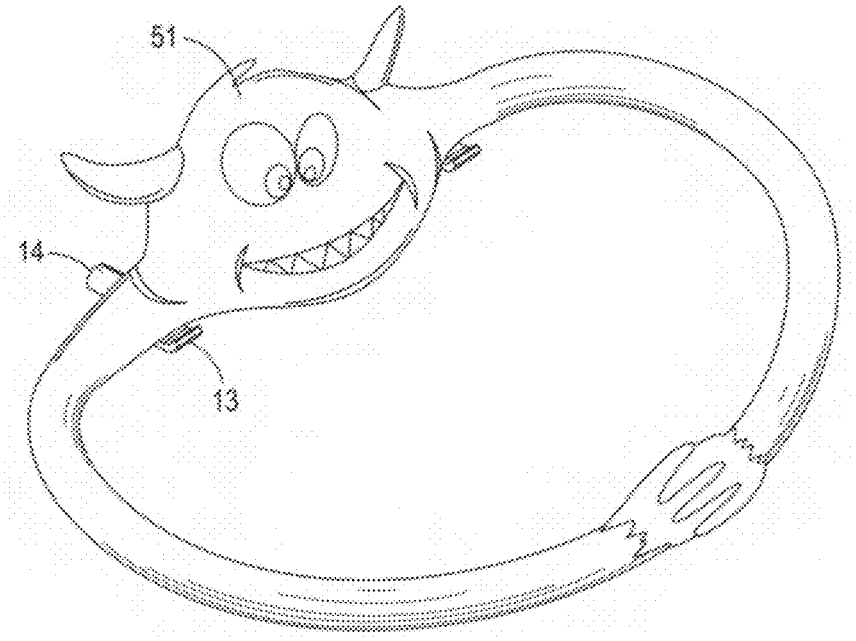

FIG. 39 illustrates a monster shaped façade 51 for the manipulative object controlling apparatus attachment of FIG. 9.

The manipulative object controlling apparatus attachment includes a frame 23, attached non-abrasive feet/skis 13, fitting arm receiving recesses 14 for engaging the fitting arms 60 of the lower frame 80 of FIG. 2.

It is noted that the manipulative object controlling apparatus attachment may have wheels, rollers, and/or bearings which are mounted to the manipulative object controlling apparatus attachment, to facilitate contact with the ground or floor.

It is further noted that the non-abrasive feet/skis 13, wheels, rollers, and/or bearings may be statically attached to the manipulative object controlling apparatus attachment.

It is also noted that the non-abrasive feet/skis 13, wheels, rollers, and/or bearings may be dynamically attached to the manipulative object controlling apparatus attachment so to allow the non-abrasive feet/skis 13, wheels, rollers, and/or bearings to float with the terrain and/or floor.

Although FIG. 39 illustrates the fitting arms as being projections from the lower frame that are received by the manipulative object controlling apparatus attachment, the manipulative object controlling apparatus attachment may have projecting fitting arms and the lower frame have fitting arm receiving recesses for engaging the fitting arms.

The monster shaped façade 51 may be composed of a molded plastic, a fabric, or other material that can sustain a desired shape.

The monster shaped façade 51 may be attached to the ring of the manipulative object controlling apparatus attachment by the utilization of snaps or a loop/hook system.

It is noted that if the monster head shaped façade 51 is composed of fabric, the monster shaped façade 51 may be secured to the ring of manipulative object controlling apparatus attachment with elastic material.

It is further noted that if the monster shaped façade 51 is composed of a plastic material, the monster shaped façade 51 may have enough expansion to allow the façade to fit snuggly to the ring of the manipulative object controlling apparatus attachment.

It is noted that the monster shaped façade 51 can be easily interchangeable with other facades, thus the attachment mechanism facilitates attachment and detachment of the façade.

Although FIG. 39 illustrates a monster shaped façade 51, the façade may be any desired shape.

Figure 40:
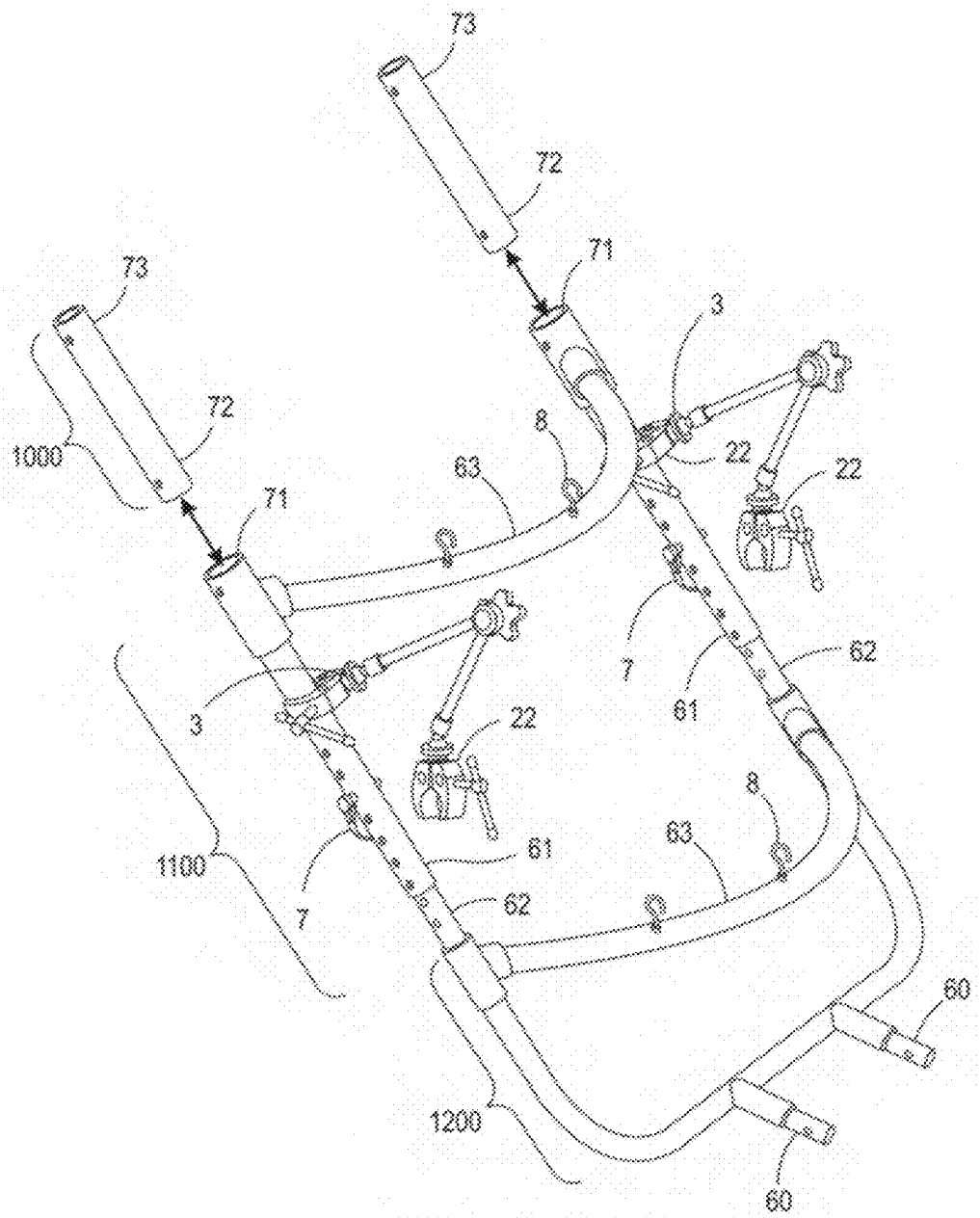
FIG. 40 illustrates a schematic view of another embodiment of an upper and lower frame of an exercise apparatus including curved horizontal supports.

As illustrated in FIG. 40, an exercise apparatus includes a lower frame section 1200, a middle frame section 1100, and an upper frame section 1000. The lower frame section 1200, middle frame section 1100, and upper frame section 1000 may be composed of rigid interconnecting tubes.

Although FIG. 40 illustrates lower frame section 1200, middle frame section 1100, and upper frame section 1000 being constructed of rigid interconnecting tubes, the frame sections may be constructed of any rigid lightweight material. Moreover, the frame sections need not be formed of tubes, but may have any geometric shape that allows interconnectability.

The lower frame section 1200 includes fitting arms 60, which are configured to receive various fitness and/or sport related skill attachments.

As illustrated in FIG. 40, the lower frame section 1200 and middle frame section 1100 include fastener elements 8 for attaching a variety of resistance tubing (as illustrated in FIG. 3) and weight resistance devices (not shown).

It is noted that the upper frame section 1000 include fastener elements 8 for attaching a variety of resistance tubing (as illustrated in FIG. 3) and weight resistance devices (not shown).

Although FIG. 40 illustrates the fitting arms 60 as being projections from the lower frame section 1200 that are received by an attachment, the attachment may have projecting fitting arms and the lower frame section 1200 has a receiving portion for engaging the fitting arms.

Moreover, the mechanism for connecting the lower frame section 1200 to the attachment may be any conventional connecting mechanism that facilitates connect and disconnect characteristics.

For example, the mechanism for connecting the lower frame section 1200 to the attachment may be a pin 7, as illustrated in FIG. 40. Moreover, the mechanism for connecting the lower frame section 1200 to the attachment may be a shear pin to protect the lower frame section 1200 and/or the attachment (not shown).

The lower frame section 1200 includes an incremental lower frame adjustment section 62 that includes points/holes. The middle frame section 1100 also includes an incremental middle frame adjustment section 61 that includes points/holes.

As illustrated in FIG. 40, the lower frame section 1200 is connected to the middle frame section 1100 by lining up holes in the incremental lower frame adjustment section 62 and incremental middle frame adjustment section 61 and inserting a pin 7 through the lined up holes. This allows the overall frame to be adjusted to accommodate individuals and equipment of various sizes.

Although FIG. 40 illustrates the exercise apparatus as being constructed of three detachable frames, the exercise apparatus may be an integral frame that is capable of expanding and contracting in length to facilitate connection to various assistive ambulation devices and to accommodate individuals and equipment of various sizes.

The lined up holes hold the lower frame section 1200 and middle frame section 1100 together by attaching pins 7. The fitting arms 60 hold the lower frame section 1200 to a fitness and/or sport related skill attachment (not shown) by using pins 7.

It is noted that although the attaching pins 7 have been illustrated as removable locking pins, it is noted that the incremental lower frame adjustment section 62 of the lower frame section 1200 or the incremental middle frame adjustment section 61 of the middle frame section 1100 may have built-in push pins that enables the securing of the lower frame section 1200 and middle frame section 1100 together.

It is further noted that the connecting mechanism for connecting the lower frame section 1200 and middle frame section 1100 may be any conventional connection mechanism that enables expanding and contracting in length to facilitate connection to various assistive ambulation devices and to accommodate individuals and equipment of various sizes.

FIG. 40 also illustrates an articulation system, which includes clamp 22 and articulation arm 3, which enables the exercise apparatus to be securely mounted to a wheelchair, walker, gait trainer, stander, and/or other assistive ambulation equipment.

Lastly, FIG. 40 illustrates curved horizontal support 63 connected between vertical sections of the lower frame section 1200 and middle frame section 1100. The fastener elements 8 are located on the curved horizontal support 63.

The curved horizontal supports (63) create a volume for the user to occupy, if needed, when using the exercise apparatus.

For example, the curved horizontal supports (63) may create a volume for the user's legs when the user is in a wheelchair.

FIG. 40 further illustrates that the upper frame section 1000 includes two vertical support sections having holes (72 and 73) at either end of each vertical support section. The vertical support sections engage the middle frame section 1100 at vertical support receiving recesses 71 of the middle frame section 1100.

As illustrated in FIG. 40, the upper frame section 1000 is connected to the middle frame section 1100 by lining up holes 72 in the upper frame section 1000 with holes in the vertical support receiving recesses 71 of the middle frame section 1100 and inserting a pin 7 through the lined up holes. This allows the overall frame to be adjusted to accommodate individuals and equipment of various sizes.

Although FIG. 40 illustrates the vertical support sections of the upper frame section 1000 being received by vertical support receiving recesses 71 of the middle frame section 1100, the middle frame section 1100 may have projecting sections and the upper frame section 1000 has a receiving portion for engaging the projecting sections.

It is noted that non-abrasive feet/skis, wheels, rollers, and/or bearings may be statically attached to the lower frame section 1200 near the fitting arms 60.

It is also noted that non-abrasive feet/skis, wheels, rollers, and/or bearings may be statically attached to a horizontal support of the lower frame section 1200, upon which the fitting arms 60 are located.

It is further noted that non-abrasive feet/skis, wheels, rollers, and/or bearings may be dynamically attached to the lower frame section 1200 near the fitting arms 60 so to allow the non-abrasive feet/skis, wheels, rollers, and/or bearings to float with the terrain and/or floor.

Lastly, it is noted that non-abrasive feet/skis, wheels, rollers, and/or bearings may be dynamically attached to a horizontal support of the lower frame section 1200, upon which the fitting arms 60 are located, so to allow the non-abrasive feet/skis, wheels, rollers, and/or bearings to float with the terrain and/or floor.

Figure 41:
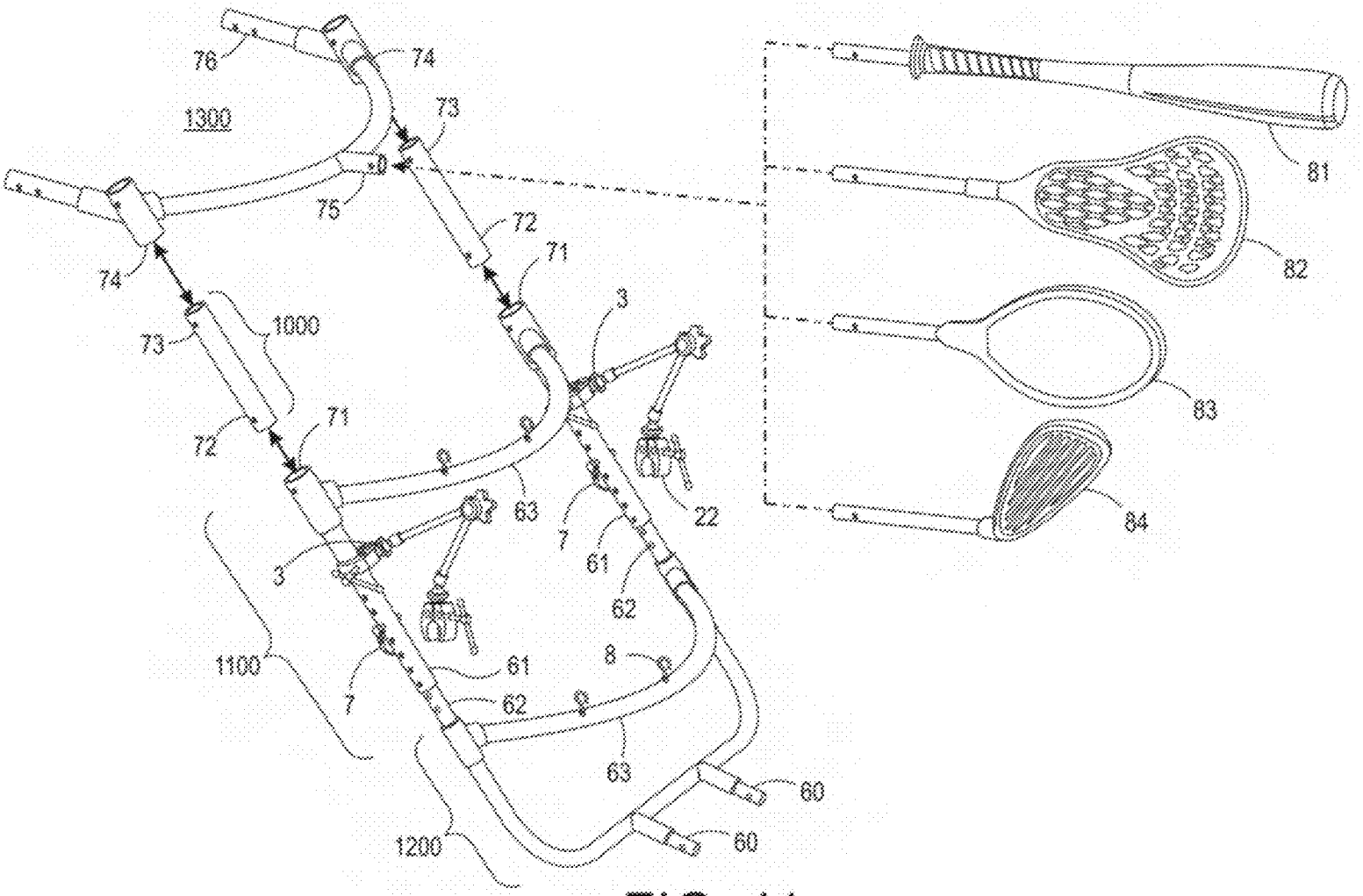
FIG. 41 illustrates a schematic view of another embodiment of an upper and lower frame of an exercise apparatus including curved horizontal supports with an accessory attachment mechanism.

As illustrated in FIG. 41, an exercise apparatus includes a lower frame section 1200, a middle frame section 1100, an upper frame section 1000, and a handle section 1300. The lower frame section 1200, middle frame section 1100, upper frame section 1000, and handle section 1300 may be composed of rigid interconnecting tubes.

Although FIG. 41 illustrates the lower frame section 1200, middle frame section 1100, upper frame section 1000, and handle section 1300 being constructed of rigid interconnecting tubes, the sections may be constructed of any rigid lightweight material. Moreover, the sections need not be formed of tubes, but may have any geometric shape that allows interconnectability.

The lower frame section 1200 includes fitting arms 60, which are configured to receive various fitness and/or sport related skill attachments.

As illustrated in FIG. 41, the lower frame section 1200 and middle frame section 1100 include fastener elements 8 for attaching a variety of resistance tubing (as illustrated in FIG. 3) and weight resistance devices (not shown).

It is noted that the upper frame section 1000 include fastener elements 8 for attaching a variety of resistance tubing (as illustrated in FIG. 3) and weight resistance devices (not shown).

Although FIG. 41 illustrates the fitting arms 60 as being projections from the lower frame section 1200 that are received by an attachment, the attachment may have projecting fitting arms and the lower frame section 1200 has a receiving portion for engaging the fitting arms.

Moreover, the mechanism for connecting the lower frame section 1200 to the attachment may be any conventional connecting mechanism that facilitates connect and disconnect characteristics.

For example, the mechanism for connecting the lower frame section 1200 to the attachment may be a pin 7, as illustrated in FIG. 40. Moreover, the mechanism for connecting the lower frame section 1200 to the attachment may be a shear pin to protect the lower frame section 1200 and/or the attachment (not shown).

The lower frame section 1200 includes an incremental lower frame adjustment section 62 that includes points/holes. The middle frame section 1100 also includes an incremental middle frame adjustment section 61 that includes points/holes.

As illustrated in FIG. 41, the lower frame section 1200 is connected to the middle frame section 1100 by lining up holes in the incremental lower frame adjustment section 62 and incremental middle frame adjustment section 61 and inserting a pin 7 through the lined up holes. This allows the overall frame to be adjusted to accommodate individuals and equipment of various sizes.

Although FIG. 41 illustrates the exercise apparatus as being constructed of three detachable frames, the exercise apparatus may be an integral frame that is capable of expanding and contracting in length to facilitate connection to various assistive ambulation devices and to accommodate individuals and equipment of various sizes.

The lined up holes hold the lower frame section 1200 and middle frame section 1100 together by attaching pins 7. The fitting arms 60 hold the lower frame section 1200 to a fitness and/or sport related skill attachment (not shown) by using pins 7.

It is noted that although the attaching pins 7 have been illustrated as removable locking pins, it is noted that the incremental lower frame adjustment section 62 of the lower frame section 1200 or the incremental middle frame adjustment section 61 of the middle frame section 1100 may have built-in push pins that enables the securing of the lower frame section 1200 and middle frame section 1100 together.

It is further noted that the connecting mechanism for connecting the lower frame section 1200 and middle frame section 1100 may be any conventional connection mechanism that enables expanding and contracting in length to facilitate connection to various assistive ambulation devices and to accommodate individuals and equipment of various sizes.

FIG. 41 also illustrates an articulation system, which includes clamp 22 and articulation arm 3, which enables the exercise apparatus to be securely mounted to a wheelchair, walker, gait trainer, stander, and/or other assistive ambulation equipment.

Lastly, FIG. 41 illustrates curved horizontal support 63 connected between vertical sections of the lower frame section 1200 and middle frame section 1100. The fastener elements 8 are located on the curved horizontal support 63.

The curved horizontal supports (63) create a volume for the user to occupy, if needed, when using the exercise apparatus.

For example, the curved horizontal supports (63) may create a volume for the user's legs when the user is in a wheelchair.

FIG. 41 further illustrates that the upper frame section 1000 includes two vertical support sections having holes (72 and 73) at either end of each vertical support section. The vertical support sections engage the middle frame section 1100 at vertical support receiving recesses 71 of the middle frame section 1100.

As illustrated in FIG. 41, the upper frame section 1000 is connected to the middle frame section 1100 by lining up holes 72 in the upper frame section 1000 with holes in the vertical support receiving recesses 71 of the middle frame section 1100 and inserting a pin 7 through the lined up holes. This allows the overall frame to be adjusted to accommodate individuals and equipment of various sizes.

Although FIG. 41 illustrates the vertical support sections of the upper frame section 1000 being received by vertical support receiving recesses 71 of the middle frame section 1100, the middle frame section 1100 may have projecting sections and the upper frame section 1000 has a receiving portion for engaging the projecting sections.

It is noted that non-abrasive feet/skis, wheels, rollers, and/or bearings may be statically attached to the lower frame section 1200 near the fitting arms 60.

It is also noted that non-abrasive feet/skis, wheels, rollers, and/or bearings may be statically attached to a horizontal support of the lower frame section 1200, upon which the fitting arms 60 are located.

It is further noted that non-abrasive feet/skis, wheels, rollers, and/or bearings may be dynamically attached to the lower frame section 1200 near the fitting arms 60 so to allow the non-abrasive feet/skis, wheels, rollers, and/or bearings to float with the terrain and/or floor.

Lastly, it is noted that non-abrasive feet/skis, wheels, rollers, and/or bearings may be dynamically attached to a horizontal support of the lower frame section 1200, upon which the fitting arms 60 are located, so to allow the non-abrasive feet/skis, wheels, rollers, and/or bearings to float with the terrain and/or floor.

With respect to FIG. 41, the handle section 1300 includes a curved horizontal support. The curved horizontal support has located thereon a receiving recess 75 for receiving a manipulative striking apparatus attachment; such as a bat shaped manipulative striking apparatus attachment 81, a lacrosse stick shaped manipulative striking apparatus attachment 82, a paddle/racket shaped manipulative striking apparatus attachment 83, a golf club shaped manipulative striking apparatus attachment 84, etc.

The handle section 1300 is connected to the manipulative striking apparatus attachment by lining up holes in the receiving recess 75 with holes in the manipulative striking apparatus attachment and inserting a pin 7 through the lined up holes.

Although FIG. 41 illustrates the manipulative striking apparatus attachment as being projections that are received by receiving recess 75, the handle section 1300 may have a projecting section and the manipulative striking apparatus attachment has a receiving portion.

FIG. 41 illustrates that the handle section 1300 includes receiving recesses 74 for receiving the vertical supports of the upper frame section 1000. The handle section 1300 is connected to the vertical supports of the upper frame section 1000 by lining up holes in the receiving recess 74 with holes 73 in the vertical supports of the upper frame section 1000 and inserting a pin 7 through the lined up holes.

Although FIG. 41 illustrates the vertical supports of the upper frame section 1000 as being projections that are received by receiving recess 74, the handle section 1300 may have a projecting section and the vertical supports of the upper frame section 1000 have a receiving portion.

Lastly, FIG. 41 illustrates that the handle section 1300 includes a handle attachment section 76 for attaching handles thereto.

Figure 42:
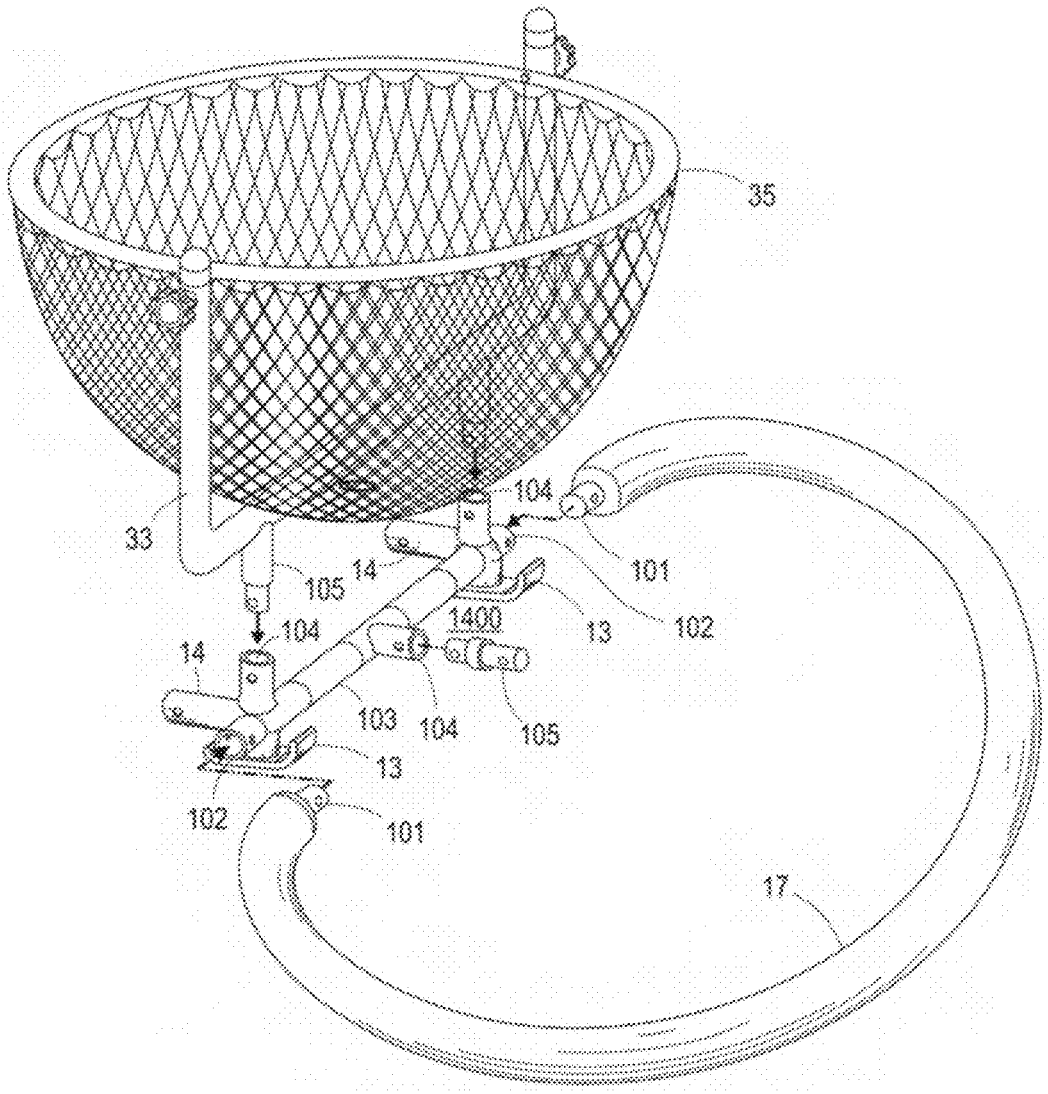
FIG. 42 illustrates a multiple accessory attachment device for attaching to the exercise apparatus to enable attachment of various accessories.

FIG. 42 illustrates an accessory attachment interface 1400. The accessory attachment interface 1400 provides a mechanical (connection) interface between a lower frame section 1200, as illustrated in FIGS. 40 and 41, and various attachments.

The accessory attachment interface 1400 includes receiving recesses 14 for receiving fitting arms of a lower frame section and a horizontal support 103.

It is noted that that the receiving recesses could be part of the lower frame section and the fitting arms part of the accessory attachment interface 1400.

The accessory attachment interface 1400 includes side receiving recesses 102 for receiving projections 101 of a detachable manipulative object controlling apparatus attachment 17, such as discussed above.

The accessory attachment interface 1400 further includes a forward receiving recess 104 for receiving a projection of a manipulative striking apparatus attachment (not shown), such as discussed above.

FIG. 42 further illustrates a conversion projection 105 which converts the forward receiving recess 104 into a projection for engaging a receiving recess of a manipulative striking apparatus attachment (not shown).

The accessory attachment interface 1400 includes upper receiving recesses 104 for receiving projections 105 of a detachable apparatus attachment, such as the illustrated hoop/basket 35 of attachment 33.

The accessory attachment interface 1400 includes attached non-abrasive feet/skis 13.

It is noted that the accessory attachment interface 1400 may have wheels, rollers, and/or bearings which are mounted to the accessory attachment interface 1400, to facilitate contact with the ground or floor.

It is further noted that the non-abrasive feet/skis 13, wheels, rollers, and/or bearings may be statically attached to the accessory attachment interface 1400.

It is also noted that the non-abrasive feet/skis 13, wheels, rollers, and/or bearings may be dynamically attached to the accessory attachment interface 1400 so to allow the non-abrasive feet/skis 13, wheels, rollers, and/or bearings to float with the terrain and/or floor.

It is noted that although the various ramps discussed above were illustrated as single integral frames the ramps can be constructed of an adjustable frame, collapsible frame, foldable frame, or modular frames to facilitate easier transport and storage.

Figure 43:
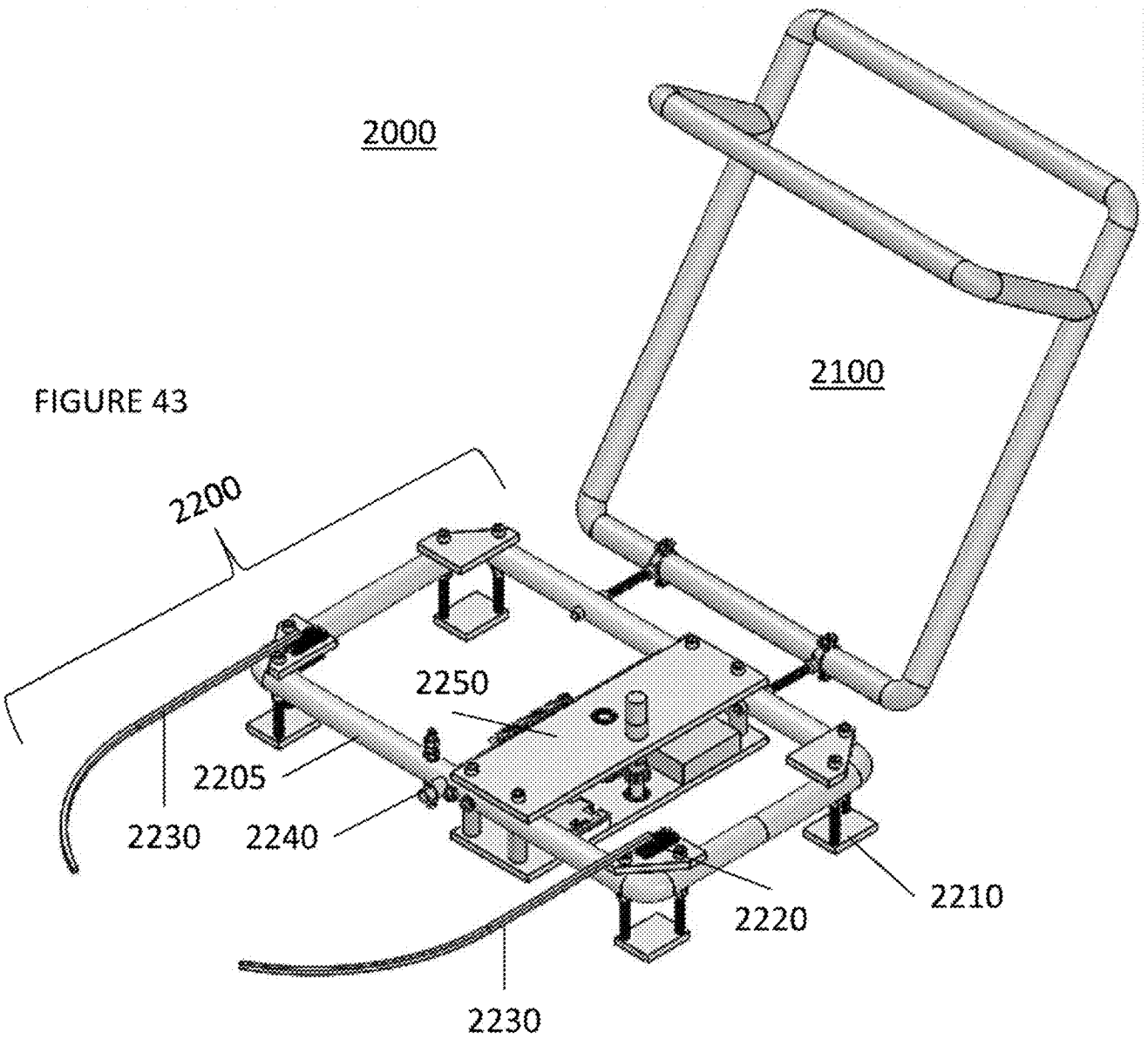
FIG. 43 illustrates a striking apparatus for capturing an object and launching the captured object.

FIG. 43 illustrates a striking apparatus 2000 for capturing an object and launching the captured object. As illustrated in FIG. 43, the striking apparatus 2000 includes a user interface frame 2100 for the striking apparatus 2000 to enable a user, confined to assistive ambulation equipment, such as a wheelchair or walker, to use striking mechanism 2200. The user interface frame 2100 is detachably connected to the striking mechanism 2200.

The user interface frame 2100 may include attachment mechanisms (not shown) to attach the user interface frame 2100 to assistive ambulation equipment. The user interface frame 2100 may also include a control pad or joy stick (not shown) to enable the user to operate capture arms 2230 and/or launching (striking) mechanism 2240, as will be described in more detail below with respect to FIGS. 65 and 66.

The striking mechanism 2200 includes non-abrasive skids 2210 for enabling the movement of the striking apparatus 2200 across a surface. The non-abrasive skids 2210 may be non-abrasive feet/skis, wheels, rollers, and/or bearings that may be dynamically attached to the striking apparatus 2200 so to allow the non-abrasive skids 2210 to float with the terrain and/or floor (surface).

The striking mechanism 2200 also includes a front portion frame 2205 and capture arms 2230 for capturing an object, such as a ball, and launching (striking) mechanism 2240 for launching (propelling) the captured object in a direction away from the striking apparatus 2000. The front portion frame 2205 and capture arms 2230 form a capture area.

The opened and closed state of the capture arms 2230 is driven by servos 2220, which operate in response to the user's commands inputted through a control pad or panel (not shown) located on the user interface frame 2100.

The activation of the launching (striking) mechanism 2240 also operates in response to the user's commands inputted through a control pad or panel (not shown) located on the user interface frame 2100.

The striking mechanism 2200 includes a launching mechanism assembly 2250, which houses a servo, gears, springs, a power source, a launching member, and a controller, which will be explained in more detail below.

In operation, the user positions the striking apparatus 2000 to intercept an object travelling towards the user. To capture the object, the user activates a switch (button or lever) on the control panel to open the capture arms 2230. Once the object passes the opened capture arms 2230, the user activates another switch (button or lever) on the control panel to close the capture arms 2230. It is noted that the user could activate the same switch if the switch is a toggle type switch.

When the user is ready to launch or propel the object, within the capture area, away from the user, the user opens the capture arms 2230, through the control panel, and activates a switch (button or lever) on the control panel to activate the launching (striking) mechanism 2240.

Figure 44:
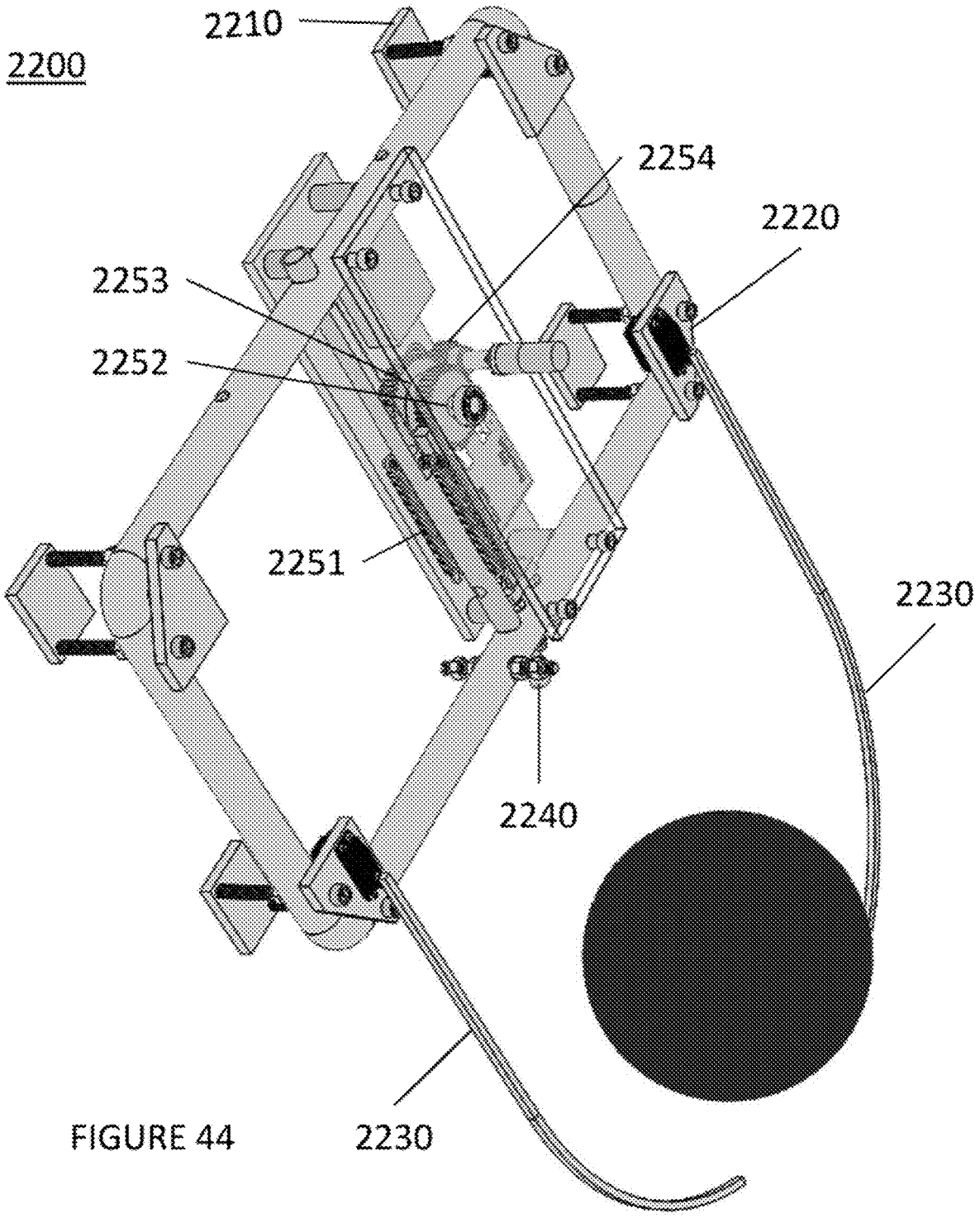
FIG. 44 illustrates the launching mechanism assembly of the striking apparatus of FIG. 43.

FIG. 44 illustrates the launching mechanism assembly of the striking apparatus of FIG. 43. As illustrated in FIG. 44, the launching mechanism assembly includes a drive gear 2254, driven by a servo controlled by a controller, in response to user input, which causes, through transfer gear 2253 and launching mechanism firing gear 2252, the launching (striking) mechanism 2240 to move away from the capture area. As the launching (striking) mechanism 2240 moves away from the capture area, spring(s) 2251, connected to the launching (striking) mechanism 2240 is/are stretched to increase the potential energy.

When the launching mechanism firing gear 2252 releases the launching (striking) mechanism 2240, the energy within the spring(s) 2251, causes the launching (striking) mechanism 2240 to move towards the capture area, striking the captured object and propelling the object away from the user.

Figure 45:
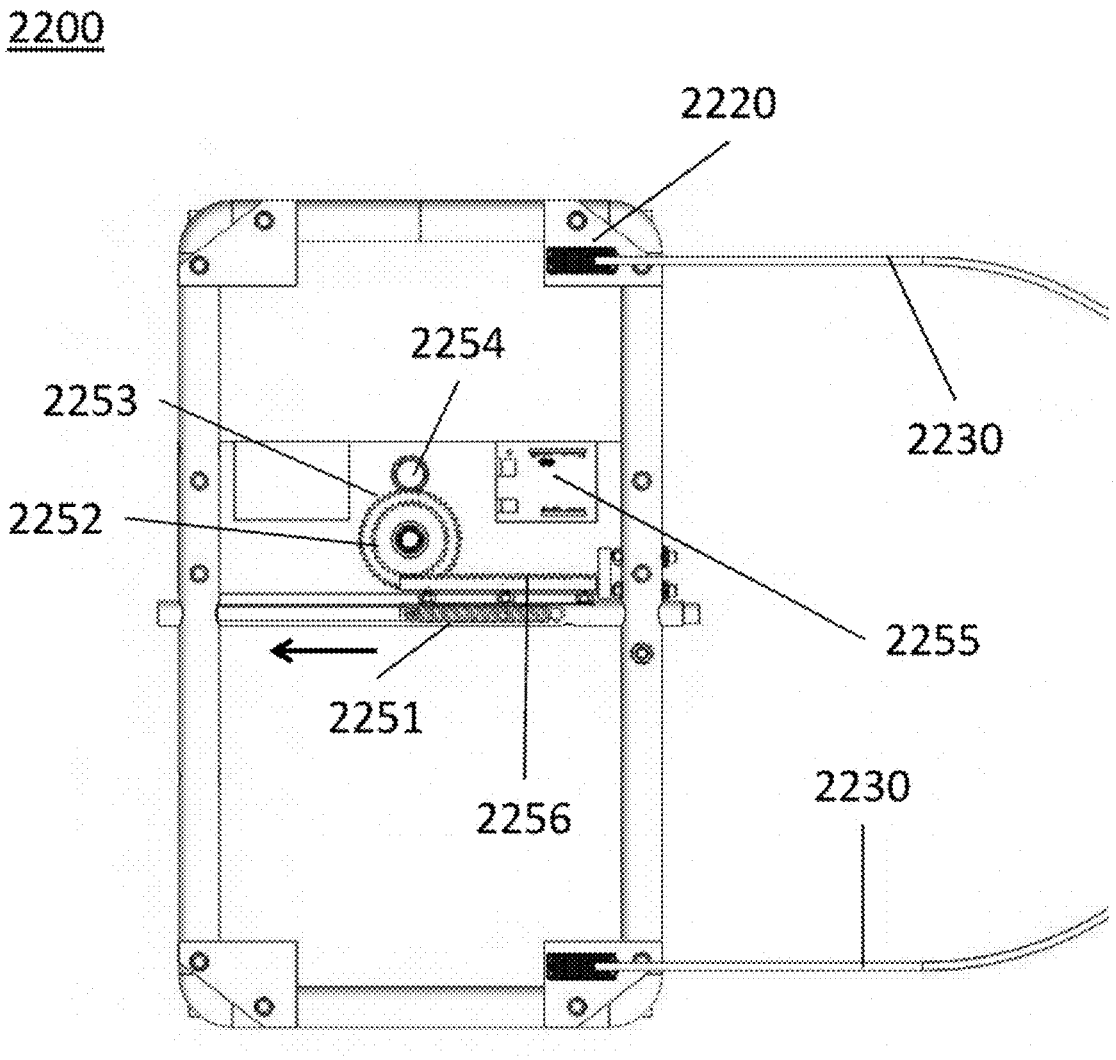
FIG. 45 illustrates the launching mechanism assembly of the striking apparatus of FIG. 43.

FIG. 45 illustrates the launching mechanism assembly of the striking apparatus of FIG. 43. As illustrated in FIG. 45, the launching mechanism assembly includes a drive gear 2254, driven by a servo controlled by a controller, in response to user input, which causes, through transfer gear 2253 and launching mechanism firing gear 2252, a straight gear 2256 to move in a direction away from the capture area.

As the straight gear 2256 moves away from the capture area, the launching (striking) mechanism 2240, attached to the straight gear 2256, moves away from the capture area, spring(s) 2251, connected to the launching (striking) mechanism 2240 is/are stretched to increase potential energy.

When the launching mechanism firing gear 2252 releases the straight gear 2256, the energy within the spring(s) 2251, causes the launching (striking) mechanism 2240 to move towards the capture area, striking the captured object and propelling the object away from the user.

Figure 46:
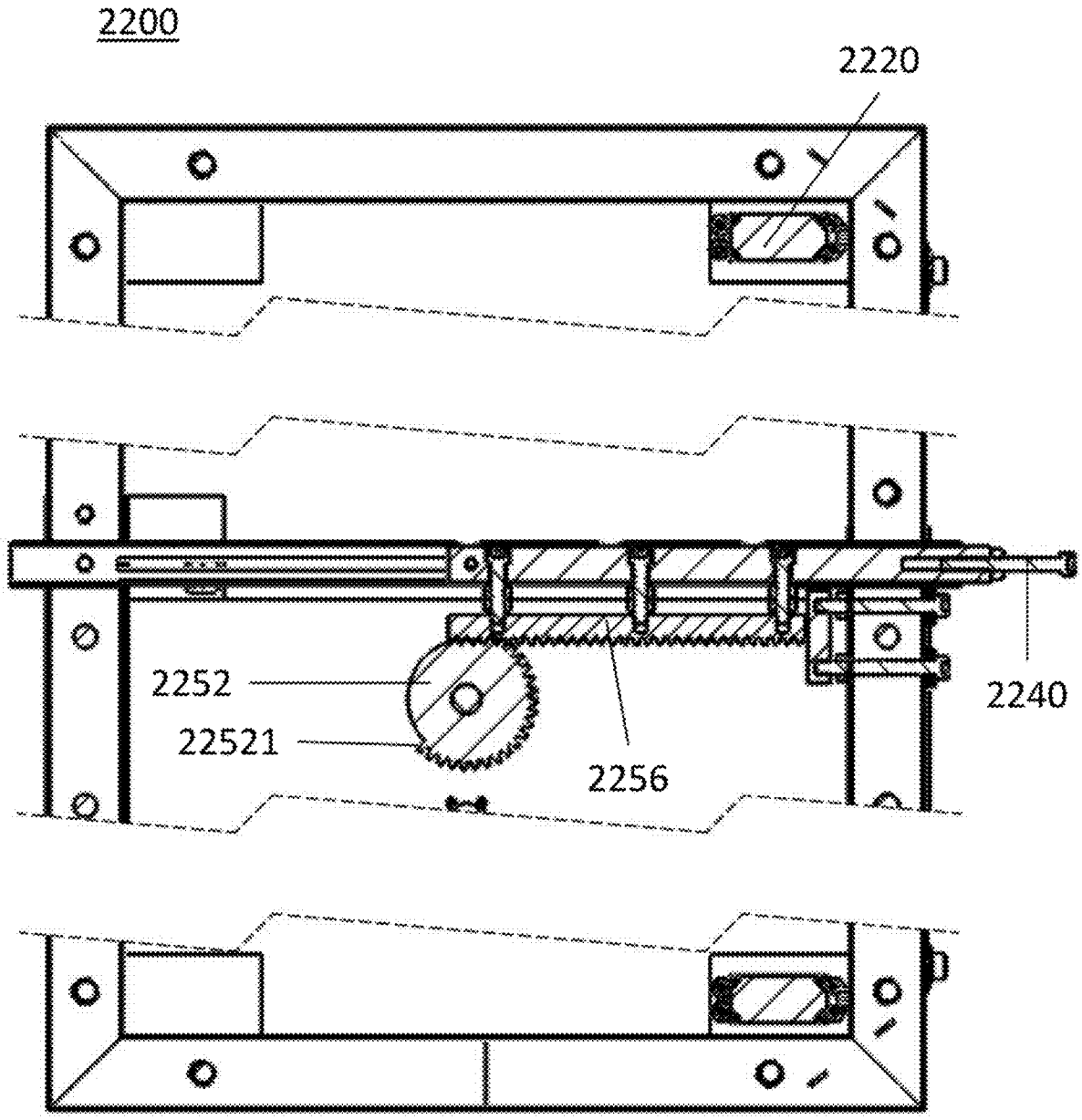
FIG. 46 illustrates the launching mechanism assembly of the striking apparatus of FIG. 43.

FIG. 46 illustrates the launching mechanism assembly of the striking apparatus of FIG. 43. As illustrated in FIG. 46, the launching mechanism assembly includes a drive gear 2254, driven by a servo controlled by a controller, in response to user input, which causes, through transfer gear 2253 and launching mechanism interface gear 2252, a straight gear 2256 to move in a direction away from the capture area.

As illustrated in FIG. 46, launching mechanism firing gear 2252 does not have teeth completely around the circumference of the launching mechanism firing gear 2252. Once the last gear tooth 22521 of the launching mechanism firing gear 2252 disengages the straight gear 2256, the launching (striking) mechanism 2240 will be propelled towards the capture area, in response to the force from the spring(s) 2251.

Figure 47:
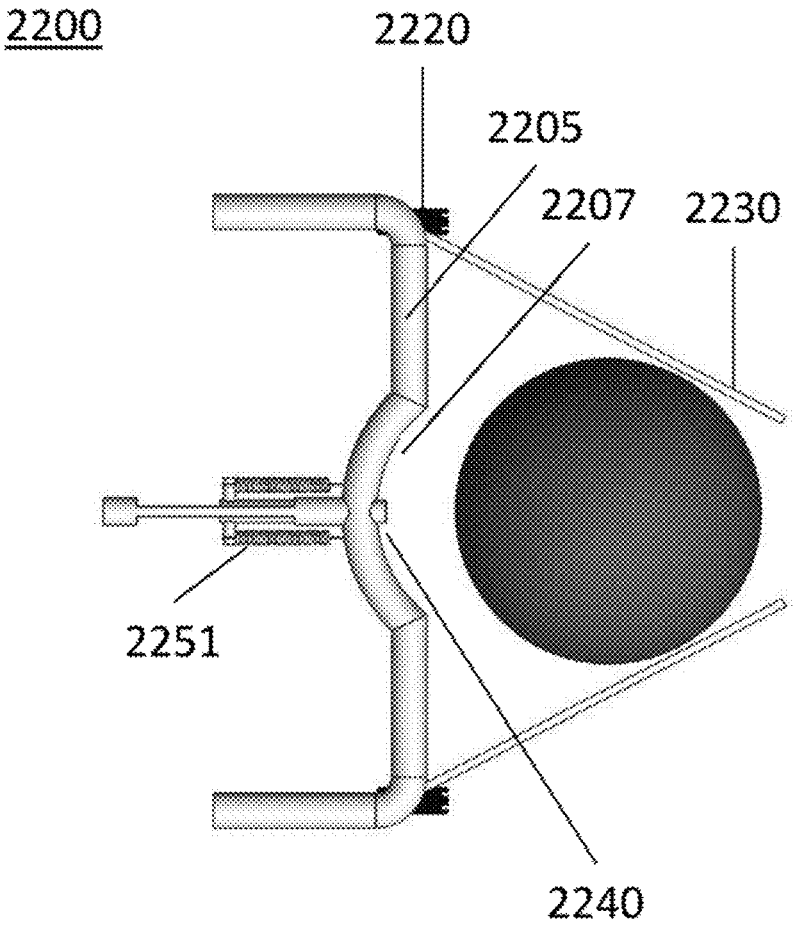
FIG. 47 illustrates another embodiment of the striking apparatus for capturing an object and launching the captured object.

FIG. 47 illustrates another embodiment of the striking apparatus for capturing an object and launching the captured object. As illustrated in FIG. 47, the striking mechanism 2200 includes a front portion frame 2205 having a curved reception area 2207 for facilitating the reception of the captured object and for enabling proper placement of the captured object within a striking area of the launching (striking) mechanism 2240.

Figure 48:
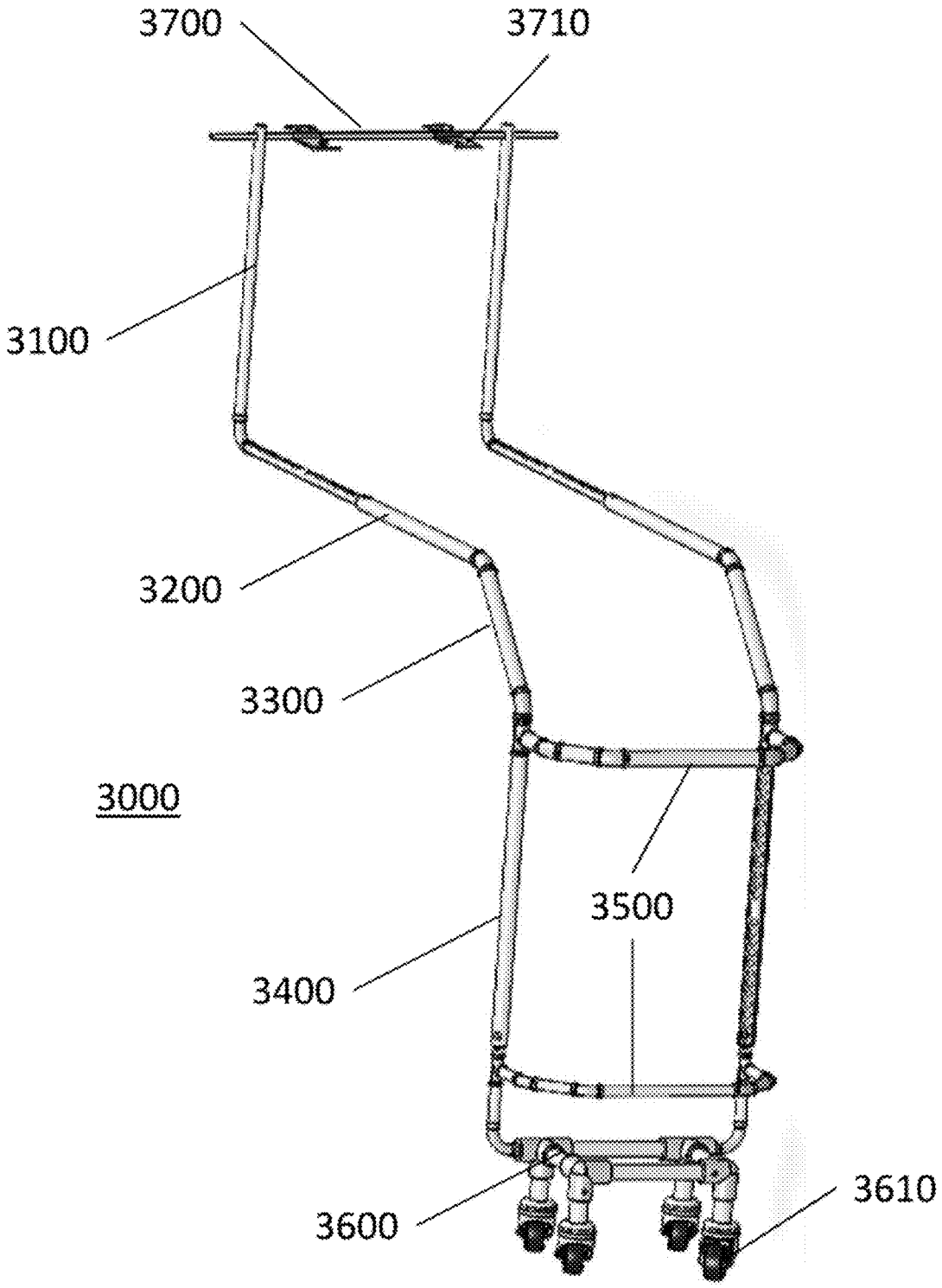
FIG. 48 illustrates a schematic view of a frame of an exercise apparatus for attaching to assistive ambulation equipment.

FIG. 48 illustrates a schematic view of a frame of an exercise apparatus for attaching to assistive ambulation equipment. As illustrated in FIG. 48, an exercise apparatus 3000 for attaching to assistive ambulation equipment (not shown) includes an upper horizontal frame portion 3700, upper vertical frame portions 3100, horizontal frame portions 3200, transition frame portions 3300, lower vertical frame portions 3400, and a mobility frame portion 3600 that includes wheels 3610.

It is noted that the wheels 3610 can be replaced with non-abrasive feet/skis, rollers, and/or bearings to enable the exercise apparatus 3000 to move across terrain and/or a floor.

The exercise apparatus 3000 also includes horizontal frame support portions 3500, which are connected between the lower vertical frame portions 3400. The horizontal frame support portions 3500 may be curved to allow a user to comfortably locate their legs between the horizontal frame support portions 3500 and the assistive ambulation equipment.

The upper horizontal frame portion 3700 includes assistive ambulation equipment attachment members 3710 to enable attachment of the exercise apparatus 3000 to the assistive ambulation equipment. The configuration of the assistive ambulation equipment attachment members 3710 will be discussed in more detail below.

The upper vertical frame portions 3100, the horizontal frame portions 3200, and the lower vertical frame portions 3400 may be telescopic to enable a changing of the dimensions of the exercise apparatus 3000 to fit the assistive ambulation equipment to which the exercise apparatus 3000 is being attached. Moreover, the various frame portions may be detachably attached to enable easy disassembly and modularity.

For example, the upper horizontal frame portion 3700 may be detachably attached to the upper vertical frame portions 3100, the upper vertical frame portions 3100 may be detachably attached to the horizontal frame portions 3200, the horizontal frame portions 3200 may be detachably attached to the transition frame portions 3300, the transition frame portions 3300 may be detachably attached to the lower vertical frame portions 3400, the lower vertical frame portions 3400 may be detachably attached to the mobility frame portion 3600, and the lower vertical frame portions 3400 may be detachably attached to the horizontal frame support portions 3500.

It is noted that the striking mechanism 2200, described above with respect to FIGS. 43 through 47, can be detachably attached to the mobility frame portion 3600 of the exercise apparatus 3000, and a control panel for controlling the operations of the striking mechanism 2200 can be detachably attached to a horizontal frame support portion 3500 or a horizontal frame portion 3200. The control panel may be hardwired to the striking mechanism 2200 or communicate, wirelessly (such as Bluetooth™), with the striking mechanism 2200.

Figure 49:
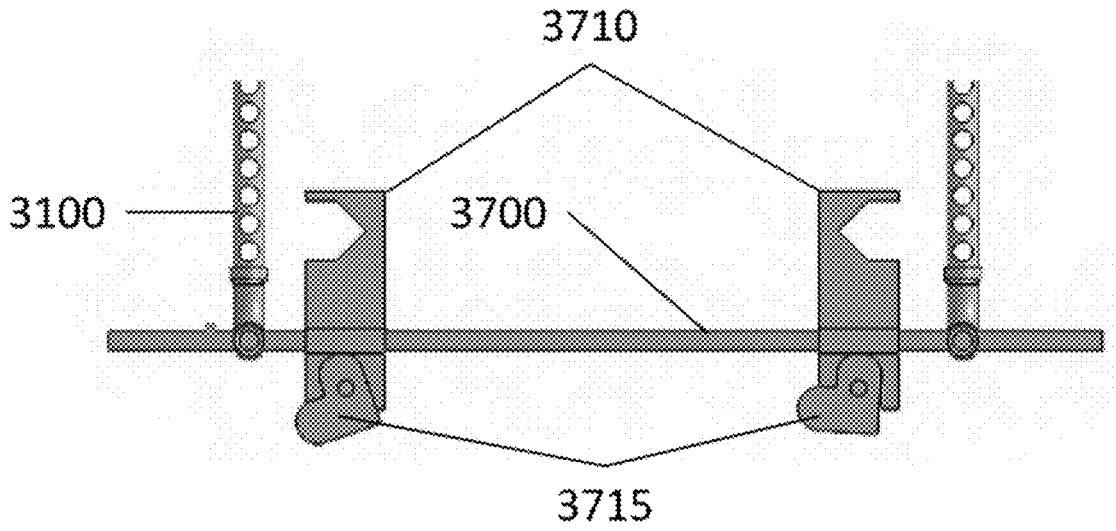
FIGS. 49 and 50 illustrate the assistive ambulation equipment attachment mechanism for the exercise apparatus of FIG. 48.
Figure 50:
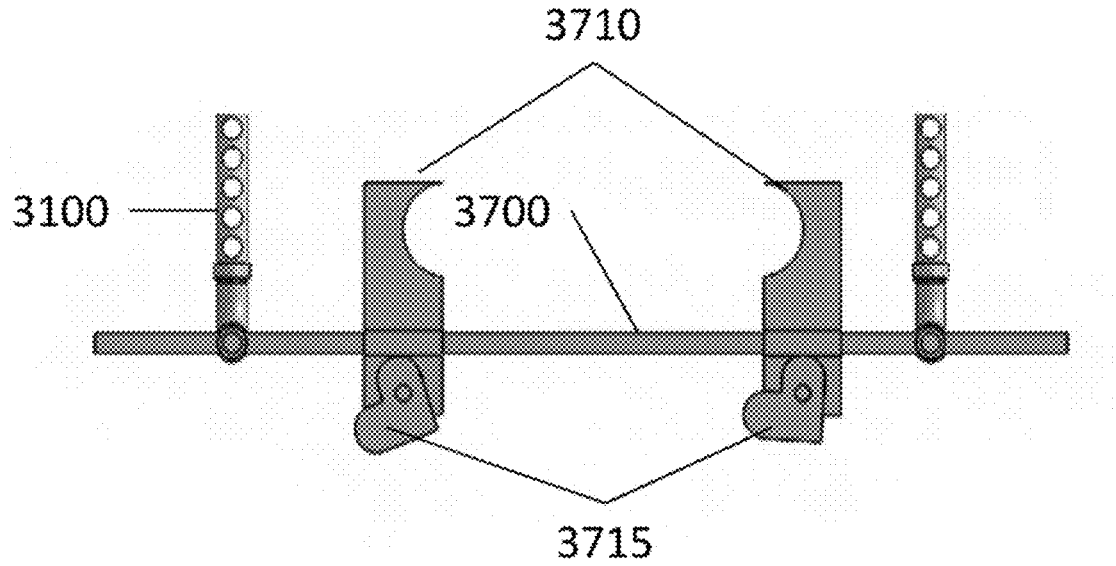

FIGS. 49 and 50 illustrate the assistive ambulation equipment attachment members for the exercise apparatus of FIG. 48. As illustrated in FIG. 49, the upper horizontal frame portion 3700 includes assistive ambulation equipment attachment members 3710 that are configured to engage the back support frame of the assistive ambulation equipment, such as the back support tubular frame of a wheelchair.

The assistive ambulation equipment attachment members 3710 may slide along the upper horizontal frame portion 3700 so that the assistive ambulation equipment attachment members 3710 can be positioned for proper engagement with the assistive ambulation equipment. Once proper positioned, the assistive ambulation equipment attachment members 3710 includes locking mechanisms 3715 that releasably lock the assistive ambulation equipment attachment members 3710 into place on the upper horizontal frame portion 3700.

The engagement portion of the assistive ambulation equipment attachment members 3710 can be configured to receive the portion of the assistive ambulation equipment being engaged.

As illustrated in FIG. 50, the upper horizontal frame portion 3700 includes assistive ambulation equipment attachment members 3710 that are configured to engage the assistive ambulation equipment, such as the back portion of a seat of a power wheelchair.

The assistive ambulation equipment attachment members 3710 may slide along the upper horizontal frame portion 3700 so that the assistive ambulation equipment attachment members 3710 can be positioned for proper engagement with the assistive ambulation equipment. Once proper positioned, the assistive ambulation equipment attachment members 3710 includes locking mechanisms 3715 that releasably lock the assistive ambulation equipment attachment members 3710 into place on the upper horizontal frame portion 3700.

The engagement portion of the assistive ambulation equipment attachment members 3710 can be configured to receive the portion of the assistive ambulation equipment being engaged.

Figure 51:
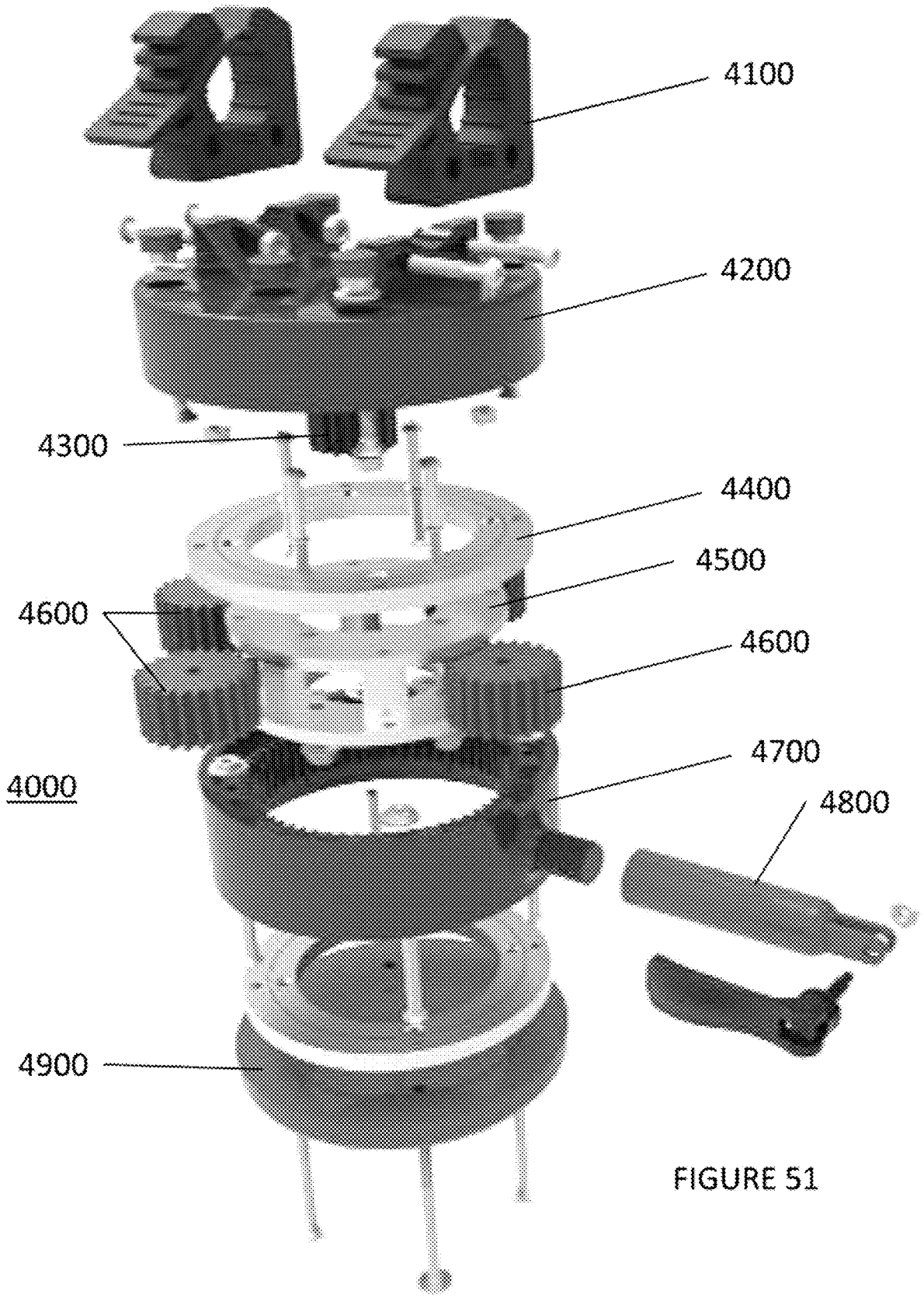
FIG. 51 illustrates an exploded view of a striking mechanism.

FIG. 51 illustrates an exploded view of a striking mechanism 4000. As illustrated in FIG. 51, the striking mechanism 4000 includes striking apparatus attachment members 4100 for attaching a striking apparatus (not shown), such as a bat or tennis racket, to the striking mechanism 4000. The striking apparatus attachment members 4100 are detachably attached to a striking apparatus rotating member 4200, which includes a sun gear 4300.

The sun gear 4300 of the striking apparatus rotating member 4200 is operably engaged with planet gears 4600 of planet gear retainer 4500. The striking apparatus rotating member 4200 is slidably engaged with retention member 4400 such that the striking apparatus rotating member 4200 may slid along a surface of the retention member 4400 as the sun gear 4300 causes the striking apparatus rotating member 4200 is slidably engaged with retention member 4400 such that the striking apparatus rotating member 4200 to rotate.

The planet gears 4600 and the planet gear retainer 4500 are fitted within a handle gear ring 4700 having gear teeth on an interior circumference of the handle gear ring 4700 such that the gear teeth of the handle gear ring 4700 engage the gear teeth of the planet gears 4600. A handle 4800 is detachably attached to the handle gear ring 4700.

The striking mechanism 4000 also includes an exercise apparatus attachment member 4900 for detachably attaching the striking mechanism 4000 to the exercise apparatus; for example, the exercise apparatus of FIG. 48. More specifically, the exercise apparatus attachment member 4900 may be detachably attached to the horizontal frame support portion 3500 or the horizontal frame portion 3200 of the exercise apparatus of FIG. 48.

It is noted that the exercise apparatus attachment member 4900 may be attached to a stand, such as a tripod-like stand (three-legged stand wherein the three legs merge at the connection site between the exercise apparatus attachment member 4900 and the stand and the other end of the three legs are flared from a center line to provide a stable base) or a weighted single pole stand (a weighted base with a single vertical member to which the exercise apparatus attachment member 4900 is attached), so that the striking mechanism 4000 can be utilized as a stand-alone device The planet gear retainer 4500 is attached to the exercise apparatus attachment member 4900 so that the planet gear retainer 4500 does not rotate as a user rotates the handle gear ring 4700, by moving the handle 4800.

The gear teeth on the interior circumference of the handle gear ring 4700, in response to the user moving the handle, rotationally engage the planet gears 4600, imparting rotational motion upon the planet gears 4600. In turn, the planet gears 4600 rotationally engage the sun gear 4300, imparting a rotational motion upon the sub gear 4300. The rotational motion of the sun gear 4300 causes the striking apparatus (not shown), attached to the striking apparatus attachment members 4100 to rotate, thereby enabling the striking apparatus (not shown) to strike an object.

Figure 52:
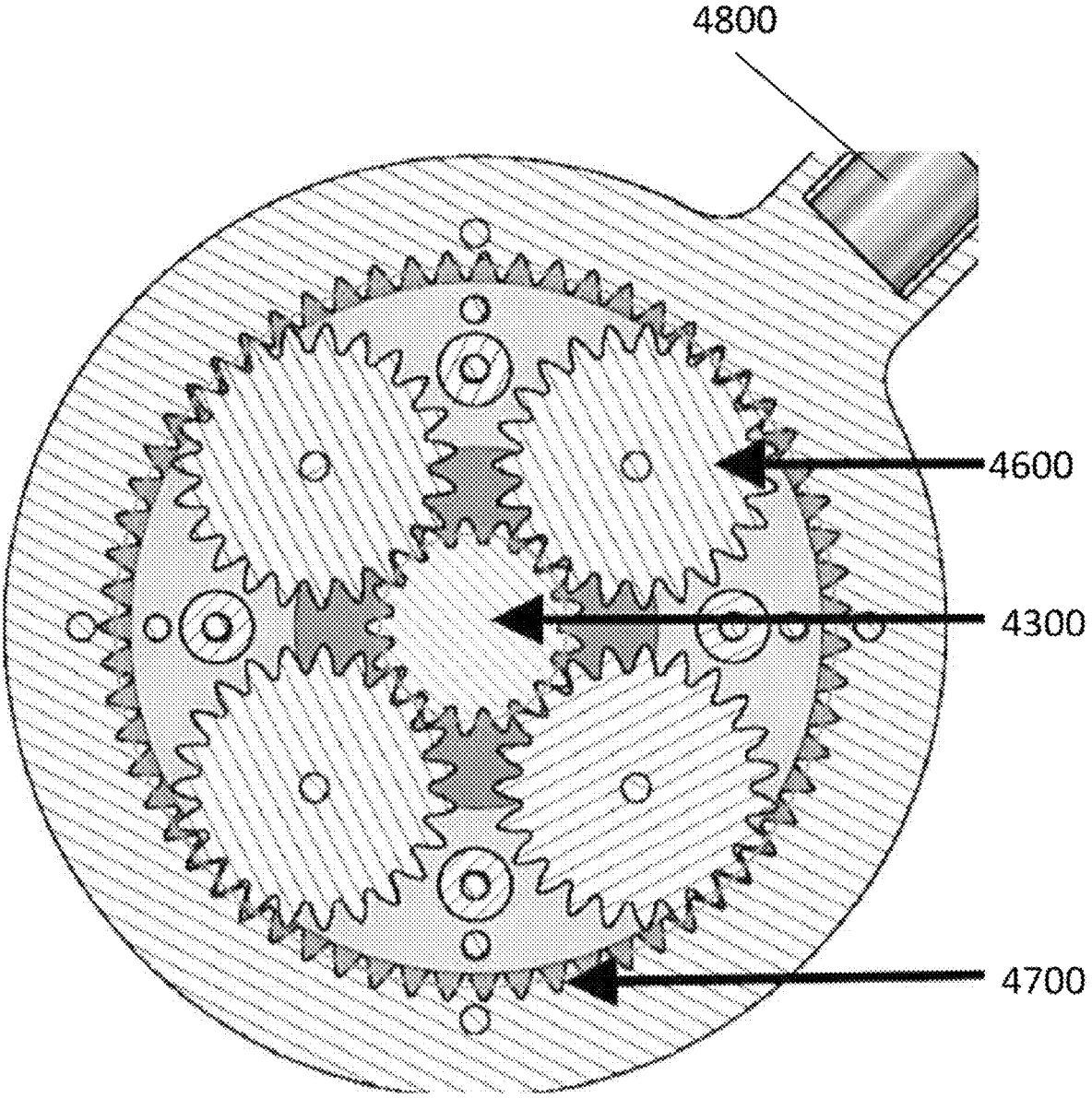
FIG. 52 illustrates the gear assembly of the striking mechanism of FIG. 51.

FIG. 52 illustrates the gear assembly of the striking mechanism of FIG. 51. As illustrated in FIG. 52, the gear assembly includes center located sun gear 4300, orbiting planet gears 4600, and surrounding handle gear ring 4700 having gear teeth on an interior circumference thereof.

As a handle 4800 is moved in a clockwise direction, the handle gear ring 4700 rotates in a clockwise direction. The clockwise rotation of the gear teeth on the interior circumference of the handle gear ring 4700 causes the planet gears 4600 to rotate in a clockwise direction. The clockwise rotation of the planet gears 4600 causes the sun gear 4300 to rotate in a counter-clockwise direction, which, in turns, causes the striking apparatus (not shown) to rotate in a counter-clockwise direction.

Figure 53:
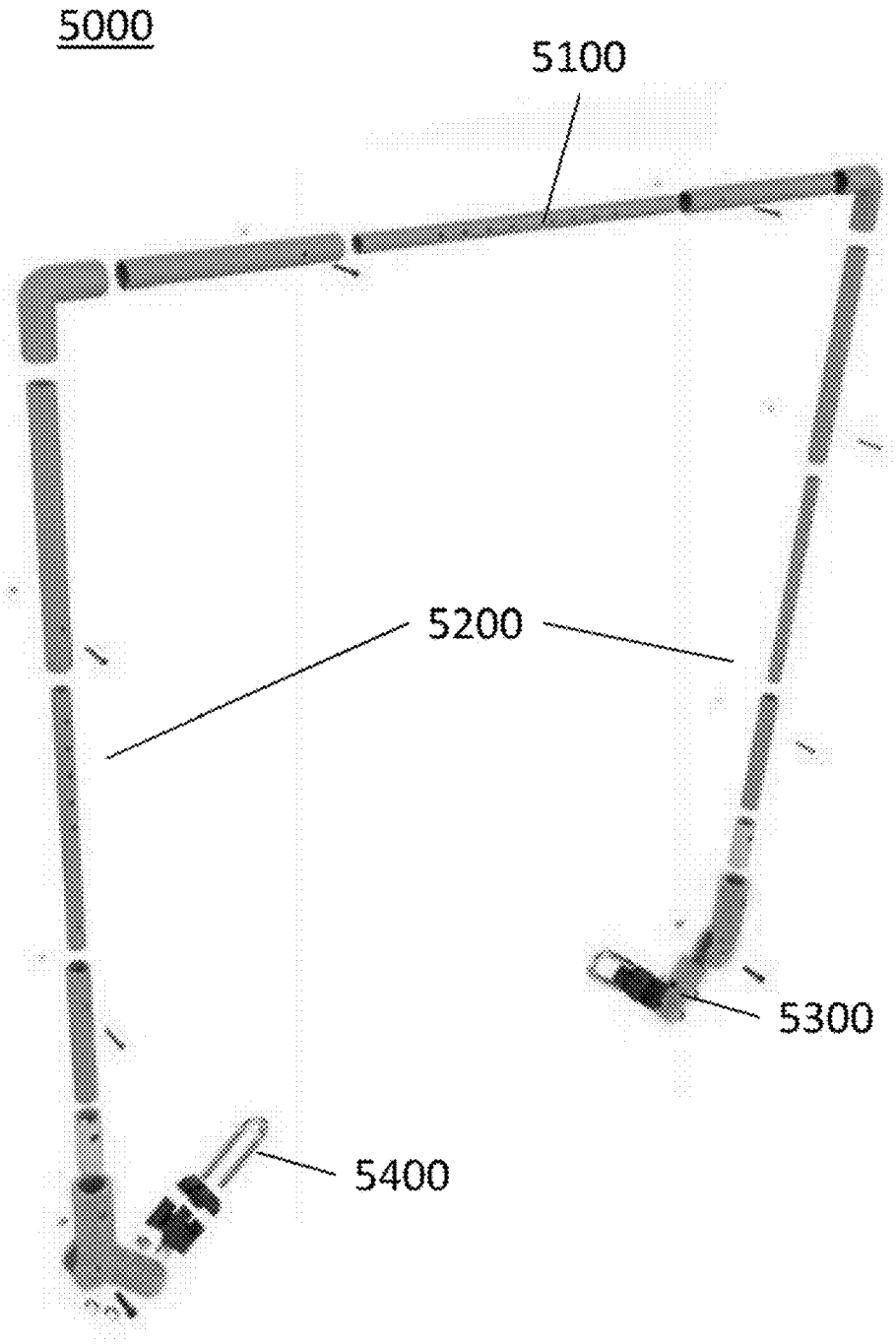
FIG. 53 illustrates a schematic view of another embodiment of a frame of an exercise apparatus for attaching to assistive ambulation equipment.

FIG. 53 illustrates a schematic view of another embodiment of an attachment frame of an exercise apparatus for attaching to assistive ambulation equipment. As illustrated in FIG. 53, the attachment frame 5000 includes a horizontal frame portion 5100 and vertical frame portions 5200.

Horizontal frame portion 5100 is telescopic, thereby allowing adjustment of the width of the attachment frame 5000. Vertical frame portions 5200 are telescopic, thereby allowing adjustment of the height of the attachment frame 5000.

The attachment frame 5000 of an exercise apparatus can be attached to the assistive ambulation equipment via u-bolt clamps 5400 which are connected to the vertical frame portions 5200 via rotatable joints 5300. The rotatable joints 5300 allow the user to rotate the u-bolt clamps 5400 to attach to both vertical and/or horizontal bars of the assistive ambulation equipment. It noted that the u-bolt clamps 5400 may be other type of clamps that enable attachment to cylindrical shapes (bars).

Various types of accessories, such as the striking mechanisms and capture/striking mechanisms described above, can be detachably attached to the attachment frame 5000. Moreover, a control panel for controlling the operations of the attached accessory can be detachably attached to the horizontal frame portion 5100 of the attachment frame 5000.

Figure 54:
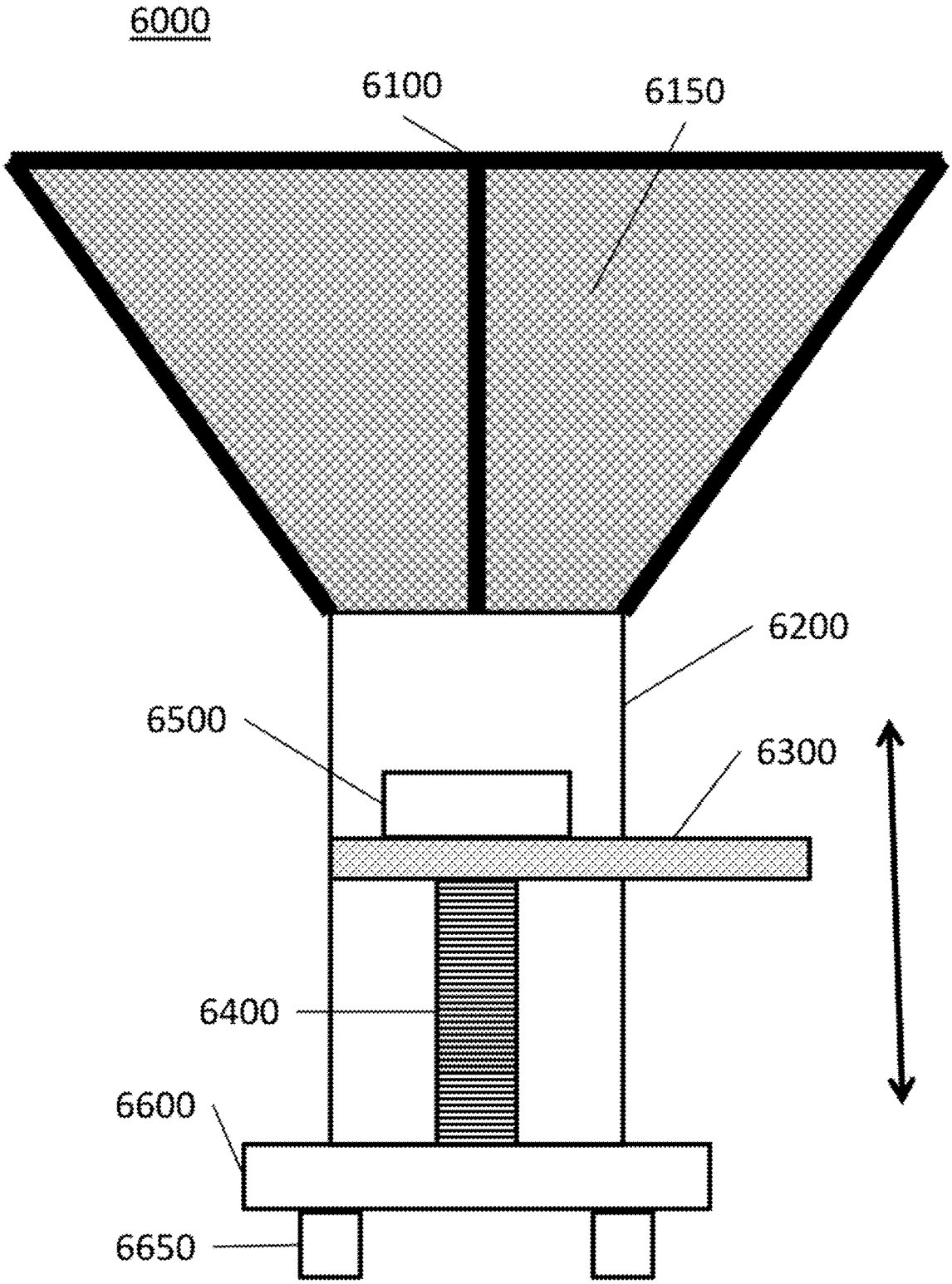
FIG. 54 illustrates a catch and launch apparatus for use with assistive ambulation equipment.

FIG. 54 illustrates a catch and launch apparatus for use with assistive ambulation equipment. As illustrated in FIG. 54, the catch and launch apparatus 6000 includes a catching mechanism including a netting 6150 and frame 6100. The catching mechanism may be cone shape so as to funnel the caught object towards a center thereof. The frame 6100 provides the shape of catching mechanism and the netting 6150 provides a forgivable backstop to slow an object to be caught, thereby enhancing the effectiveness of the catching mechanism.

The catch and launch apparatus 6000 also includes a launching housing 6200, which is attached to the netting 6150 and frame 6100 of the catching mechanism. Within the launching housing 6200, the catch and launch apparatus 6000 includes a launching/striking member 6500 for striking the caught object to launch it from the catch and launch apparatus 6000.

The launching/striking member 6500 is set by moving a launch arm/handle 6300 away from the catching mechanism. As the launch arm/handle 6300 is moved away from the catching mechanism, a spring 6400 is compressed such that when the launch arm/handle 6300 is released, the launching/striking member 6500 is propelled towards the catching mechanism to strike the caught object.

The launching housing 6200 includes a channel to allow the launch arm/handle 6300 move towards and away from the catching mechanism. The channel may include side channels into which the launch arm/handle 6300 can be moved so that the launch arm/handle 6300 is held at a predetermined position by the side channel.

The catch and launch apparatus 6000 includes an attachment base 6600 for anchoring one side of the spring 6400 and includes attachment members 6650 for detachably attaching the catch and launch apparatus 6000 to a frame associated with assistive ambulation equipment, such as the frames described above.

Figure 55:
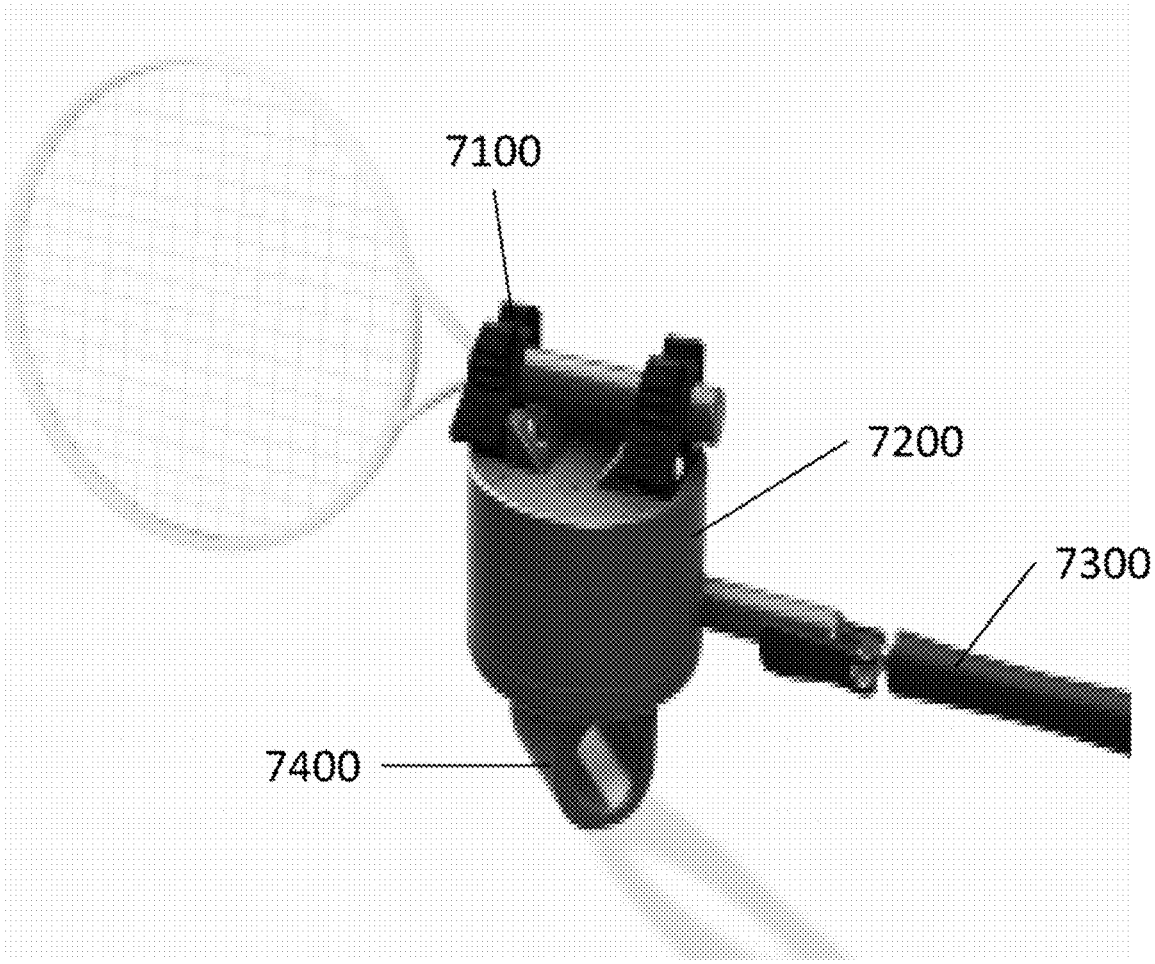
FIG. 55 illustrates a striking apparatus for use with assistive ambulation equipment.

FIG. 55 illustrates a striking apparatus for use with assistive ambulation equipment. As illustrated in FIG. 55, the striking apparatus 7000 includes a striking attachment mechanism 7100 for detachably attaching a striking device, such as a bat or tennis racket, to the striking apparatus 7000. The striking apparatus 7000 also includes a gear assembly 7200 for translating movement of a handle 7300 to movement of the striking device. The striking apparatus 7000 includes a frame attachment mechanism 7400 for detachably attaching the striking apparatus 7000 to a frame associated with assistive ambulation equipment, such as the frames described above.

Figure 56:
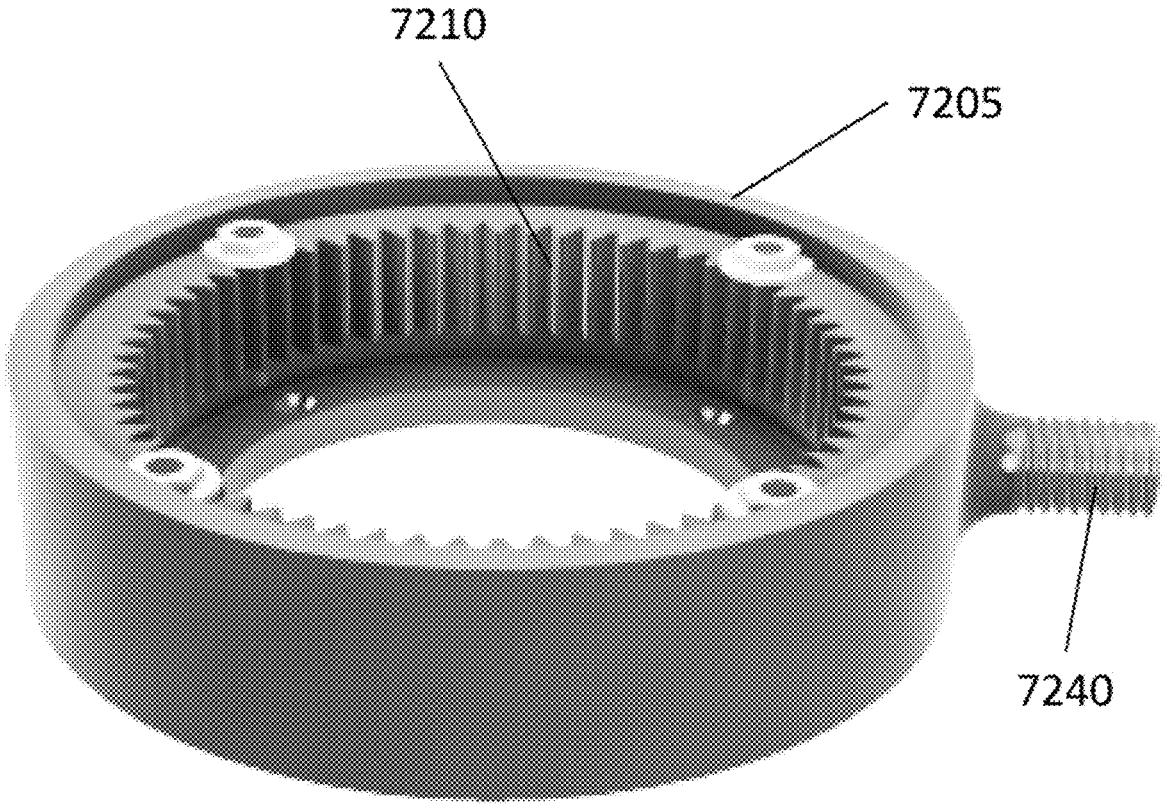
FIG. 56 illustrates an outer gear assembly of the striking apparatus of FIG. 55.

FIG. 56 illustrates an outer gear assembly of the striking apparatus of FIG. 55. As illustrated in FIG. 56, an outer gear assembly of the gear assembly of FIG. 55 includes a gear housing 7205 having gear teeth 7210 located on an interior circumference of the gear housing 7205. The outer gear assembly further includes a handle attachment mechanism 7240 to detachably attach the handle 7300 of FIG. 55 to the gear assembly 7200 of FIG. 55.

Figure 57:
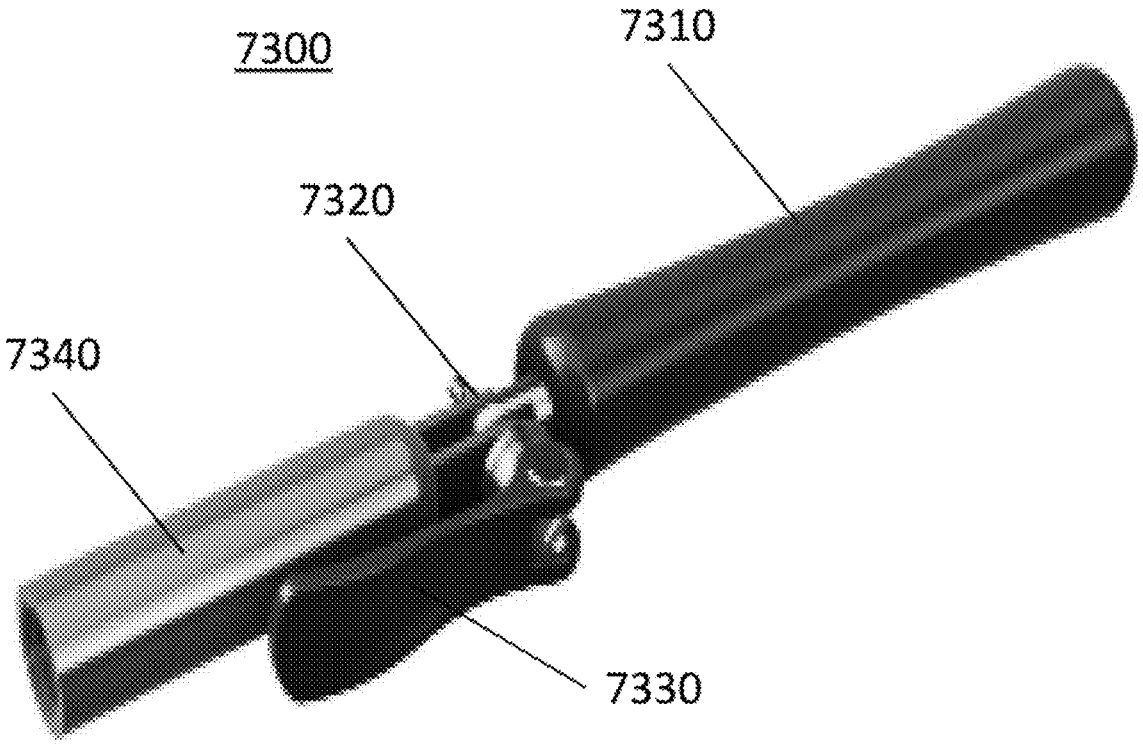
FIG. 57 illustrates a handle assembly of the striking apparatus of FIG. 55.

FIG. 57 illustrates a handle assembly of the striking apparatus of FIG. 55. As illustrated in FIG. 57, the handle assembly 7300 includes an outer gear assembly attachment mechanism 7340 to detachably attach the handle 7300 of FIG. 55 to the gear assembly 7200 of FIG. 55. The handle assembly 7300 also includes a handle portion 7310, which is rotatably detachably attached to the outer gear assembly attachment mechanism 7340, via rotatable joint 7320. The rotatable joint 7320 can be locked into a position using locking mechanism 7330.

Figure 58:
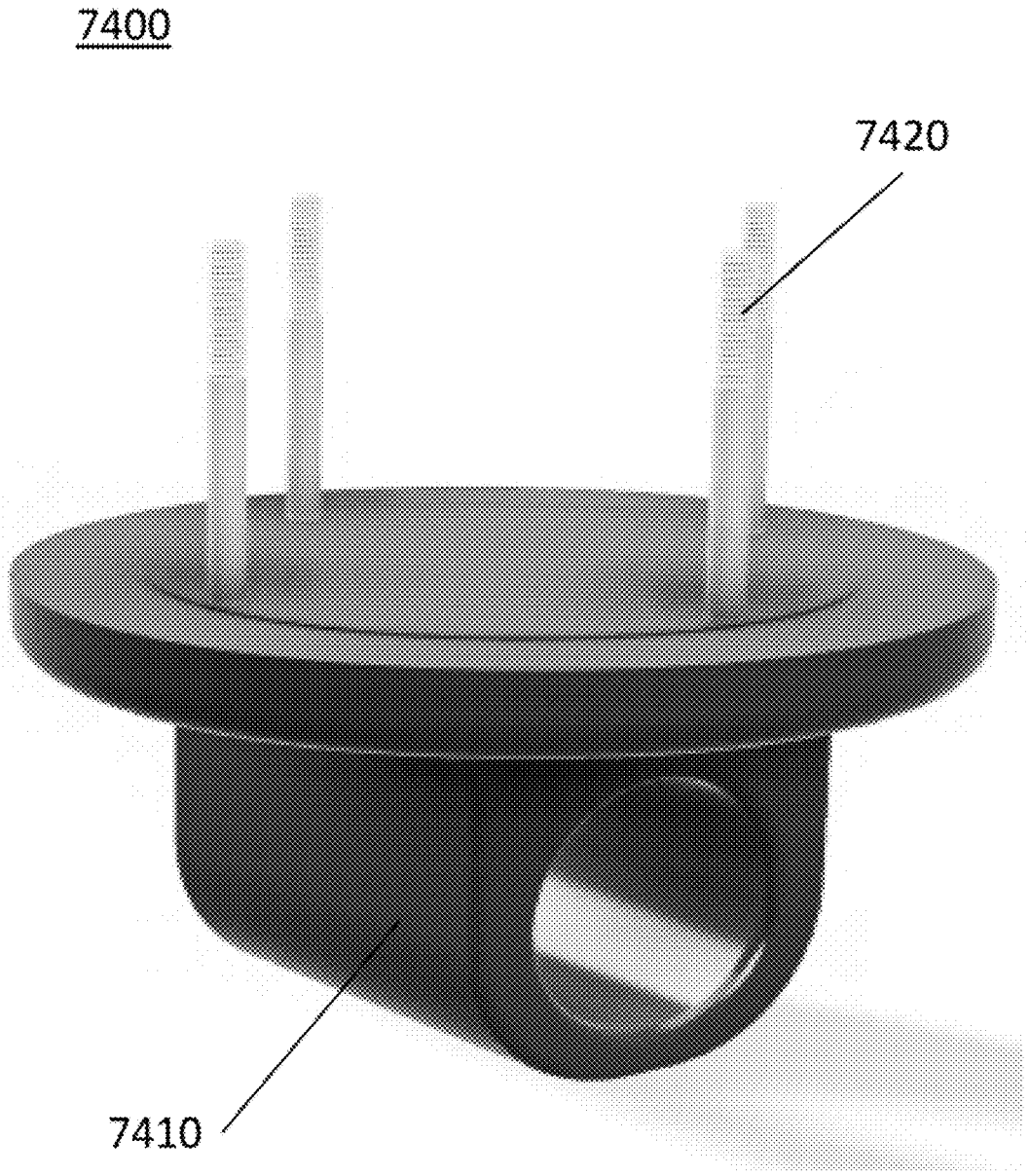
FIG. 58 illustrates an assistive ambulation equipment attachment assembly of the striking apparatus of FIG. 55.

FIG. 58 illustrates an assistive ambulation equipment attachment assembly of the striking apparatus of FIG. 55. As illustrated in FIG. 58, assistive ambulation equipment attachment assembly 7400 includes an assistive ambulation equipment attachment mechanism 7410 to detachably attach the striking apparatus 7000 to a frame associated with assistive ambulation equipment, such as the frames described above. The assistive ambulation equipment attachment assembly 7400 also includes anchor pins 7420 for preventing a planet gear assembly, as described below, from rotating when the handle assembly 7300 is moved.

Figure 59:
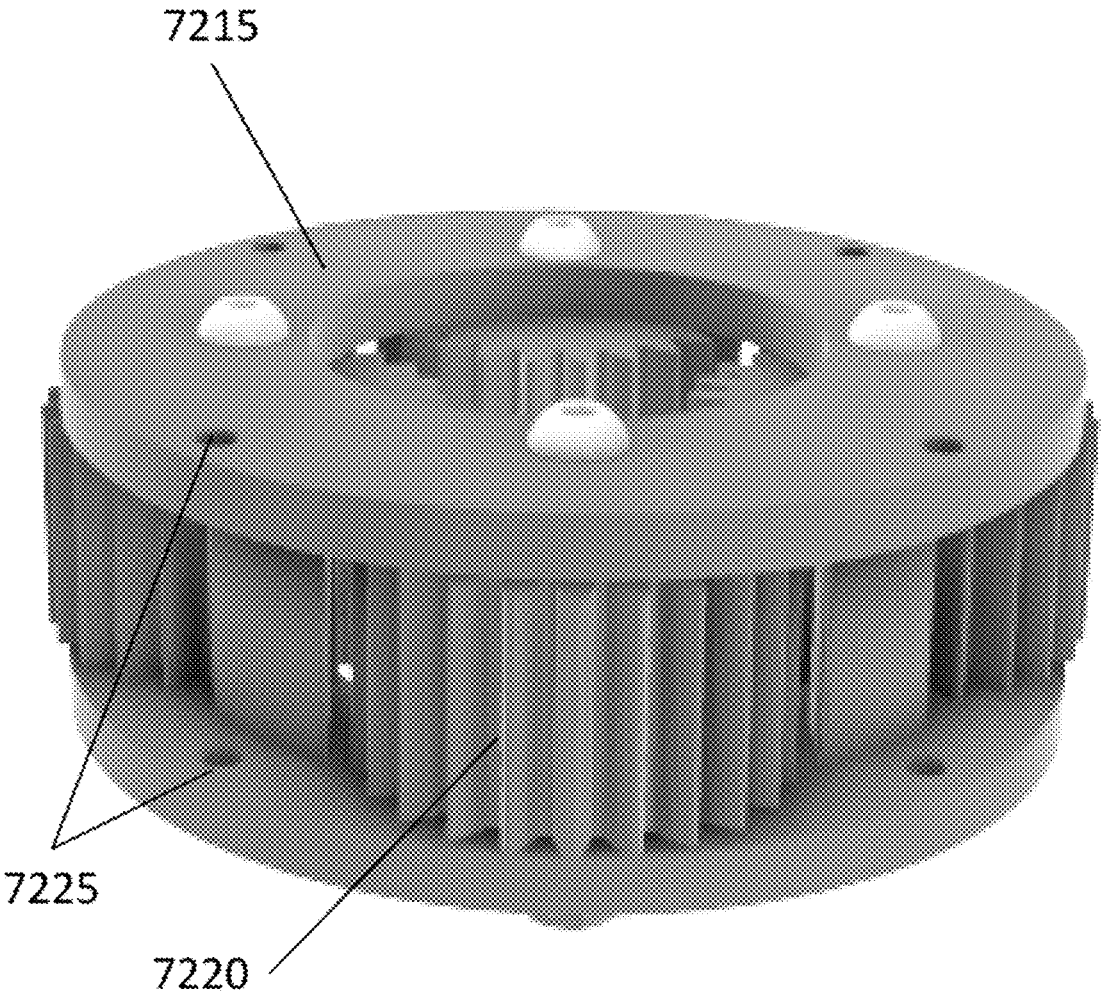
FIG. 59 illustrates a planet gear assembly of the striking apparatus of FIG. 55.

FIG. 59 illustrates a planet gear assembly of the striking apparatus of FIG. 55. As illustrated in FIG. 59, the planet gear assembly includes rotatable planet gears 7220, sandwiched between planet gear assembly housing plates 7215. The rotatable planet gears 7220 are operational connected to the gear teeth 7210 of the outer gear assembly when the striking apparatus 7000 is fully assembled, such that movement of the gear teeth 7210 impart rotational movement upon the rotatable planet gears 7220.

The planet gear assembly also includes receiving holes 7225 for receiving the anchor pins 7420 of the assistive ambulation equipment attachment assembly 7400, thereby locking the planet gear assembly with the assistive ambulation equipment attachment assembly 7400.

Figure 60:
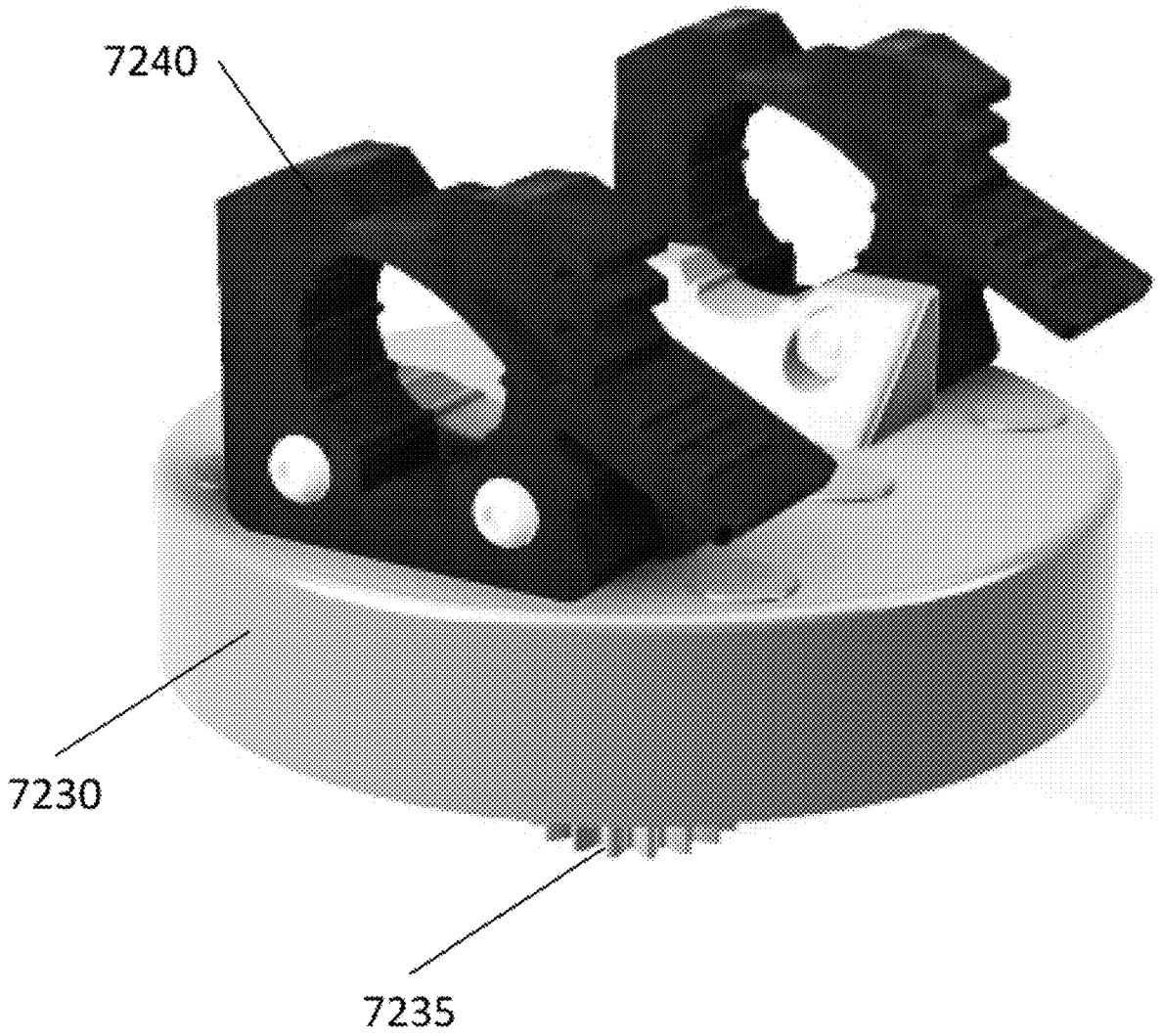
FIG. 60 illustrates a sun gear and striking mechanism attachment assembly of the striking apparatus of FIG. 55.

FIG. 60 illustrates a sun gear and striking mechanism attachment assembly of the striking apparatus of FIG. 55. As illustrated in FIG. 60, the sun gear and striking mechanism attachment assembly includes a sun gear 7235, which is operational connected to the rotatable planet gears 7220, such that movement of the rotatable planet gears 7220 impart rotational movement upon the sun gear 7235, thereby causing an attached striking device to move.

The sun gear and striking mechanism attachment assembly also includes a housing 7230 that rotates with the rotation of the sun gear 7235 and striking device attachment mechanisms 7240 for detachably attaching a striking device. The interface between the housing 7230 and gear housing 7205 of FIG. 56 provides slideable movement between the housings while the planet gear assembly remains motionless.

Figure 61:
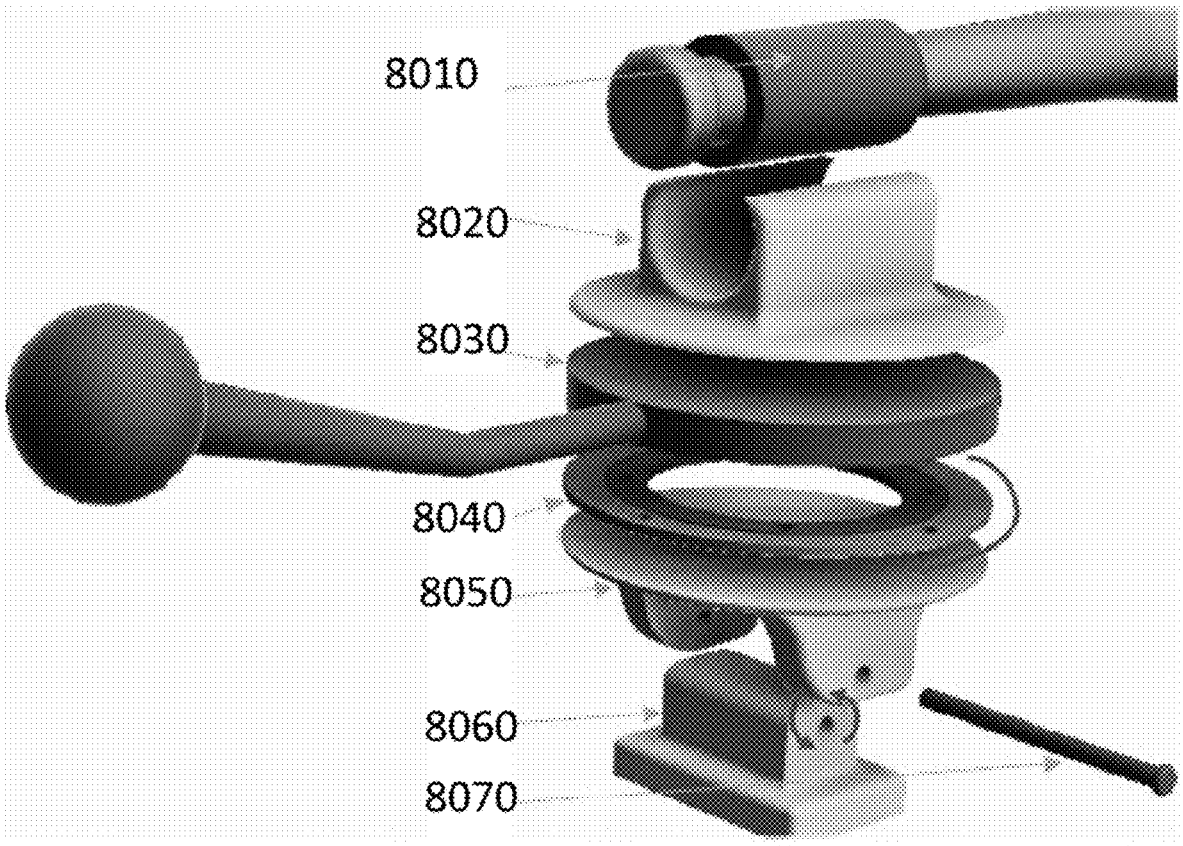
FIG. 61 illustrates another embodiment of a striking apparatus for use with assistive ambulation equipment.

FIG. 61 illustrates another embodiment of a striking apparatus for use with assistive ambulation equipment. As illustrated in FIG. 61, the striking apparatus 8000 includes a striking device adapter 8010 to enable attachment of a striking device to a striking device holder 8020. The striking device holder 8020 is connected to a level 8030, which rotates upon a lazy-Susan bearing plate 8040 to allow horizontal rotation of the lever 8030.

The lazy-Susan bearing plate 8040 is connected to a pivot plate 8050 to allow vertical rotation of the striking apparatus 8000. The pivot plate 8050 is secured to a frame attachment mechanism 8060, through a pin 8070. The frame attachment mechanism 8060 detachably attaches the striking apparatus 8000 to a frame associated with assistive ambulation equipment, such as the frames described above.

Figure 62:
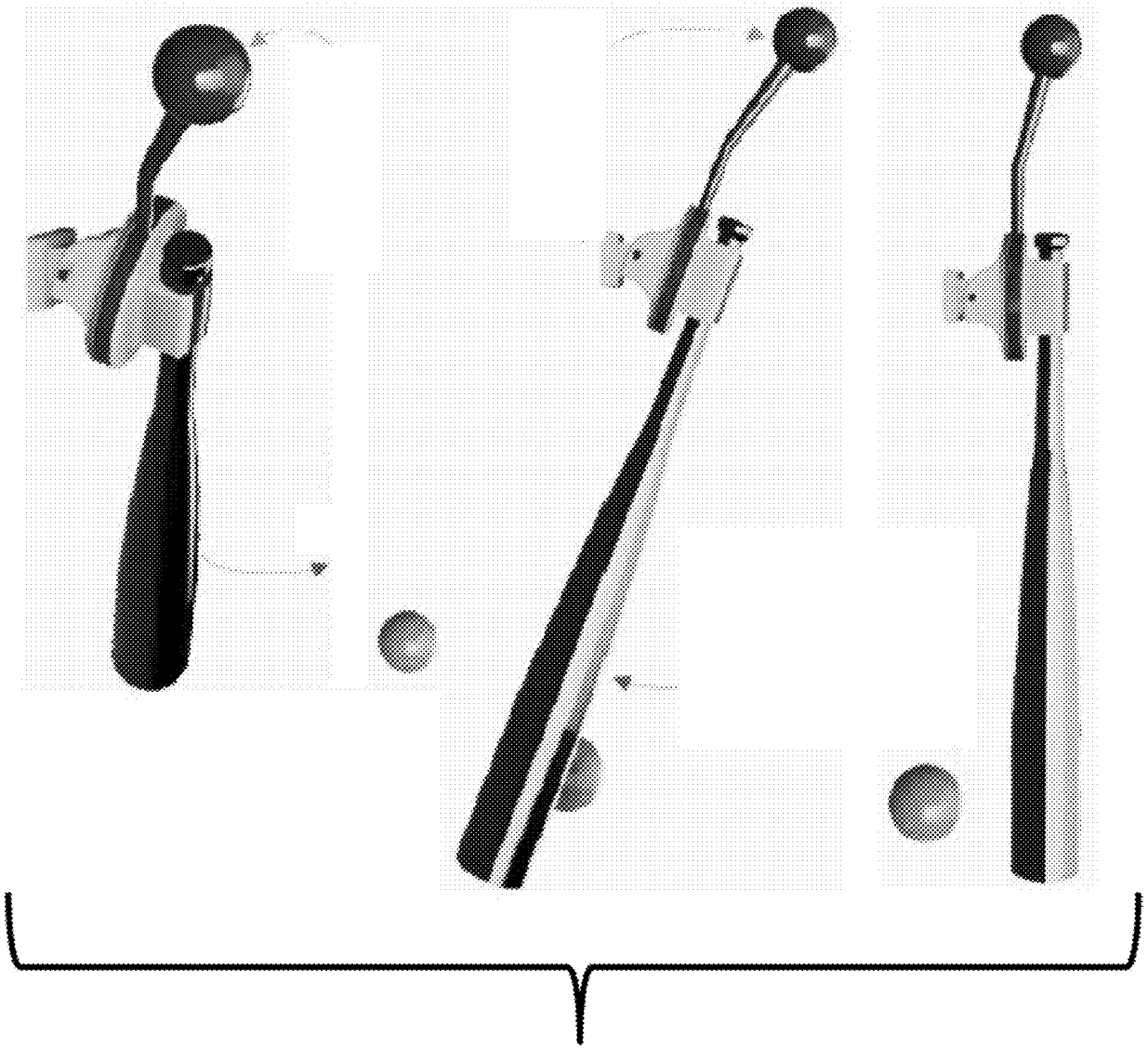
FIG. 62 illustrates the operation of the striking apparatus of FIG. 61.

FIG. 62 illustrates the operation of the striking apparatus of FIG. 61. As illustrated in FIG. 62, the striking device can be rotated in a vertical direction as well as rotated in a horizontal direction, thereby providing two-dimensional rotational movement of the striking device.

Figure 63:
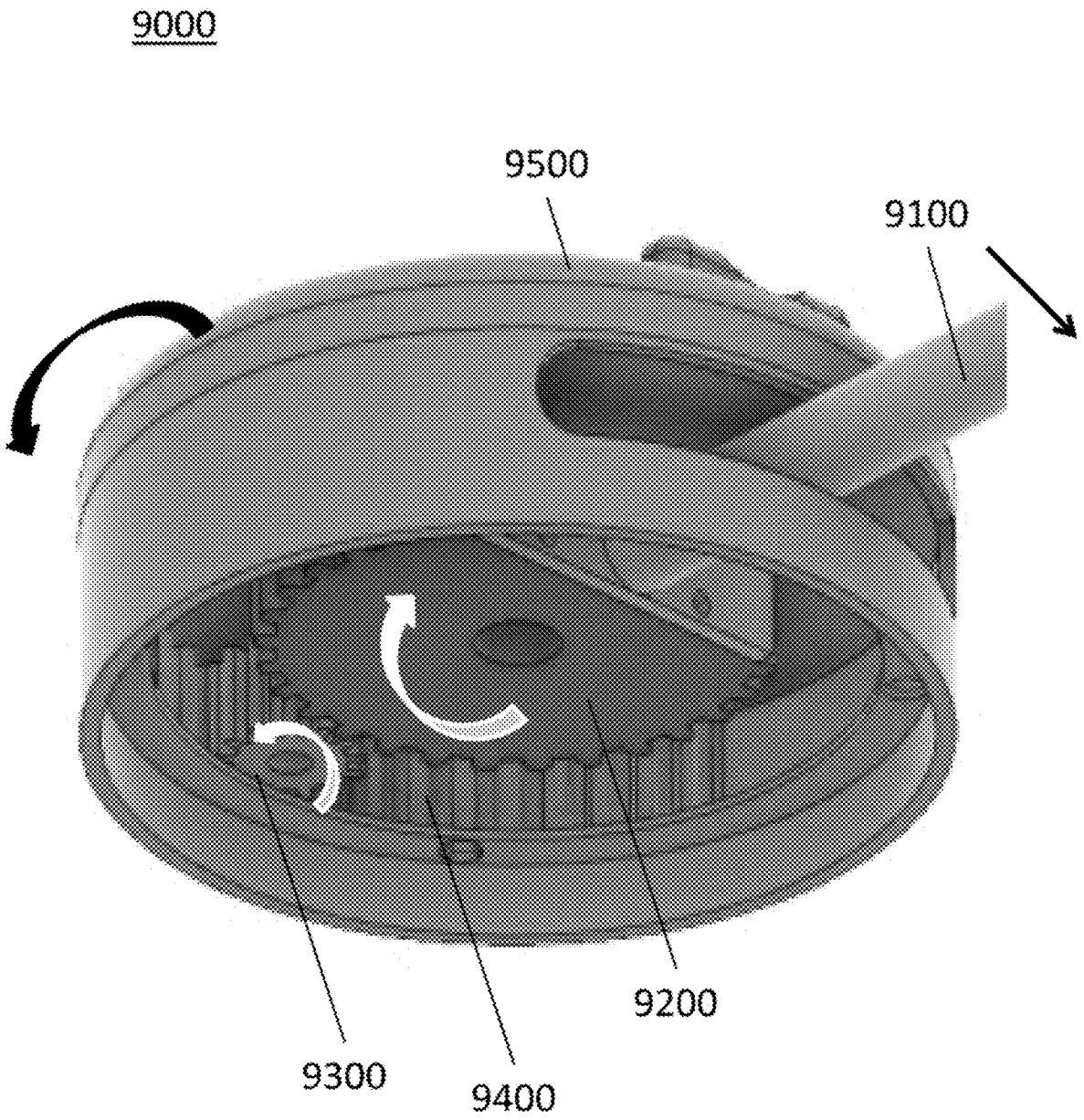
FIG. 63 illustrates a gear assembly of another embodiment of a striking apparatus for use with assistive ambulation equipment.

FIG. 63 illustrates a gear assembly of another embodiment of a striking apparatus for use with assistive ambulation equipment. As illustrated in FIG. 63, the gear assembly 9000 includes a handle 9100 attached to a handle gear 9200. As the handle 9100 is moved (illustrated arrow), the handle gear 9200 rotates in a clockwise direction (illustrated large white rotation arrow). The clockwise rotation of the handle gear 9200 causes a transfer gear 9300 to rotate in a counter-clockwise direction (illustrated small white rotation arrow). The counter-clockwise rotation of the transfer gear 9300 causes a striking device attachment housing 9500 to rotate in a clockwise direction (illustrated black rotation arrow).

Figure 64:
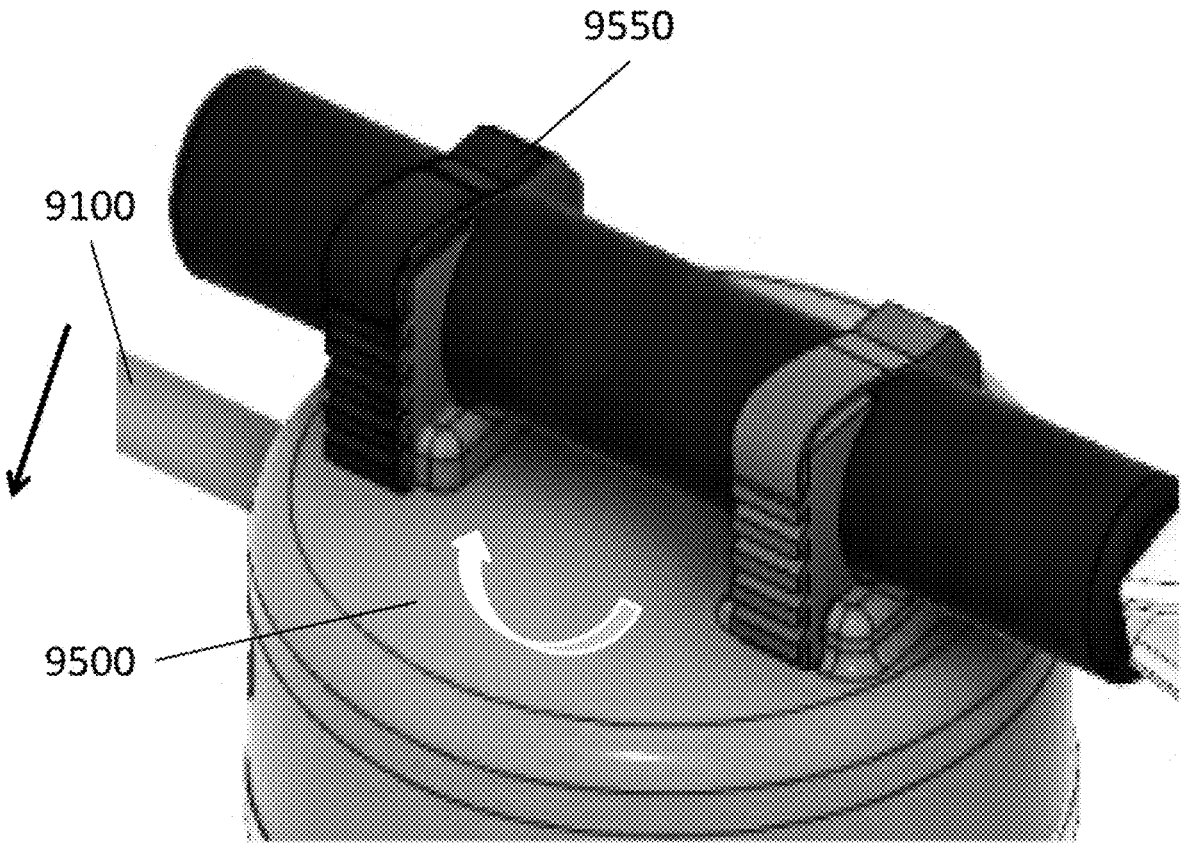
FIG. 64 illustrates a rotation relationship of the striking device of FIG. 63.

FIG. 64 illustrates a rotation relationship of the striking device of FIG. 63. As illustrated in FIG. 64, as the handle 9100 is moved in the direction of the arrow, the striking device attachment housing 9500 is rotated in the direction of the white rotation arrow such that the striking area of the striking device, attached to attachment mechanisms 9550, is moved in same direction as the handle 9100.

Figure 65:
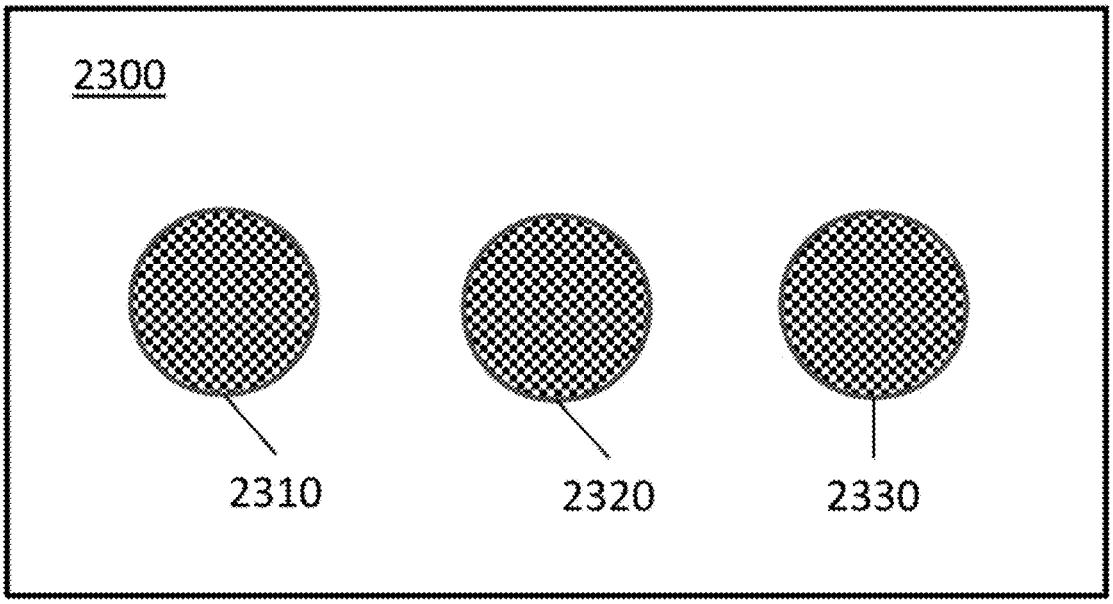
FIG. 65 illustrates a control panel for the striking apparatus of FIG. 43.

FIG. 65 illustrates a control panel for a striking apparatus. The control panel 2300, as illustrated, includes various input activatable areas (2310, 2320, and 2330) to enable the user to control the operations of the attached striking apparatus. For example, if the striking device of FIG. 43 is attached to the control panel, input activatable area 2310 may open the capture arms, input activatable area 2320 may close the capture arms, and input activatable area 2330 may activate the striking mechanism. The various input activatable areas (2310, 2320, and 2330) may be push buttons, activatable areas on a touchscreen, a joystick, or other input mechanism that enables a user to input commands for operating an attached striking apparatus.

Figure 66:
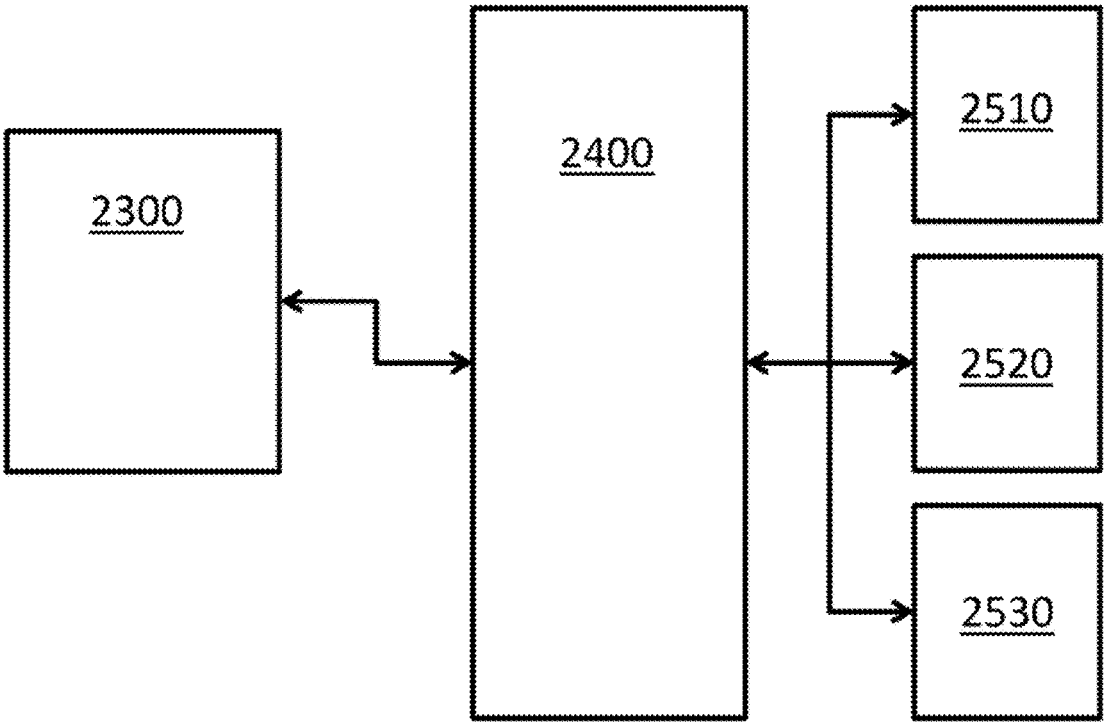
FIG. 66 illustrates a schematic view of the electronic control system for the striking apparatus of FIG. 43.

FIG. 66 illustrates a block diagram of the control system for a striking device. As illustrated in FIG. 66, a control panel 2300 is communicatively connected to a controller 2400, which is communicatively connected to servos 2510, 2520, and 2530. As the user input commands, through the control panel 2300, the commands are communicated to the controller 2400. The communication may be hard wired or wireless. Based upon the received commands, the controller 2400 communicates commands or control signals to servos 2510, 2520, and 2530 to control the various operations of the striking apparatus. The control system may include a power source, such as a battery or rechargeable battery, to power the control panel 2300, the controller 2400, and/or the servos 2510, 2520, and 2530.

A striking mechanism for assistive ambulation equipment includes a front portion frame; capture arms, attached to the front portion frame for capturing an object; and launching mechanism for launching a captured object in a direction away from the front portion frame.

The striking mechanism may include capture arm servos for moving the capture arms. The striking mechanism may include a launching mechanism servo for moving the launching mechanism.

The launching mechanism may include a striking member; a drive gear; a transfer gear operatively connected to the drive gear; a launching mechanism interface gear operatively connected to the transfer gear; a straight gear operatively connected to the striking member; and a spring operatively connected to the striking member. The launching mechanism interface gear may include teeth formed on a portion of an outer circumference of the launching mechanism interface gear such that when the straight gear disengages from a last tooth of the launching mechanism interface gear, the spring causes the striking member to propel towards the front portion frame.

The launching mechanism may include a striking member; a drive gear; a transfer gear operatively connected to the drive gear; a launching mechanism interface gear operatively connected to the transfer gear; a straight gear operatively connected to the striking member; and a spring operatively connected to the straight gear. The striking mechanism may include a control panel for enabling a user to input operation command; a controller, communicatively connected to the control panel, for controlling operations of the capture arms and the launching mechanism; and servos, operatively connected to the capture arms and the launching mechanism, to move the capture arms and the launching mechanism. The front frame portion may include a curved portion for receiving a captured object; the launching mechanism striking the captured object located in the curved portion.

A striking apparatus for assistive ambulation equipment includes striking apparatus attachment members for detachably attaching a striking device to the striking apparatus; a sun gear; a plurality of planet gears operatively connected to the sun gear; a handle gear ring, operatively connected to the plurality of planet gears, having gear teeth on an interior circumference thereof; a handle, detachably connected to the handle gear ring; and an exercise apparatus attachment member, operatively connected to the handle gear ring, for detachably attaching the striking apparatus to assistive ambulation equipment.

The striking apparatus may include a striking apparatus rotating member operatively connected to the sun gear and the striking apparatus attachment members; the striking apparatus rotating member rotating when the sun gear rotates. The striking apparatus may include a planet gear retainer operatively connected to the plurality of planet gears and the handle gear ring; the planet gear retainer not rotating when the plurality of planet gears rotate. The striking apparatus may include a striking apparatus rotating member operatively connected to the sun gear and the striking apparatus attachment members; the striking apparatus rotating member rotating when the sun gear rotates; a planet gear retainer operatively connected to the plurality of planet gears and the handle gear ring; the planet gear retainer not rotating when the plurality of planet gears rotate; the plurality of planet gears rotating when the handle gear ring rotates; the planet gear retainer not rotating when the handle gear ring rotates; the sun gear rotating when the plurality of planet gears rotate.

A catch/striking apparatus for assistive ambulation equipment includes a catching mechanism for catching an object; a launching mechanism, operatively connected to the catching mechanism, for propelling the caught object; and an exercise apparatus attachment member, operatively connected to the launching mechanism, for detachably attaching the catch/striking apparatus to assistive ambulation equipment; the catching mechanism including netting; the launching mechanism including a housing, a handle, a striking member operatively connected to the handle, and a spring operatively connected to the handle; the housing including a channel for the handle.

The channel may include side channels for holding the handle in predetermined positions.

A striking apparatus includes a striking apparatus attachment member for detachably attaching a striking device to the striking apparatus; a sun gear; a plurality of planet gears operatively connected to the sun gear; a handle gear ring, operatively connected to the plurality of planet gears, having gear teeth on an interior circumference thereof; a handle, detachably connected to the handle gear ring; and an stand operatively connected to the handle gear ring.

The striking apparatus may include a striking apparatus rotating member operatively connected to the sun gear and the striking apparatus attachment member; the striking apparatus rotating member rotating when the sun gear rotates.

The striking apparatus may include a planet gear retainer operatively connected to the plurality of planet gears and the handle gear ring; the planet gear retainer not rotating when the plurality of planet gears rotate.

The striking apparatus may include a striking apparatus rotating member operatively connected to the sun gear and the striking apparatus attachment member; the striking apparatus rotating member rotating when the sun gear rotates; a planet gear retainer operatively connected to the plurality of planet gears and the handle gear ring; the planet gear retainer not rotating when the plurality of planet gears rotate; the plurality of planet gears rotating when the handle gear ring rotates; the planet gear retainer not rotating when the handle gear ring rotates; the sun gear rotating when the plurality of planet gears rotate.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A striking mechanism for assistive ambulation equipment, comprising:

a front portion frame having a first end, a second end, and a middle portion located between said first end and said second end;

a first capture arms, movably attached to said first end of said front portion frame, for capturing an object;

a second capture arm, movably attached to said second end of said front portion frame, for capturing the object; and launching mechanism, operatively attached to said middle portion of said front portion frame, for launching a captured object in a direction away from said front portion frame;

said front frame portion including a curved portion for receiving a captured object;

said launching mechanism striking the captured object located in said curved portion.

2. The striking mechanism as claimed in claim 1, further comprising capture arm servos for moving said first and second capture arms.

3. The striking mechanism as claimed in claim 2, further comprising a launching mechanism servo for moving said launching mechanism.

4. The striking mechanism as claimed in claim 1, further comprising a launching mechanism servo for moving said launching mechanism.

5. The striking mechanism as claimed in claim 1, wherein said launching mechanism comprises:

a striking member;

a drive gear;

a transfer gear operatively connected to said drive gear;

a launching mechanism interface gear operatively connected to said transfer gear;

a straight gear operatively connected to said striking member; and a spring operatively connected to said striking member.

6. The striking mechanism as claimed in claim 5, wherein said launching mechanism interface gear includes teeth formed on a portion of an outer circumference of said launching mechanism interface gear such that when said straight gear disengages from a last tooth of said launching mechanism interface gear, said spring causes said striking member to propel towards said front portion frame.

7. The striking mechanism as claimed in claim 1, wherein said launching mechanism comprises:

a striking member;

a drive gear;

a transfer gear operatively connected to said drive gear;

a launching mechanism interface gear operatively connected to said transfer gear;

a straight gear operatively connected to said striking member; and a spring operatively connected to said straight gear.

8. The striking mechanism as claimed in claim 7, wherein said launching mechanism interface gear includes teeth formed on a portion of an outer circumference of said launching mechanism interface gear such that when said straight gear disengages from a last tooth of said launching mechanism interface gear, said spring causes said striking member to propel towards said front portion frame.

9. The striking mechanism as claimed in claim 1, further comprising:

a control panel for enabling a user to input operation command;

a controller, communicatively connected to said control panel, for controlling operations of said first and second capture arms and said launching mechanism; and servos, operatively connected to said first and second capture arms and said launching mechanism, to move said first and second capture arms and said launching mechanism.

* * * * *